US012208302B2

(12) United States Patent
Nesemeier et al.

(10) Patent No.: US 12,208,302 B2
(45) **Date of Patent: *Jan. 28, 2025**

(54) EXERCISE RACK PULLEY SYSTEM

(71) Applicant: PRx Performance, LLC, Fargo, ND (US)

(72) Inventors: Michael W. Nesemeier, Leonard, ND (US); Kathryn A. Johnson, Littleton, CO (US); Garrett A. Iverson, Fargo, ND (US); Alexander M. Johnson, Fargo, ND (US); Austin R. Birrenkott, West Fargo, ND (US)

(73) Assignee: PRx Performance, LLC, Fargo, ND (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/412,667

(22) Filed: Jan. 15, 2024

(65) Prior Publication Data

US 2024/0149100 A1 May 9, 2024

Related U.S. Application Data

(63) Continuation of application No. 17/545,230, filed on Dec. 8, 2021, now Pat. No. 11,872,436.

(51) Int. Cl.
*A63B 21/00* (2006.01)
*A63B 21/062* (2006.01)

(52) U.S. Cl.
CPC ..... *A63B 21/154* (2013.01); *A63B 21/062* (2013.01); *A63B 21/4035* (2015.10); *A63B 2225/09* (2013.01)

(58) Field of Classification Search
CPC ..... A63B 17/00; A63B 17/04; A63B 21/062; A63B 21/0624; A63B 21/0626;
(Continued)

(56) References Cited

U.S. PATENT DOCUMENTS 4,257,590 A 3/1981 Sullivan
4,657,246 A 4/1987 Salyer
(Continued)

FOREIGN PATENT DOCUMENTS

KR 20220020178 A 2/2022

OTHER PUBLICATIONS https://www.roguefitness.com/rogue-monster-lite-slinger; Rogue Fitness "Rogue Monster Lite Slinger" Webpage; Oct. 21, 2021.
(Continued)

*Primary Examiner* — Gary D Urbiel Goldner
(74) *Attorney, Agent, or Firm* — Neustel Law Offices

(57) ABSTRACT

An exercise rack pulley system for providing a wide range of versatile arrangements of pulleys on an exercise rack. An example embodiment generally includes an exercise rack including one or more support members and arm members. One or more pulley units may be attached to one or more support members and/or arm members of the exercise rack. Each of the pulley units includes a bracket for attaching to the exercise rack and a frame for supporting a rotatable pulley. The frame is adjustably connected with the bracket such that each pulley unit may be adjusted between at least two positions, including a first position in which the frame is parallel with the bracket and a second position in which the frame is perpendicular with the bracket. A cable is routed through the pulley units and connected to a weight to accommodate a wide range of different types of exercises.

20 Claims, 40 Drawing Sheets

(58) Field of Classification Search
CPC ... A63B 21/0628; A63B 21/15; A63B 21/151; A63B 21/152; A63B 21/154; A63B 21/156; A63B 21/4033; A63B 21/4035; A63B 21/4043; A63B 21/4047; A63B 21/4049; A63B 23/12; A63B 23/1209; A63B 23/1218; A63B 23/1281; A63B 2225/09; A63B 2225/093; A63B 2225/10; A63B 2225/102; A63B 2225/105; A63B 2225/107
See application file for complete search history.

(56) References Cited

U.S. PATENT DOCUMENTS

| | | | | |
|---|---|---|---|---|
| 9,333,387 | B2 | 5/2016 | Hopperstad | |
| 9,844,691 | B2 | 12/2017 | Hopperstad | |
| 10,953,301 | B2 | 3/2021 | Brasch | |
| 11,058,936 | B1 | 7/2021 | Brasch | |
| 11,872,436 | B2 * | 1/2024 | Nesemeier | A63B 21/154 |
| 2019/0240525 | A1 | 8/2019 | Leipheimer | |
| 2019/0336812 | A1 | 11/2019 | Leipheimer | |
| 2020/0114195 | A1 | 4/2020 | Henniger | |
| 2020/0222745 | A1 | 7/2020 | Leipheimer | |
| 2021/0170218 | A1 | 6/2021 | Lewis-Dove | |
| 2021/0283451 | A1 | 9/2021 | Gvoich | |
| 2022/0072361 | A1 | 3/2022 | Henniger | |
| 2022/0096891 | A1 | 3/2022 | Yang | |
| 2022/0233909 | A1 | 7/2022 | Williams | |
| 2023/0173329 | A1 * | 6/2023 | Nesemeier | A63B 21/062 482/103 |

OTHER PUBLICATIONS https://surplusstrength.com/products/ups-high-universal-pulley-system; Surplus Strength "UPS High (Universal Pulley System)" Webpage; Oct. 21, 2021.

https://www.tuffstuffitness.com/product/cxt-200-evolution-functional-trainer/; Tuff Stuff Fitness International Webpage Evolution Corner Dual Stack Multi-Functional Trainer (CXT-200); Nov. 1, 2021.

https://repfitness.com/products/ft-5000-functional-trainer; REP Fitness Webpage "FT-5000 Functional Trainer"; Nov. 1, 2021.

https://www.instagram.com/reel/CUxce_7gAvr/?utm_source=ig_web_copy_link; REP Fitness Equipment Instagram Post "What New Product Are We Releasing"; Oct. 8, 2021.

https://www.instagram.com/p/CU-O2OujbuV/?utm_source=ig_web_copy_link; REP Fitness Equipment Instagram Post "We've Been Busy"; Oct. 13, 2021.

* cited by examiner

EXERCISE RACK PULLEY SYSTEM

CROSS REFERENCE TO RELATED APPLICATIONS

The present application is a continuation of U.S. application Ser. No. 17/545,230 filed on Dec. 8, 2021. Each of the aforementioned patent applications is herein incorporated by reference in their entirety.

STATEMENT REGARDING FEDERALLY SPONSORED RESEARCH OR DEVELOPMENT

Not applicable to this application.

BACKGROUND

The described example embodiments in general relate to an exercise rack pulley system for providing a wide range of versatile arrangements of pulleys on an exercise rack. More and more people are looking to stay fit, particularly during times of quarantine and self-isolation. Along with the desire to stay fit, there has been a greater demand for more versatile exercise equipment which allows an exerciser to perform many different exercises with less equipment being required. Such a benefit would apply equally to exercise studios and home gyms. In both cases, studio owners and exercisers seek exercise equipment that can perform multiple types of exercises while limiting the amount of parts needed and time spent adjusting between configurations.

Many types of exercises used in both exercise studios and home gyms rely upon one or more pulleys which may be manipulated to perform various exercise movements, typically including some type of resistance being applied against a cord or other elongated member extending over the pulley. While pulleys are commonly used in exercise studios and home gyms, they are often limited in versatility, require the use of different pulleys for different orientations, and are difficult to set up and take down.

Thus, there is a demand for pulleys which are versatile, easy-to-install, and can accommodate multiple different configurations and orientations with limited parts to keep track of.

SUMMARY

Some of the various embodiments of the present disclosure relate to an exercise rack pulley system for providing a wide range of versatile arrangements of pulleys on an exercise rack. An example embodiment generally includes an exercise rack including one or more support members and arm members. One or more pulley units may be attached to one or more support members and/or arm members of the exercise rack. Each of the pulley units includes a bracket for attaching to the exercise rack and a frame for supporting a rotatable pulley. The frame is adjustably connected with the bracket such that each pulley unit may be adjusted between at least two positions, including a first position in which the frame is parallel with the bracket and a second position in which the frame is perpendicular with the bracket. A cable is routed through the pulley units and connected to a weight to accommodate a wide range of different types of exercises.

There has thus been outlined, rather broadly, some of the embodiments of the present disclosure in order that the detailed description thereof may be better understood, and in order that the present contribution to the art may be better appreciated. There are additional embodiments of that will be described hereinafter and that will form the subject matter of the claims appended hereto. In this respect, before explaining at least one embodiment in detail, it is to be understood that the various embodiments are not limited in its application to the details of construction or to the arrangements of the components set forth in the following description or illustrated in the drawings. Also, it is to be understood that the phraseology and terminology employed herein are for the purpose of the description and should not be regarded as limiting.

To better understand the nature and advantages of the present disclosure, reference should be made to the following description and the accompanying figures. It is to be understood, however, that each of the figures is provided for the purpose of illustration only and is not intended as a definition of the limits of the scope of the present disclosure. Also, as a general rule, and unless it is evidence to the contrary from the description, where elements in different figures use identical reference numbers, the elements are generally either identical or at least similar in function or purpose.

DETAILED DESCRIPTION

Figure 1A:
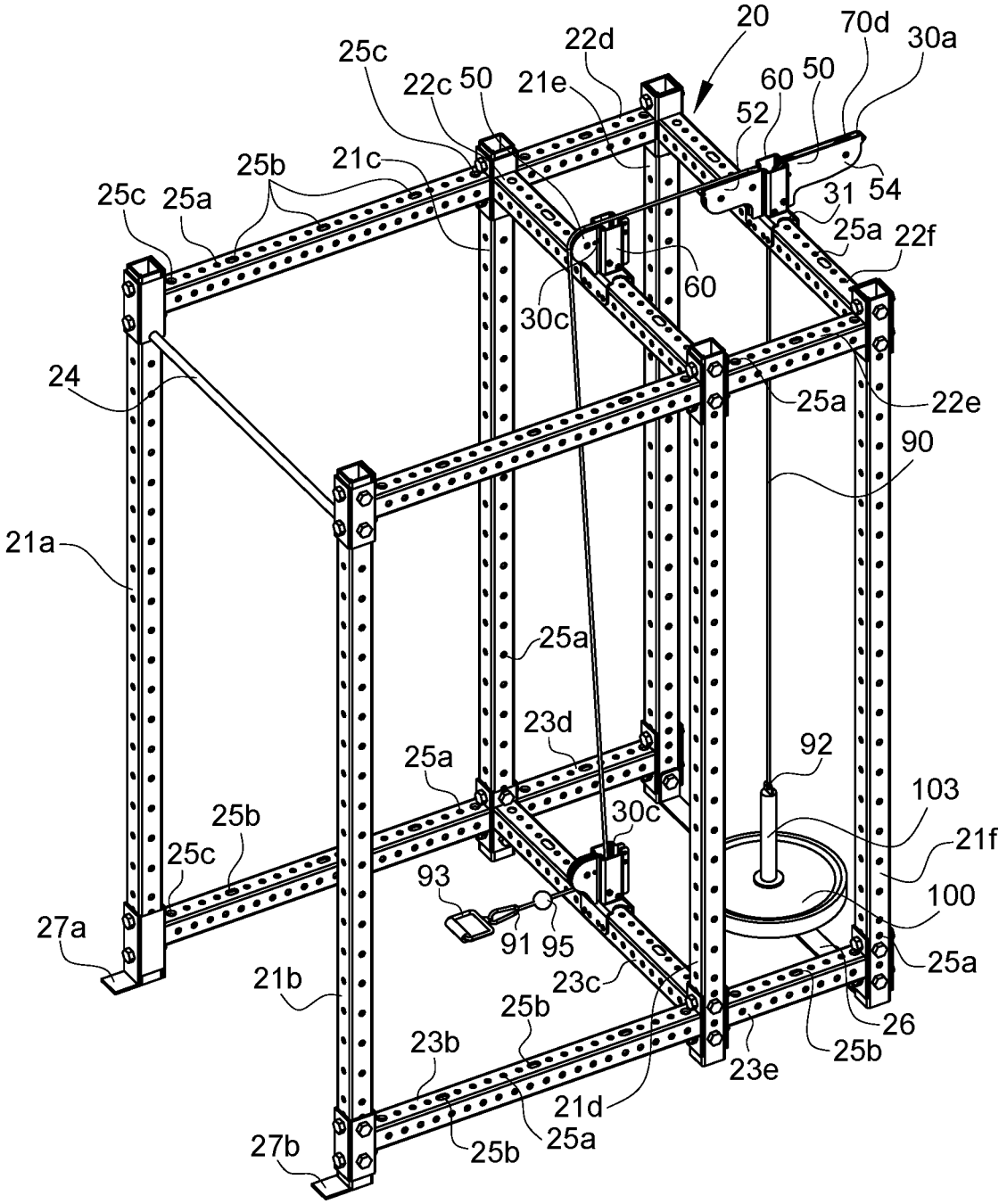
FIG. 1A is a perspective view of an exercise rack pulley system in accordance with an example embodiment.

A. Overview.

Some of the various embodiments of the present disclosure relate to an exercise rack pulley system that includes one or more pulley units 30*a*, 30*b*, 30*c*, 30*d* adapted to be attached to various positions of an exercise rack 20. Each of the pulley units 30*a*, 30*b*, 30*c*, 30*d* includes a bracket 31 which is adapted to be connected to the exercise rack 20, and a frame 50 which is adjustably and removably connected to the bracket 31. One or more pulleys 70*a*, 70*b*, 70*c*, 70*d* are rotatably connected to the frame 50 such that a cable 90 may be routed over, through, or under the pulleys 70*a*, 70*b*, 70*c*, 70*d*. Each pulley unit 30*a*, 30*b*, 30*c*, 30*d* is adjustable between at least two positions, including at least a first position in which the frame 50 is parallel to the bracket 31 and a second position in which the frame 50 is perpendicular to the bracket 31. Thus, the first position is at a ninety degree angle with respect to the second position.

Any number of pulley units 30*a*, 30*b*, 30*c*, 30*d* may be connected to various locations on the exercise rack 20, including but not limited to its support members 21*a*, 21*b*, 21*c*, 21*d*, 21*e*, 21*f*, upper arm members 22*a*, 22*b*, 22*c*, 22*d*, 22*e*, 22*f*, and/or lower arm members 23*a*, 23*b*, 23*c*, 23*d*, 23*e*. One or more cables 90 may be routed through the pulley units 30*a*, 30*b*, 30*c*, 30*d* and connected to one or more weights 100 such that a resistance force is applied against the one or more cables 90. By adjusting the positioning and orientation of the pulley units 30*a*, 30*b*, 30*c*, 30*d*, a wide range of cable 90 routing may be arranged to accommodate different positioning of the weight 100, thus allowing for a wide range of exercise moves being available to an exerciser 12.

In an exemplary embodiment, the exercise rack pulley system may comprise a bracket 31 adapted to be removably connected to an exercise rack 20. The bracket 31 may include a first connector 40. The first connector 40 may include a first aperture 42 and a second aperture 45. A frame 50 including a second connector 60 may be adjustably and removably connected to the bracket 31. The second connector 60 may include a third aperture 62 and the first connector 40 of the bracket 31 may be adapted to be removably connected to the second connector 60 of the frame 50.

A first pulley 70*a* may be rotatably connected to the frame 50. The frame 50 may be adjustable between a first position and a second position with respect to the bracket 31. The third aperture 62 of the second connector 60 may be aligned with the first aperture 42 of the first connector 40 when the frame 50 is in the first position, and the third aperture 62 of the second connector 60 may be aligned with the second aperture 45 of the first connector 40 when the frame 50 is in the second position.

A pin 80*a*, 80*b* is adapted to removably connect the first connector 40 of the bracket 31 to the second connector 60 of the frame 50. The pin 80*a*, 80*b* extends through the first aperture 42 of the first connector 40 and the third aperture 62 of the second connector 60 when the frame 50 is in the first position, and the pin 80*a*, 80*b* extends through the second aperture 45 of the first connector 40 and the third aperture 62 of the second connector 60 when the frame 50 is in the second position.

B. Exercise Rack.

The systems and methods shown and described herein may be utilized with a wide range of different types of exercise equipment, including but not limited to various types of exercise racks 20. While the figures illustrate the usage of pulley units 30*a*, 30*b*, 30*c*, 30*d* with exercise racks 20 for the purpose of illustration, it should be appreciated that the pulley units 30*a*, 30*b*, 30*c*, 30*d* could in some embodiments be secured to various other structures comprised of a wide range of different types of exercise equipment.

The figures illustrate exemplary embodiments of exercise racks 20 to which a variety of different attachments such as pulley units 30*a*, 30*b*, 30*c*, 30*d* may be removably or fixedly attached such that an exerciser 12 may perform a wide range of different types of exercise moves. A wide range of types of exercise racks 20 may be utilized in connection with the systems and methods described herein, and thus the exemplary embodiments of exercise racks 20 shown in FIGS. 1A-10G should not be construed as limiting in scope.

As an example, although the figures illustrate exercise racks 20 which include six support members 21*a*, 21*b*, 21*c*, 21*d*, 21*e*, 21*f*, the systems and methods described herein could be utilized with exercise racks 20 having more or less support members 21*a*, 21*b*, 21*c*, 21*d*, 21*e*, 21*f* than are shown in the figures. Additional non-limiting examples of exercise racks 20 which may be utilized with the systems and methods shown and described herein include the exercise racks 20 shown and described in U.S. Pat. Nos. 9,333,387 and 11,058,936, the entire disclosures of which, except for any definitions, disclaimers, disavowals, and inconsistencies, are incorporated herein by reference.

As best shown in FIGS. 1A-10G, it can be seen that an exemplary exercise rack 20 is shown which is comprised of a plurality of support members 21*a*, 21*b*, 21*c*, 21*d*, 21*e*, 21*f*, a plurality of upper arm members 22*a*, 22*b*, 22*c*, 22*d*, 22*e*, 22*f* and a plurality of lower arm members 23*a*, 23*b*, 23*c*, 23*d*, 23*e*. However, as previously mentioned, such a configuration is merely for illustrative purposes only, and should not be construed as limiting.

The systems and methods shown and described herein may be utilized with various other types of exercise racks 20, such as exercise racks 20 which do not necessarily include upper or lower arms members 22*a*, 22*b*, 22*c*, 22*d*, 22*e*, 22*f*, 23*a*, 23*b*, 23*c*, 23*d*, 23*e* or the same number of support members 21*a*, 21*b*, 21*c*, 21*d*, 21*e*, 21*f* as are shown in the exemplary figures. For example, the systems and methods described and shown herein may be utilized with an exercise rack 20 including two support members 21*a*, 21*b*, four support members 21*a*, 21*b*, 21*c*, 21*d*, or any other number of support members 21*a*, 21*b*, 21*c*, 21*d*, 21*e*, 21*f*.

With reference to FIGS. 1A-10G, it can be seen that the exemplary exercise rack 20 is illustrated as comprising six support members 21*a*, 21*b*, 21*c*, 21*d*, 21*e*, 21*f*. Each of the support members 21*a*, 21*b*, 21*c*, 21*d*, 21*e*, 21*f* is comprised of a vertically-oriented elongated member such as a beam or the like which, taken together, form the exercise rack 20. The support members 21*a*, 21*b*, 21*c*, 21*d*, 21*e*, 21*f* are all illustrated as being in parallel orientation with each other.

In the exemplary embodiments shown in FIGS. 1A-10G, it can be seen that six support members 21*a*, 21*b*, 21*c*, 21*d*, 21*e*, 21*f* are utilized, including a first support member 21*a*, a second support member 21*b*, a third support member 21*c*, a fourth support member 21*d*, a fifth support member 21*e*, and a sixth support member 21*f*. Each of the support members 21*a*, 21*b*, 21*c*, 21*d*, 21*e*, 21*f* are illustrated as being oriented vertically and in parallel, though in some embodiments one or more of the support members 21*a*, 21*b*, 21*c*, 21*d*, 21*e*, 21*f* may be or horizontally or diagonally oriented, or may be adjustable into horizontal or diagonal orientations. Thus, the exercise rack 20 may be adjustable in some embodiments such that not all of the support members 21*a*, 21*b*, 21*c*, 21*d*, 21*e*, 21*f* are vertical or parallel.

The support members 21*a*, 21*b*, 21*c*, 21*d*, 21*e*, 21*f* are generally positioned on a ground surface such as a floor. Anchors 27*a*, 27*b* such as shown in FIGS. 1A-10G may be utilized to secure the support members 21*a*, 21*b*, 21*c*, 21*d*, 21*e*, 21*f* to the floor to prevent the exercise rack 20 from moving around when exercises are being performed. In the exemplary embodiments shown in the figures, it can be seen that a first anchor 27*a* may be positioned at a lower end of a first support member 21*a*, and that a second anchor 27*b* may be positioned at a lower end of a second support member 21*b*.

The height (i.e., length) of the respective support members 21*a*, 21*b*, 21*c*, 21*d*, 21*e*, 21*f* may vary in different embodiments, both with respect to each other and with respect to any arm members 22*a*, 22*b*, 22*c*, 22*d*, 22*e*, 22*f*, 23*a*, 23*b*, 23*c*, 23*d*, 23*e*. Shorter exercisers 12 may prefer a shorter exercise rack 20, in which case the support members 21*a*, 21*b*, 21*c*, 21*d*, 21*e*, 21*f* will be shorter, whereas taller exercisers 12 may prefer a taller exercise rack 20, in which case the support members 21*a*, 21*b*, 21*c*, 21*d*, 21*e*, 21*f* may be taller.

As best shown in FIGS. 1A-10G, a cross bar 24 may be connected between a pair of the support members 21*a*, 21*b*, 21*c*, 21*d*, 21*e*, 21*f*. The cross bar 24 may be removably attached such that the cross bar 24 may be variably connected between different support members 21*a*, 21*b*, 21*c*, 21*d*, 21*e*, 21*f* as-needed. The cross bar 24 may be utilized for a wide range of functions, such as, for example, for use as a pull-up bar. In the exemplary embodiment shown in FIGS. 1A-10G, the cross bar 24 is illustrated as being connected between the first and second support members 21*a*, 21*b*.

Continuing to reference the embodiments shown in FIGS. 1A-10G, it can be seen that the exercise rack 20 may include one or more arm members 22*a*, 22*b*, 22*c*, 22*d*, 22*e*, 22*f*, 23*a*, 23*b*, 23*c*, 23*d*, 23*e* which are connected between support members 21*a*, 21*b*, 21*c*, 21*d*, 21*e*, 21*f*. The arm members 22*a*, 22*b*, 22*c*, 22*d*, 22*e*, 22*f*, 23*a*, 23*b*, 23*c*, 23*d*, 23*e* are illustrated as being horizontally-oriented, but in some embodiments may be diagonally oriented, or adjustable into diagonal or vertical orientations (such as to collapse or fold the exercise rack 20).

Each arm member 22*a*, 22*b*, 22*c*, 22*d*, 22*e*, 22*f*, 23*a*, 23*b*, 23*c*, 23*d*, 23*e* may comprise an elongated member such as a beam or the like that is connected between a pair of the support members 21*a*, 21*b*, 21*c*, 21*d*, 21*e*, 21*f*. In the exemplary embodiments shown in the figures, the arm members 22*a*, 22*b*, 22*c*, 22*d*, 22*e*, 22*f*, 23*a*, 23*b*, 23*c*, 23*d*, 23*e* are each illustrated as being oriented perpendicularly with respect to the support members 21*a*, 21*b*, 21*c*, 21*d*, 21*e*, 21*f*. However, in some embodiments, one or more of the support members 21*a*, 21*b*, 21*c*, 21*d*, 21*e*, 21*f* and/or one or more of the arm members 22*a*, 22*b*, 22*c*, 22*d*, 22*e*, 22*f*, 23*a*, 23*b*, 23*c*, 23*d*, 23*e* may be adjustable (e.g., by folding, pivoting, or collapsing) such that one or more of the arm members 22*a*, 22*b*, 22*c*, 22*d*, 22*e*, 22*f*, 23*a*, 23*b*, 23*c*, 23*d*, 23*e* may not be perpendicular with respect to one or more of the support members 21*a*, 21*b*, 21*c*, 21*d*, 21*e*, 21*f*.

As best shown in FIGS. 1A-10G, one or more upper arm members 22*a*, 22*b*, 22*c*, 22*d*, 22*e*, 22*f* may be connected between a point at or near the upper ends of a pair of support members 21*a*, 21*b*, 21*c*, 21*d*, 21*e*, 21*f*. By way of example, a first upper arm member 22*a* may be connected between the first and third support members 21*a*, 21*c*, a second upper arm member 22*b* may be connected between the second and fourth support members 21*b*, 21*d*, a third arm upper member 22*c* may be connected between the third and fourth support members 21*c*, 21*d*, a fourth arm member 22*d* may be connected between the third and fifth support members 21*c*, 21*e*, a fifth upper arm member 22*e* may be connected between the fourth and sixth support members 21*d*, 21*f*, and a sixth upper arm member 22*f* may be connected between the fifth and sixth support members 21*e*, 21*f*.

Figure 2A:
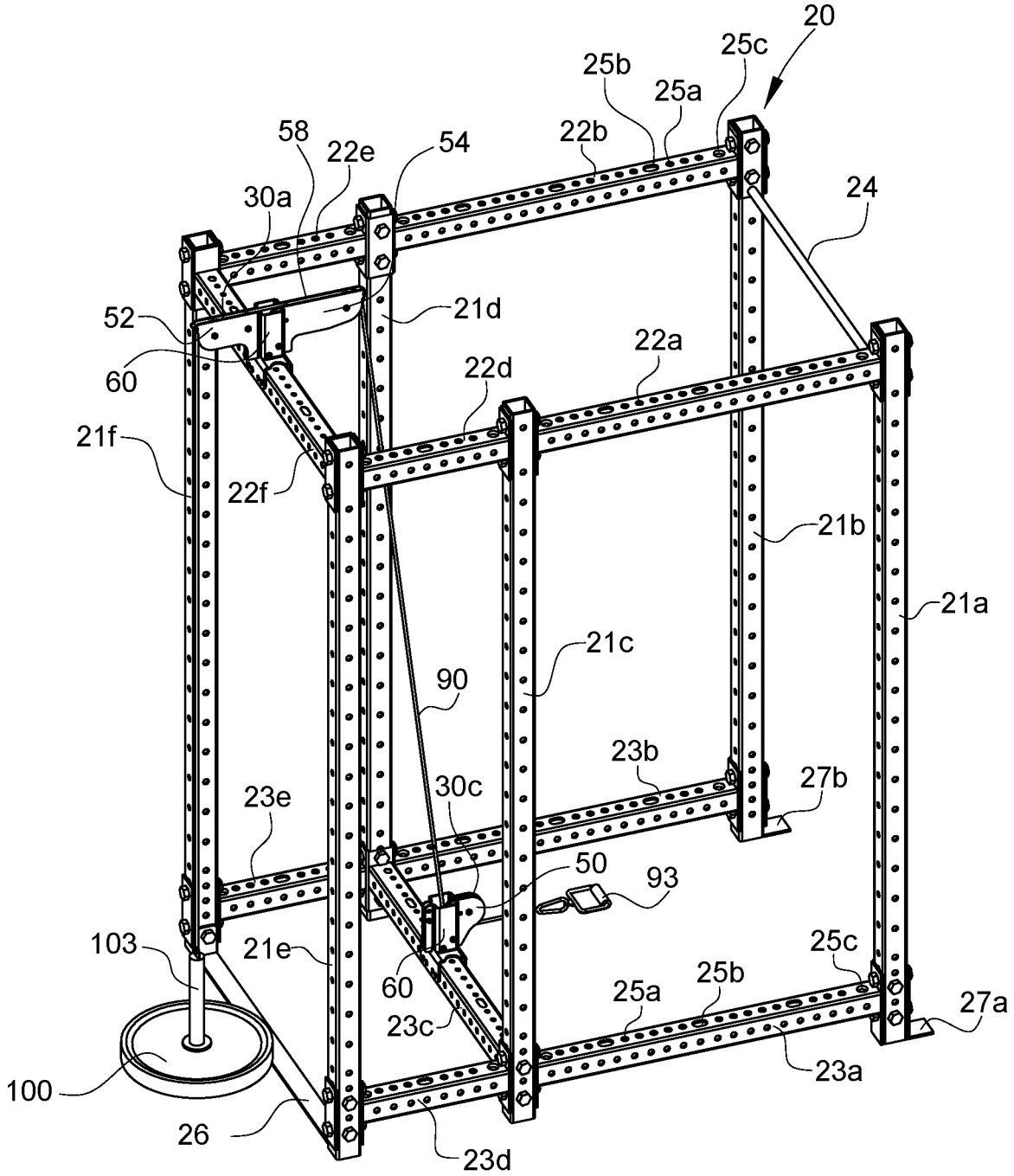
FIG. 2A is a perspective view of an exercise rack pulley system in accordance with an example embodiment.

It should be appreciated that more or less upper arm members 22*a*, 22*b*, 22*c*, 22*d*, 22*e*, 22*f* may be used in different embodiments. For example, FIG. 2A illustrates an embodiment in which only five upper arm members 22*a*, 22*b*, 22*d*, 22*e*, 22*f* are utilized, with the third upper arm member 22*c* being omitted. In some embodiments, no upper arm members 22*a*, 22*b*, 22*c*, 22*d*, 22*e*, 22*f* may be utilized, with the support members 21*a*, 21*b*, 21*c*, 21*d*, 21*e*, 21*f* instead being interconnected by lower arm members 23*a*, 23*b*, 23*c*, 23*d*, 23*e*, or not interconnected at all (e.g., by being free-standing).

With reference to FIGS. 1A-10G, it can be seen that the exercise rack 20 may include one or more lower arm members 23*a*, 23*b*, 23*c*, 23*d*, 23*e* which may be connected between respective support members 21*a*, 21*b*, 21*c*, 21*d*, 21*e*, 21*f*. By way of example, a first lower arm member 23*a* may be connected between the first and third support members 21*a*, 21*c*, a second lower arm member 23*b* may be connected between the second and fourth support members 21*b*, 21*d*, a third lower arm member 23*c* may be connected between the third and fourth support members 21*c*, 21*d*, a fourth lower arm member 23*d* may be connected between the third and fifth support members 21*c*, 21*e*, and a fifth lower arm member 23*e* may be connected between the fourth and sixth support members 21*d*, 21*f*.

As shown in the figures, the length of each of the upper and lower arm members 22*a*, 22*b*, 22*c*, 22*d*, 22*e*, 22*f*, 23*a*, 23*b*, 23*c*, 23*d*, 23*e* may vary in different embodiments to suit different types of exercise racks 20. Thus, the lengths of the respective arm members 22*a*, 22*b*, 22*c*, 22*d*, 22*e*, 22*f*, 23*a*, 23*b*, 23*c*, 23*d*, 23*e* illustrated in the FIGS. should not be construed as limiting in scope. A more compact exercise rack 20 may include shorter arm members 22*a*, 22*b*, 22*c*, 22*d*, 22*e*, 22*f*, 23*a*, 23*b*, 23*c*, 23*d*, 23*e*, whereas a larger exercise rack 20 may include longer arm members 22*a*, 22*b*, 22*c*, 22*d*, 22*e*, 22*f*, 23*a*, 23*b*, 23*c*, 23*d*, 23*e*.

As shown throughout the figures, the support members 21*a*, 21*b*, 21*c*, 21*d*, 21*e*, 21*f* and/or arm members 22*a*, 22*b*, 22*c*, 22*d*, 22*e*, 22*f*, 23*a*, 23*b*, 23*c*, 23*d*, 23*e* may include openings 25*a*, 25*b*, 25*c* positioned at various locations along their lengths/heights. The openings 25*a*, 25*b*, 25*c* may be utilized to removably attach various exercise attachments to the exercise rack 20, such as but not limited to pulley units 30*a*, 30*b*, 30*c*, 30*d*, weight brackets 105, weightlifting units 110, foot rests 29, and the like as discussed herein. While the figures illustrate such openings 25*a*, 25*b*, 25*c* on all of the support members 21*a*, 21*b*, 21*c*, 21*d*, 21*e*, 21*f* and arm members 22*a*, 22*b*, 22*c*, 22*d*, 22*e*, 22*f*, 23*a*, 23*b*, 23*c*, 23*d*, 23*e*, it should be appreciated that openings 25*a*, 25*b*, 25*c* may be omitted from some or all of the support members 21*a*, 21*b*, 21*c*, 21*d*, 21*e*, 21*f* and/or arm members 22*a*, 22*b*, 22*c*, 22*d*, 22*e*, 22*f*, 23*a*, 23*b*, 23*c*, 23*d*, 23*e* in some embodiments.

Figure 3A:
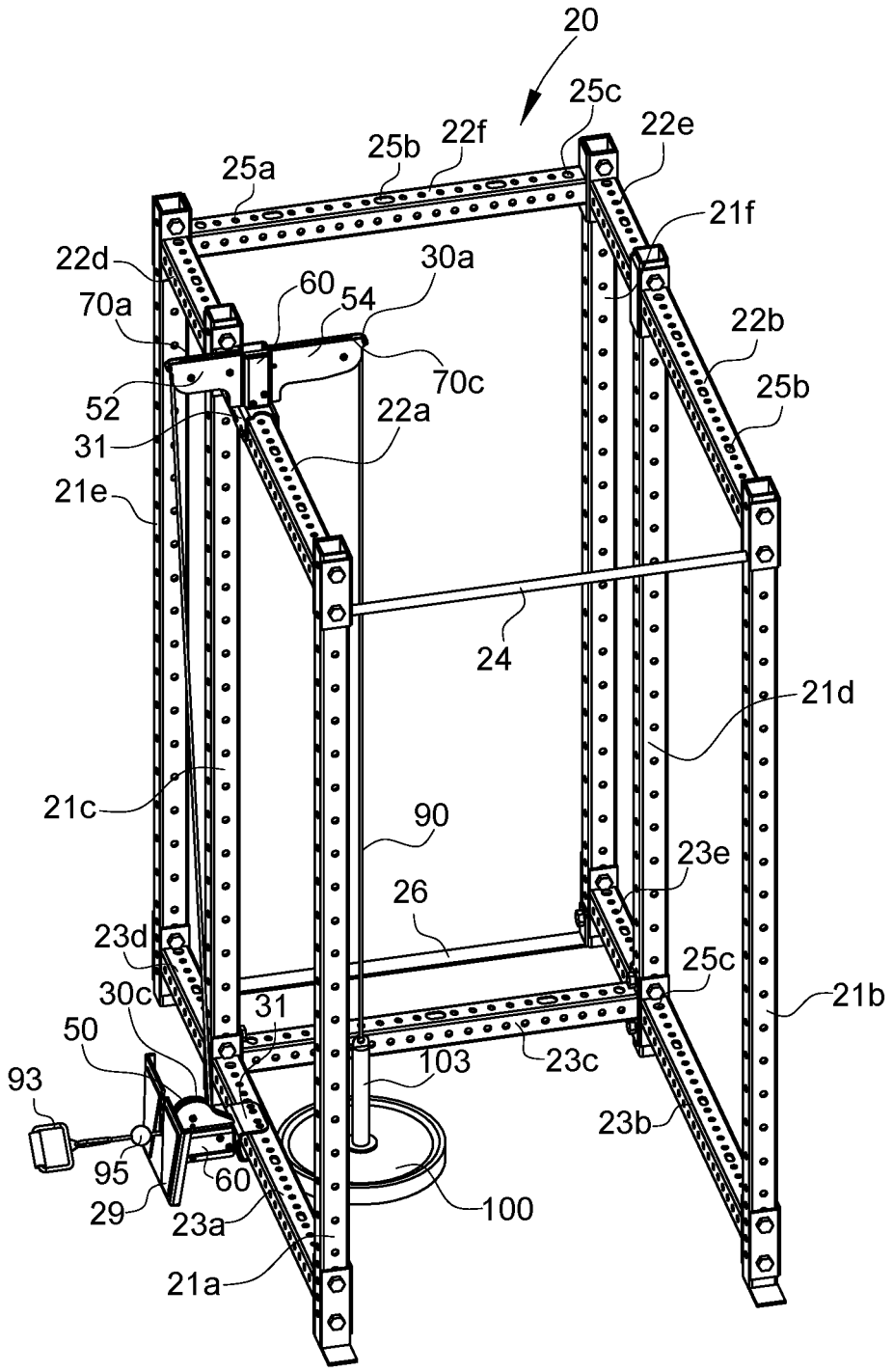
FIG. 3A is a perspective view of an exercise rack pulley system in accordance with an example embodiment.

The size of the openings 25*a*, 25*b*, 25*c* may vary to suit different types of exercise attachments and exercise rack 20 configurations. As best shown in FIGS. 1A, 2A, and 3A, the openings 25*a*, 25*b*, 25*c* may comprise various sizes and shapes. In the exemplary embodiments shown in the figures, openings 25*a*, 25*b*, 25*c* comprised of small round openings 25*a*, slotted openings 25*b*, and large round openings 25*c* are illustrated. The small round openings 25*a* may be configured to accommodate fasteners to attach various exercise attachments. The slotted openings 25*b* and larger round openings 25*c* may also be utilized for attaching various exercise attachments, and may additionally be useful for routing cables 90 through the various support members 21*a*, 21*b*, 21*c*, 21*d*, 21*e*, 21*f* and/or arm members 22*a*, 22*b*, 22*c*, 22*d*, 22*e*, 22*d*, 23*a*, 23*b*, 23*c*, 23*d*, 23*e* of the exercise rack 20. It should be appreciated, however, that the cable 90 may be routed through the smaller round openings 25*a* as well in certain configurations.

As best shown in FIG. 1A, it can be seen that the smaller round openings 25*a* will generally comprise round (i.e., circular) openings. By way of example and without limitation, the smaller round openings 25*a* may be comprised of ⅝ inch openings. The slotted openings 25*b* may comprise elongated, rounded slots such as shown in the figures. The larger round openings 25*c* will generally comprise round (e.g., circular) openings that are larger than the smaller round openings 25*a*. By way of example and without limitation, the larger round openings 25*c* may be comprised of one inch openings. It should be appreciated, however, that the specific size of each opening 25*a*, 25*b*, 25*c* may vary in different embodiments to suit different types of exercise racks 20 and different attachments, cables 90, and the like.

The figures illustrate exemplary patterns of such openings 25*a*, 25*b*, 25*c* extending along the upper and lower arm members 22*a*, 22*b*, 22*c*, 22*d*, 22*e*, 22*d*, 23*a*, 23*b*, 23*c*, 23*d*, 23*e* of the exercise rack 20. More specifically, it can be seen in FIG. 1A, for example, that the longer arm members 22*a*, 22*b*, 22*c*, 22*f*, 23*a*, 23*b*, 23*c* may include a pattern, starting from the intersection point with a support member 21*a*, 21*b*, 21*c*, 21*d*, 21*e*, 21*f*, of one larger round opening 25*c*, three smaller round openings 25*a*, one slotted opening 25*b*, five smaller round openings 25*a*, one slotted opening 25*b*, five smaller round openings 25*a*, one slotted opening 25*b*, three smaller round openings 25*a*, and one larger round opening 25*c*. The shorter arm members 22*d*, 22*e*, 23*d*, 23*e* may include a pattern, starting from the intersection point with a support member 21*a*, 21*b*, 21*c*, 21*d*, 21*e*, 21*f*, of one larger round opening 25*c*, three smaller round openings 25*a*, one slotted opening 25*b*, three smaller round openings 25*a*, and one larger round opening 25*c*.

It should be appreciated that the patterns and order of openings 25*a*, 25*b*, 25*c* utilized may vary in different embodiments to suit different lengths of arm members 22*a*, 22*b*, 22*c*, 22*d*, 22*e*, 22*d*, 23*a*, 23*b*, 23*c*, 23*d*, 23*e* and different configurations. Thus, the exemplary pattern of openings 25*a*, 25*b*, 25*c* shown in the figures, and the preceding non-limiting description of one exemplary pattern of openings 25*a*, 25*b*, 25*c*, should not be construed as limiting in scope.

As best shown in FIGS. 1A-10G, the exercise rack 20 may include one or more floor supports 26 which extend between a pair of support members 21*a*, 21*b*, 21*c*, 21*d*, 21*e*, 21*f* along a ground surface (e.g., the floor). The floor support 26 may improve stability and provide a point on which a weight 100 may rest. In the exemplary embodiment shown in FIG. 2A, a floor support 26 is shown as being connected between the respective lower ends of the fifth and sixth support members 21*e*, 21*f*. It should be appreciated that the floor support 26 may be positioned at various other locations, or be connected between various other support members 21*a*, 21*b*, 21*c*, 21*d*, 21*e*, 21*f* in different embodiments.

Figure 4A:
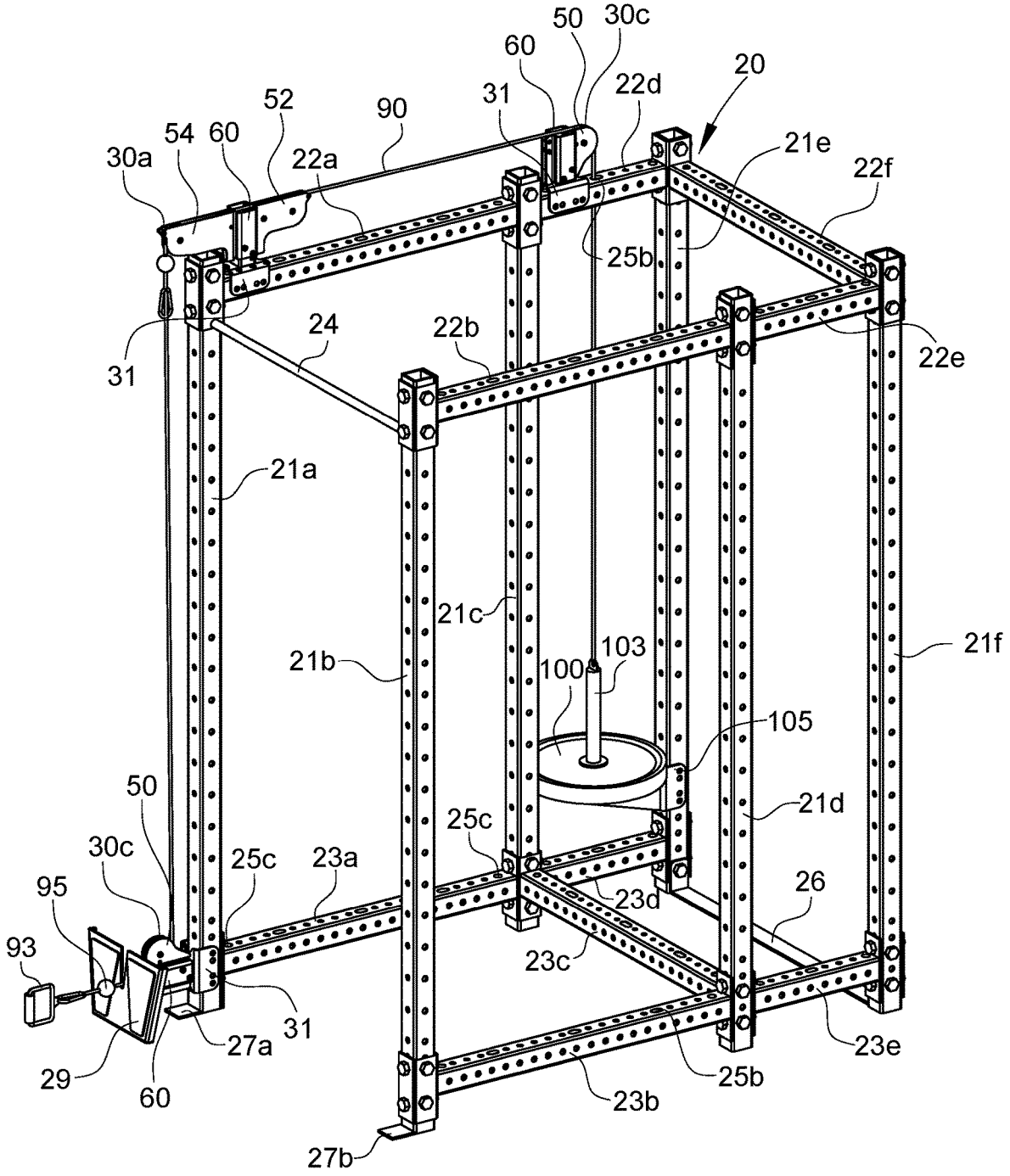
FIG. 4A is a perspective view of an exercise rack pulley system in accordance with an example embodiment.

As discussed in more detail below, various pulley units 30*a*, 30*b*, 30*c*, 30*d* may be connected to the exercise rack 20 at various locations so as to allow for a wide range of exercises to be performed by an exerciser 12. Additionally, weights 100 may be attached to the exercise rack 20, such as by a weight bracket 105 as shown in FIG. 4A, or by a weightlifting unit 110 as shown in FIGS. 10B and 10C. A foot rest 29 may also be attached to the exercise rack 20 such as shown in FIG. 3A.

C. Cable End Connector.

As shown in FIGS. 10D-10G, the systems and methods shown and described herein may utilize a cable end connector 120 which may be attached to various locations on the exercise rack 20. The cable end connector 120 may be comprised of a bracket 121, such as a U-shaped bracket, that is adapted to be removably attached to the support members 21*a*, 21*b*, 21*c*, 21*d*, 21*e*, 21*f*, upper arm members 22*a*, 22*b*, 22*c*, 22*d*, 22*e*, 22*f*, and/or lower arm members 23*a*, 23*b*, 23*c*, 23*d*, 23*e* of the exercise rack 20. The bracket 121 may be connected by, for example, extending one or more fasteners through the bracket 121 and the support member 21*a*, 21*b*, 21*c*, 21*d*, 21*e*, 21*f*, upper arm member 22*a*, 22*b*, 22*c*, 22*d*, 22*e*, 22*f*, and/or lower arm member 23*a*, 23*b*, 23*c*, 23*d*, 23*e* to which the cable end connector 120 is attached.

Continuing to reference FIGS. 10D-10G, it can be seen that a connector 122 extends outwardly from the bracket 121 of the cable end connector 120. The connector 122 may comprise a looped structure, or a U-shaped member that is integral with, or connected to, the bracket 121 so as to extend outwardly from the bracket 121. The second end 92 of a cable 90 may be secured to the cable end connector 120 by being tied or otherwise secured to the connector 122 of the cable end connector 120. The manner by which the cable 90 is secured to the cable end connector 120 may vary in different embodiments. By way of example and without limitation, the cable 90 may be secured to the cable end connector 120 by tying various knots, use of clasps or clamps such as carabiners, eyelets, and the like.

The cable end connector 120 may be utilized in a variety of manners to perform a wide range of exercises. Exemplary, non-limiting configurations are shown in FIGS. 10D-10G which are merely illustrative examples that are not meant to be limiting in scope.

D. Pulley Units.

As shown throughout the figures, pulley units 30*a*, 30*b*, 30*c*, 30*d* may be utilized with the exercise rack 20 to perform a wide range of versatile exercise moves. While the preceding FIGS. 1A-10G illustrate usage of specific embodiments of pulley units 30*a*, 30*b*, 30*c*, 30*d*, it should be appreciated that the other embodiments of pulley units 30*a*, 30*b*, 30*c*, 30*d* shown and described herein may also or alternatively be used with any of the configurations shown in FIGS. 1A-10G.

FIGS. 11A-14 illustrate a first exemplary embodiment of a pulley unit 30*a*. FIGS. 15A-18 illustrate a second exemplary embodiment of a pulley unit 30*b*. FIGS. 19A-22 illustrate a third exemplary embodiment of a pulley unit 30*c*. FIGS. 23A-26 illustrate a fourth exemplary embodiment of a pulley unit 30*d*.

Each of the pulley units 30*a*, 30*b*, 30*c*, 30*d* illustrated in FIGS. 11A-26 comprise a bracket 31 which is adapted to be connected to an exercise rack 20. Each bracket 31 includes a first connector 40 which may be integral with, or connected to, the respective bracket 31. A frame 50 is removably connected to the bracket 31 by a second connector 60, with the frame 50 includes at least one rotatably connected pulley 70*a*, 70*b*, 70*c*, 70*d*.

Each pulley 70*a*, 70*b*, 70*c*, 70*d* may be rotatably connected to the frame 50 utilizing a pulley axle 72*a*, 72*b*, 72*c*, 72*d* as shown in FIGS. 11A-26. More specifically, it can be seen that a first pulley axle 72*a* may extend through the first and second members 56, 57 of the frame 50 for rotatably supporting the first pulley 70*a*, a second pulley axle 72*b* may extend through the first and second members 56, 57 of the frame 50 for rotatably supporting the second pulley 70*b*, a third pulley axle 72*c* may extend through the first and second members 56, 57 of the frame 50 for rotatably supporting the third pulley 70*c*, and a fourth pulley axle 72*d* may extend through the first and second members 56, 57 of the frame 50 for rotatably supporting the fourth pulley 70*d*.

Thus, each of the pulley units 30*a*, 30*b*, 30*c*, 30*d* are configured to be rotatable between at least a first position and a second position. The first and second positions may be at various angles with respect to each other. For example, the first and second positions may be at ninety degree angles with respect to each other. In other embodiments, however, different angular increments may be supported. For example, the pulley units 30*a*, 30*b*, 30*c*, 30*d* may be adjustable along forty-five degree increments between four positions in certain embodiments.

Generally, each pulley unit 30*a*, 30*b*, 30*c*, 30*d* is adapted to be removably attached to an exercise rack 20, such as to a support member 21*a*, 21*b*, 21*c*, 21*d*, 21*e*, 21*f*, upper arm member 22*a*, 22*b*, 22*c*, 22*d*, 22*e*, 22*f*, or lower arm member 23*a*, 23*b*, 23*c*, 23*d*, 23*e*. Each pulley unit 30*a*, 30*b*, 30*c*, 30*d* is adjustable between a first position in which the pulley unit 30*a*, 30*b*, 30*c*, 30*d* is parallel with respect to the support member 21*a*, 21*b*, 21*c*, 21*d*, 21*e*, 21*f*, upper arm member 22*a*, 22*b*, 22*c*, 22*d*, 22*e*, 22*f*, or lower arm member 23*a*, 23*b*, 23*c*, 23*d*, 23*e* of the exercise rack 20 and a second position in which the pulley unit 30*a*, 30*b*, 30*c*, 30*d* is perpendicular with respect to the support member 21*a*, 21*b*, 21*c*, 21*d*, 21*e*, 21*f*, upper arm member 22*a*, 22*b*, 22*c*, 22*d*, 22*e*, 22*f*, or lower arm member 23*a*, 23*b*, 23*c*, 23*d*, 23*e*.

As shown throughout the figures, the cable 90 may be routed through, under, or over various pulleys 70*a*, 70*b*, 70*c*, 70*d* of various pulley units 30*a*, 30*b*, 30*c*, 30*d* to accommodate different configurations to perform a wide range of exercises. It should be appreciated that the cable 90 may extend through the various support members 21*a*, 21*b*, 21*c*, 21*d*, 21*e*, 21*f* and/or arm members 22*a*, 22*b*, 22*c*, 22*d*, 22*e*, 22*f*, 23*a*, 23*b*, 23*c*, 23*d*, 23*e*, such as by extending through one or more openings 25*a*, 25*b*, 25*c*. In some embodiments, the cable 90 may instead be routed to the side of the various support members 21*a*, 21*b*, 21*c*, 21*d*, 21*e*, 21*f* and/or arm members 22*a*, 22*b*, 22*c*, 22*d*, 22*e*, 22*f*, 23*a*, 23*b*, 23*c*, 23*d*, 23*e*, rather than through the openings 25*a*, 25*b*, 25*c*. In some embodiments, the cable 90 may both be routed through openings 25*a*, 25*b*, 25*c* and alongside the support members 21*a*, 21*b*, 21*c*, 21*d*, 21*e*, 21*f* and/or arm members 22*a*, 22*b*, 22*c*, 22*d*, 22*e*, 22*f*, 23*a*, 23*b*, 23*c*, 23*d*, 23*e* at various locations.

i. First Exemplary Embodiment

Figure 11A:
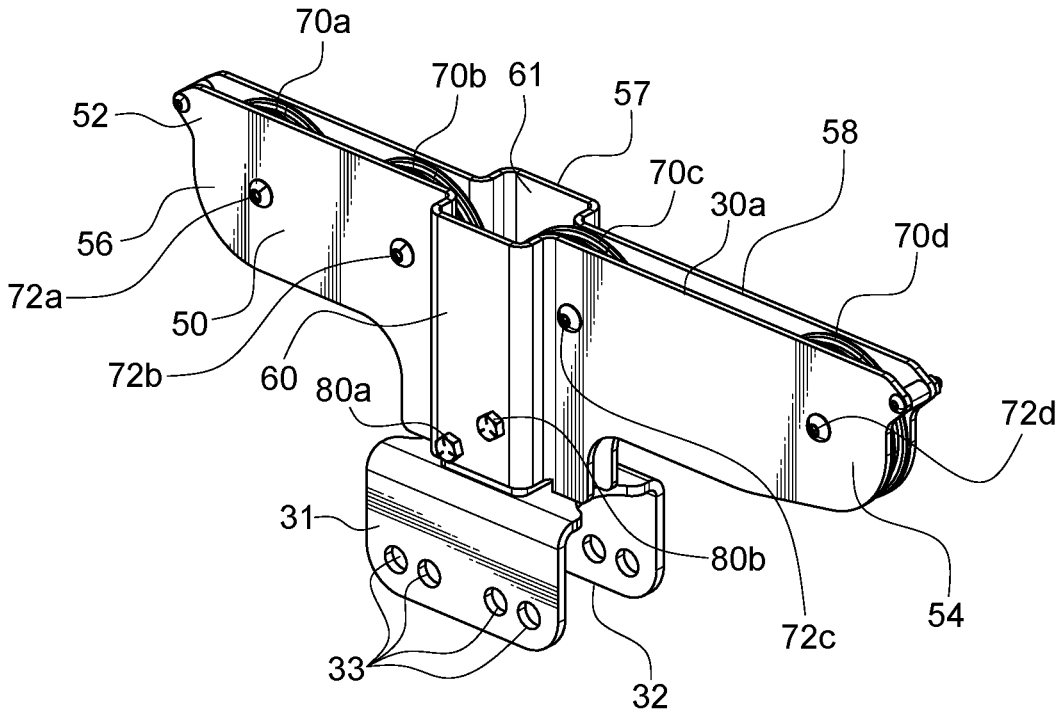
FIG. 11A is a perspective view of a first exemplary embodiment of a pulley unit in a first position in accordance with an example embodiment.

FIGS. 11A-14 illustrate a first exemplary embodiment of a pulley unit 30*a*. As shown, the pulley unit 30*a* includes a bracket 31 which is adapted to be removably connected to an exercise rack 20, and a frame 50 which is adjustably connected to the bracket 31. FIGS. 11A and 12A illustrate the frame 50 in a first position with respect to the bracket 31 and FIGS. 11B and 12B illustrate the frame 50 in a second position with respect to the bracket 31. By allowing adjustment of the pulley unit 30*a* between positions, additional versatility may be provided in connection with various types of exercise racks 20 to perform a wider range of exercises.

Figure 13A:
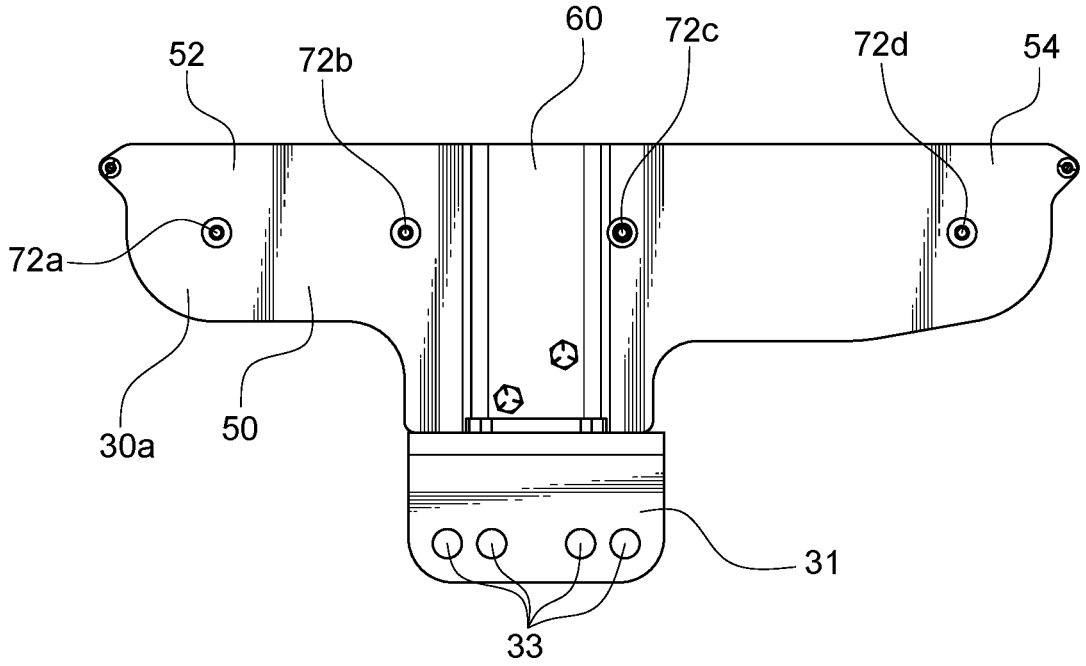
FIG. 13A is a front view of a first exemplary embodiment of a pulley unit in a first position in accordance with an example embodiment.
Figure 13B:
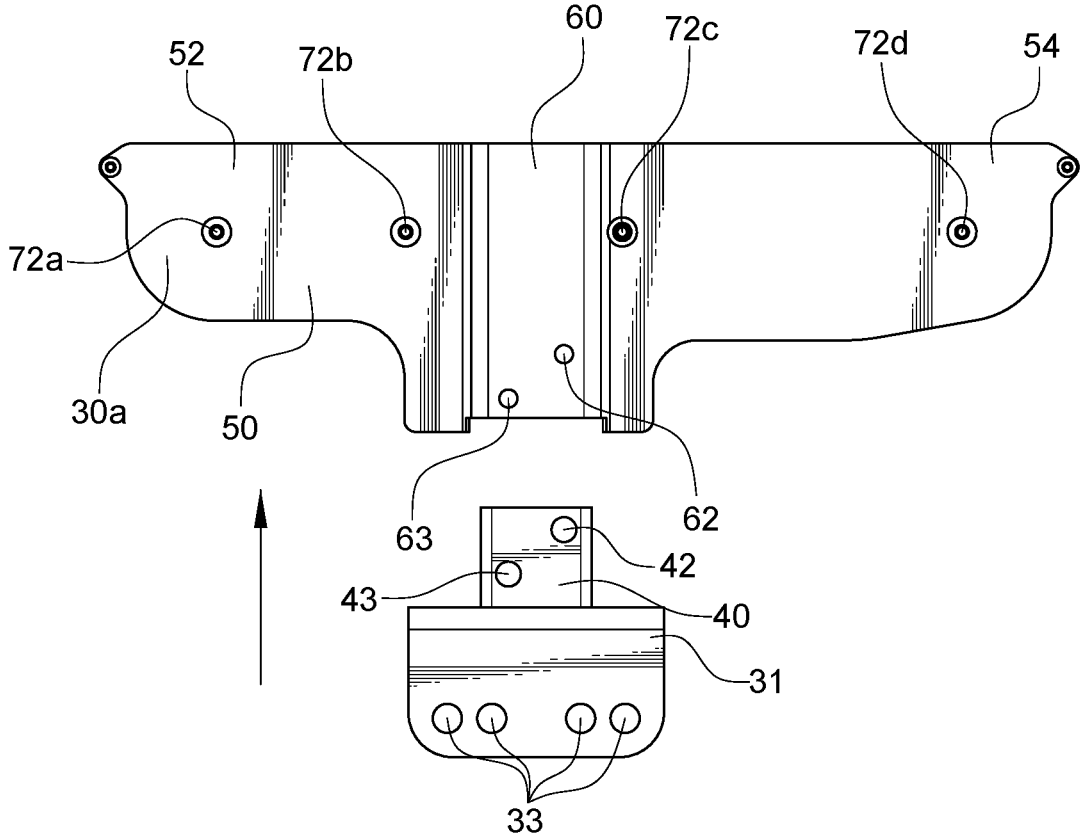
FIG. 13B is a front view of a frame lifted up with respect to a bracket of a first exemplary embodiment of a pulley unit in accordance with an example embodiment.
Figure 13C:
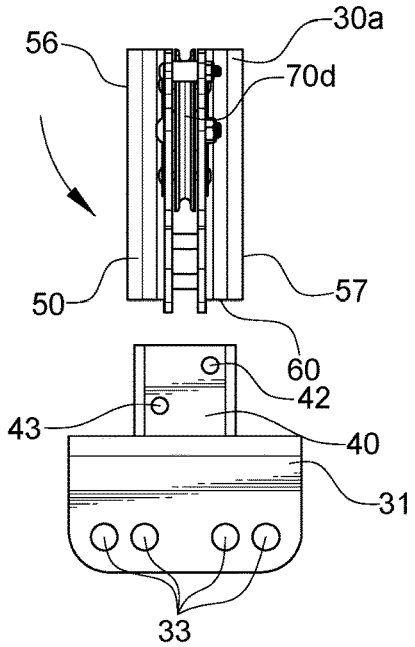
FIG. 13C is a front view of a frame lifted up and rotated with respect to a bracket of a first exemplary embodiment of a pulley unit in accordance with an example embodiment.
Figure 14:
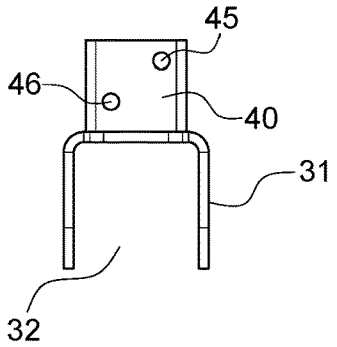
FIG. 14 is a side view of a bracket of a first exemplary embodiment of a pulley unit in accordance with an example embodiment.

As best shown in FIGS. 13A, 13C, and 14, the pulley unit 30*a* includes a bracket 31 which may be connected to an exercise rack 20. The bracket 31 is illustrated as comprising a U-shaped member which includes a channel 32 adapted to receive the exercise rack 20 (e.g., the support member 21*a*, 21*b*, 21*c*, 21*d*, 21*e*, 21*f*, upper arm member 22*a*, 22*b*, 22*c*, 22*d*, 22*e*, 22*f*, or lower arm member 23*a*, 23*b*, 23*c*, 23*d*, 23*e* of the exercise rack 20). However, it should be appreciated that various other shapes may be utilized for the bracket 31 to accommodate different types of exercise racks 20.

Continuing to reference FIGS. 13A, 13C, and 14, it can be seen that the bracket 31 includes a plurality of apertures 33 for use in connecting the bracket 31 to the exercise rack 20. Generally, the bracket 31 will be positioned around the exercise rack 20, and fasteners such as pins, threaded fasteners, bolts, and the like may be inserted through both the apertures 33 and the exercise rack 20 to secure the bracket 31 (and thus the pulley unit 30*a*) to the exercise rack 20.

The figures illustrate that the bracket 31 includes four sets of concentric apertures 33 which are aligned along both portions of the bracket 31. It should be appreciated that more or less apertures 33 may be utilized in different embodiments, and thus the arrangement and number of apertures 33 shown in the exemplary figures should not be construed as limiting in scope.

As best shown in FIG. 13B, the bracket 31 includes a first connector 40 which is adapted to engage with a corresponding second connector 60 on the frame 50 so as to removably connect the frame 50 to the bracket 31. The first connector 40 is illustrated as comprising a male-type mating connector; however, in some embodiments the first connector 40 may instead comprise a female receiver. The first connector 40 may be connected to the bracket 31, or may be integral therewith.

Figure 12A:
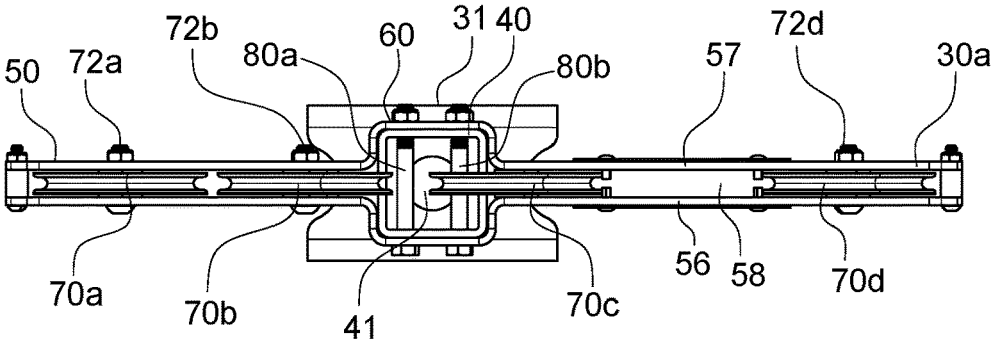
FIG. 12A is a top view of a first exemplary embodiment of a pulley unit in a first position in accordance with an example embodiment.
Figure 12B:
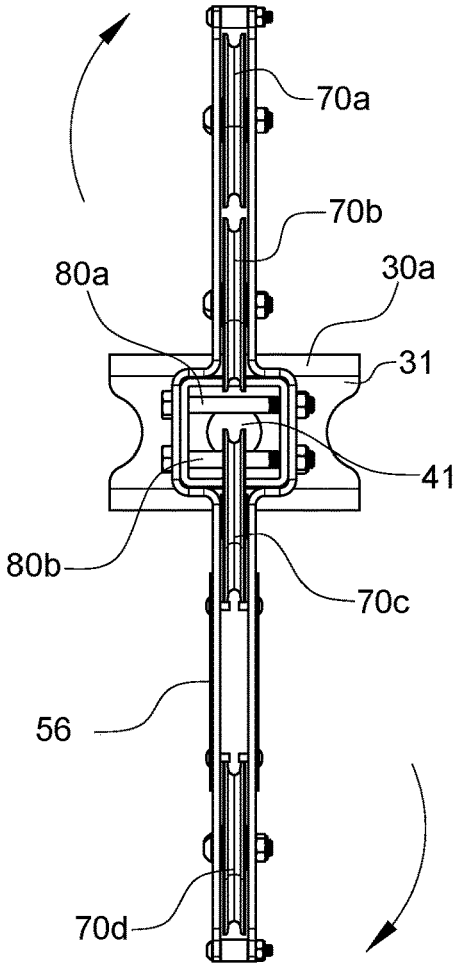
FIG. 12B is a top view of a first exemplary embodiment of a pulley unit in a second position in accordance with an example embodiment.

As best shown in FIGS. 12A and 12B, an opening 41 may extend through the height of the first connector 40. The opening 41 is adapted to receive a cable 90 when the cable 90 is routed through the pulley unit 30*a*. The opening 41 may comprise various shapes and sizes, and thus should not be construed as limited in scope by the exemplary embodiment shown in the figures. Generally, the opening 41 will extend from the upper end to the lower end of the first connector 40 to reach the channel 32 of the bracket 31.

As best shown in FIGS. 13B and 14, the first connector 40 of the bracket 31 will generally include at least a pair of apertures 42, 43, 45, 46. The first connector 40 may include a first aperture 42 on its first side, and a second aperture 45 on its second side, with the apertures 42, 45 being at a right angle with respect to each other. Thus, the first aperture 42 may be aligned along a first axis and the second aperture 45 may be aligned along a second axis, with the first axis and the second axis being perpendicular.

The first aperture 42 may be utilized to secure the frame 50 to the bracket 31 in a first position, and the second aperture 45 may be utilized to secure the frame 50 to the bracket 31 in a second position which is at a right angle with respect to the first position. While the figures illustrate that each side of the first connector 40 includes a pair of apertures 42, 43, 45, 46, it should be appreciated that a single aperture 42, 45 may be used on each side in some embodiments.

FIG. 13B illustrates that a first side of the first connector 40 may include a first upper aperture 42 and a first lower aperture 43. The first upper aperture 42 is illustrated as being diagonally-offset with respect to the first lower aperture 43. However, in some embodiments, the first upper and lower apertures 42, 43 may instead be vertically-aligned or horizontally-aligned. In some embodiments, the first connector 40 may include a first upper set of apertures 42 comprised of a pair of apertures that are aligned and concentric, and a first lower set of apertures 43 comprised of a pair of apertures that are aligned and concentric. In such embodiments, the first upper aperture 42 and first lower aperture 43 each extend through both opposite sides of the first connector 40 such that a pin 80*a*, 80*b* may extend completely through the bracket 31 such as shown in FIG. 12A.

FIG. 14 illustrates that a second side of the first connector 40, which is at a right angle with respect to the first side previously discussed, may include a second upper aperture 45 and a second lower aperture 46. The second upper aperture 45 is illustrated as being diagonally-offset with respect to the second lower aperture 46. However, in some embodiments, the second upper and lower apertures 45, 46 may instead be vertically-aligned or horizontally-aligned. In some embodiments, the first connector 40 may include a second upper set of apertures 45 comprised of a pair of apertures that are aligned and concentric, and a second lower set of apertures 46 comprised of a pair of apertures that are aligned and concentric. In such embodiments, the second upper aperture 45 and second lower aperture 46 each extend through both opposite sides of the first connector 40 such that a pin 80*a*, 80*b* may extend completely through the bracket 31 such as shown in FIG. 12B.

In the figures, it can be seen that the first upper and lower sets of apertures 42, 43 may be aligned along a first axis and the second upper and lower sets of apertures 45, 46 may be aligned along a second axis, with the first axis being at a right angle (i.e., ninety degree angle) with respect to the second axis.

As best shown in FIGS. 11A-12B, the pulley unit 30*a* will generally include a frame 50 which is removably and adjustably connected to the bracket 31. The frame 50 supports one or more pulleys 70*a*, 70*b*, 70*c*, 70*d* which are rotatably connected to the frame 50 and around which a cable 90 may be routed. The frame 50 may comprise various shapes and configurations. In the exemplary embodiment shown in FIGS. 11A-12B, it can be seen that the frame 50 is illustrated as comprising a pair of opposing wings 52, 54 which extend outwardly from a central second connector 60. The shape, size, and configuration of the wings 52, 54 may vary in different embodiments, and thus should not be construed as limited in scope by the exemplary embodiments shown in the figures.

Continuing to reference FIGS. 11A-12B, it can be seen that the frame 50 may comprise a first member 56 and a second member 57, with the first and second members 56, 57 being spaced-apart so as to define a slot 58 between the first and second members 56, 57. The pulleys 70*a*, 70*b*, 70*c*, 70*d* are rotatably connected to both the first and second members 56, 57 within the slot 58 such that the pulleys 70*a*, 70*b*, 70*c*, 70*d* may each freely rotate within the slot 58. The pair of members 56, 57 may be interconnected with each other by fasteners such as shown in FIGS. 11A and 11B.

Figure 11B:
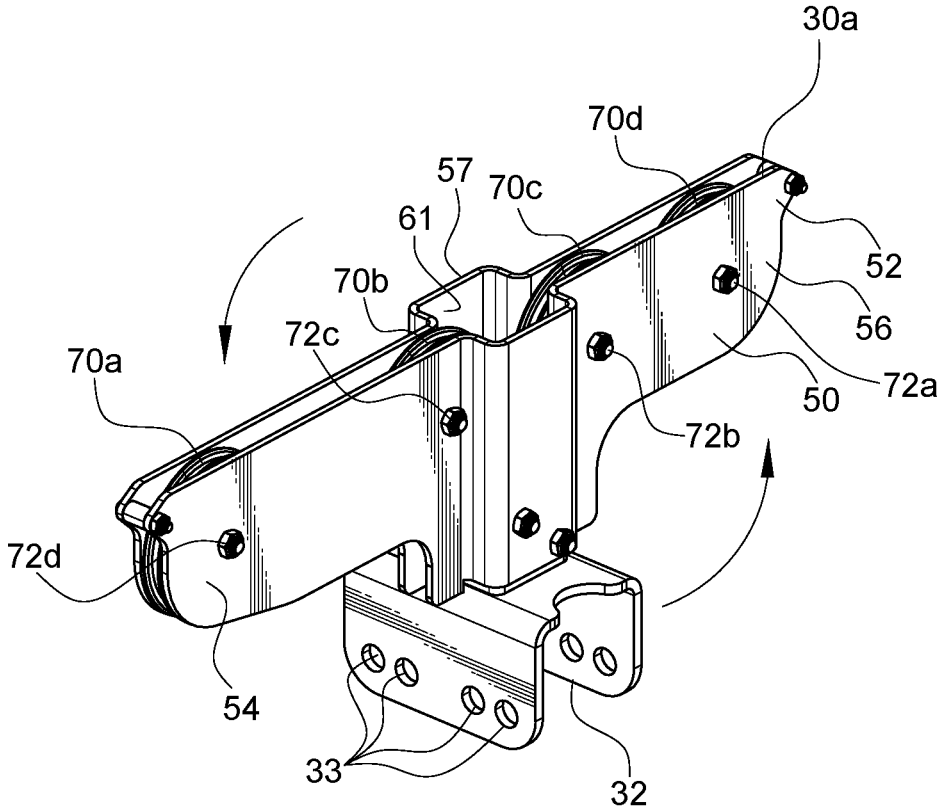
FIG. 11B is a perspective view of a first exemplary embodiment of a pulley unit in a second position in accordance with an example embodiment.

As best shown in FIGS. 11A and 11B, the frame 50 of the pulley unit 30*a* will generally include a second connector 60 which is adapted to removably engage with the first connector 40 of the bracket 31 so as to removably connect the frame 50 to the bracket 31 in one of at least two positions. The second connector 60 is illustrated as comprising a female receiver; however, in some embodiments the second connector 60 may instead comprise a male-type mating connector. The second connector 60 may be connected to the frame 50, or may be integral therewith.

In the embodiment shown in FIGS. 11A and 11B, the second connector 60 is comprised of a square-shaped receiver, with a first wing 52 extending outwardly therefrom in a first direction and a second wing 54 extending outwardly therefrom in a second direction. The second connector 60 includes an opening 61 which extends through the height of the second connector 60. The opening 61 is adapted to receive a cable 90 when the cable 90 is routed through the pulley unit 30*a*. The opening 61 is also adapted to receive the first connector 40 such as shown in the figures. The opening 61 may comprise various shapes and sizes, and thus should not be construed as limited in scope by the exemplary embodiment shown in the figures. Generally, the opening 61 will extend from the upper end to the lower end of the second connector 60 so as to be concentric with the corresponding opening 41 of the first connector 40 as shown in FIGS. 12A and 12B.

As best shown in FIG. 13B, one or more apertures 62, 63 may extend through the second connector 60, with the apertures 62, 63 being adapted to receive pins 80*a*, 80*b* to lock the frame 50 in a position with respect to the bracket 31. FIG. 13B illustrates the usage of an upper aperture 62 and a lower aperture 63, with the apertures 62, 63 being diagonal with respect to each other. In other embodiments, the upper and lower apertures 62, 63 may instead be horizontally-aligned or vertically-aligned. In some embodiments, only a single aperture 62 may be utilized.

In some embodiments, the second connector 60 may include an upper set of apertures 62 comprised of a pair of apertures that are aligned and concentric, and a lower set of apertures 63 comprised of a pair of apertures that are aligned and concentric. In such embodiments, the upper aperture 62 and lower aperture 63 each extend through both opposite sides of the second connector 60 such that a pin 80*a*, 80*b* may extend completely through the frame 50 such as shown in FIG. 12B.

As best shown in FIGS. 11A-12B, one or more pulleys 70*a*, 70*b*, 70*c*, 70*d* may be rotatably connected to the frame 50. The number of pulleys 70*a*, 70*b*, 70*c*, 70*d* connected to the frame 50 may vary in different embodiments. For example, in some embodiments, three or less pulleys 70*a*, 70*b*, 70*c*, 70*d* may be utilized. In other embodiments, five or more pulleys 70*a*, 70*b*, 70*c*, 70*d* may be utilized. In the exemplary embodiment best shown in FIGS. 12A and 12B, it can be seen that a first pulley 70*a* and a second pulley 70*b* are rotatably connected within the slot 58 of the first wing 52, and a third pulley 70*c* and a fourth pulley 70*d* are rotatably connected within the slot 58 of the second wing 54. In such a configuration, a cable 90 may be routed between the first and second pulleys 70*a*, 70*b*, or between the third and fourth pulleys 70*c*, 70*d*.

Various types of pulleys 70*a*, 70*b*, 70*c*, 70*d* known in the art may be utilized. Generally, each pulley 70*a*, 70*b*, 70*c*, 70*d* will comprise a wheel with a groove in its outer perimeter adapted to receive the cable 90. The size and shape of the pulleys 70*a*, 70*b*, 70*c*, 70*d* may vary in different embodiments, and thus should not be construed as limited by the exemplary embodiments shown in the figures. Additionally, the spacing of the respective pulleys 70*a*, 70*b*, 70*c*, 70*d* may vary. In the embodiment shown in FIG. 12B, the first and second pulleys 70*a*, 70*b* are positioned adjacent to each other, while the third and fourth pulleys 70*c*, 70*d* are distally spaced such that a larger gap is positioned between them.

Figure 13D:
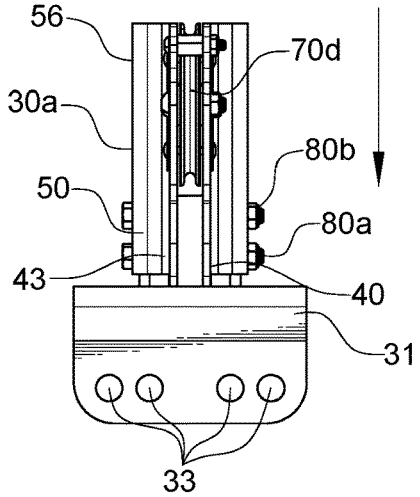
FIG. 13D is a front view of a first exemplary embodiment of a pulley unit in a second position in accordance with an example embodiment.

FIGS. 13A-13D illustrate a method of adjusting the pulley unit 30*a* between a first position and a second position. In the first position such as shown in FIG. 13A, the frame 50 is at a first angle with respect to the bracket 31. In the second position such as shown in FIG. 13D, the frame 50 is at a second angle with respect to the bracket 31, with the second angle being ninety degrees with respect to the first angle.

FIG. 13A illustrates the pulley unit 30*a* in the first position. As shown, the frame 50 is parallel with the bracket 31, with the first connector 40 inserted within the second connector 60. A pair of pins 80*a*, 80*b* are used to connect the bracket 31 and frame 50 together, with a first pin 80*a* extending through the first upper aperture 42 of the first connector 40 and the upper aperture 62 of the second connector 60. In some embodiments, however, a single pin 80*a* may be utilized for the same purpose.

Various types of pins 80*a*, 80*b* may be utilized, including a wide range of fasteners known in the art. The pins 80*a*, 80*b* may comprise a threaded fastener in some embodiments, with corresponding nuts being utilized to secure the pins 80*a*, 80*b* in place such as shown in FIGS. 12A and 12B. The pins 80*a*, 80*b* may in some embodiments be comprised of detents, including the use of a handle and a spring. The pins 80*a*, 80*b* may comprise various types of screws, bolts, nails, or other elongated fasteners known for connecting one object to another. As shown in FIGS. 15A-17D and discussed in more detail below, the pins 80*a*, 80*b* may each include a locking member 82*a*, 82*b*.

As shown in FIG. 12A, in the first position, the first pin 80*a* may extend through both a first set of upper apertures 42 of the first connector 40 and a set of upper apertures 62 of the second connector 60, and a second pin 80*b* may extend through both a first set of lower apertures 43 of the first connector 40 and a set of lower apertures 63 of the second connector 60. The pins 80*a*, 80*b* may be distally-spaced away from each other such that a cable 90 may extend in the space between the pins 80*a*, 80*b*.

To adjust the pulley unit 30*a* into the second position, the frame 50 is first removed from the bracket 31. As shown in FIG. 13B, the pins 80*a*, 80*b* are first removed such that the frame 50 may be lifted up and away from the bracket 31. The second connector 60 thus slides upwardly off of the first connector 40 such that the frame 50 is fully disconnected from the bracket 31.

As shown in FIG. 13C, the frame 50 may then be rotated with respect to the bracket 31 into the second position, which is at a right angle with respect to the first position. In the second position, the frame 50 is at a right angle with respect to the bracket 31 such as shown in FIG. 12B. In the embodiment shown in FIGS. 11A-14 in which the first and second connectors 40, 60 are both square-shaped, the frame 50 will need to be fully removed from the bracket 31 prior to being rotated. However, in certain embodiments in which the first and second connectors 40, 60 are round such as discussed below, the frame 50 may be rotated while still connected to the bracket 31.

As shown in FIG. 13D, the frame 50 may be lowered back onto the bracket 31 after the frame 50 has been rotated into the second position. The first connector 40 of the bracket 31 is inserted within the opening 61 of the second connector 60 until the second upper and lower apertures 45, 46 of the first connector 40 are aligned with the upper and lower apertures 62, 63 of the second connector 60. When the respective apertures 45, 46, 62, 63 are so aligned, the pins 80*a*, 80*b* may be reinserted so as to lock the pulley unit 30*a* into the second position such as shown in FIG. 13D. The same steps may be repeated in order to adjust the pulley unit 30*a* back into the first position as-needed.

As shown in FIG. 12B, in the second position, the first pin 80*a* may extend through both a second set of upper apertures 45 of the first connector 40 and a set of upper apertures 62 of the second connector 60, and a second pin 80*b* may extend through both a second set of lower apertures 46 of the first connector 40 and a set of lower apertures 63 of the second connector 60. The pins 80*a*, 80*b* may be distally-spaced away from each other such that a cable 90 may extend in the space between the pins 80*a*, 80*b*.

ii. Second Exemplary Embodiment

FIGS. 15A-18 illustrate a second exemplary embodiment of a pulley unit 30*b*. The second exemplary embodiment of the pulley unit 30*b* is similar to the first exemplary embodiment of the pulley unit 30*b*, with some notable variations. Generally, the second exemplary embodiment of the pulley unit 30*b* comprises a bracket 31 adapted to be connected to an exercise rack 20 and a frame 50 which is rotatably connected to the bracket 31. The bracket 31 includes a first connector 40 and the frame 50 includes a second connector 60, with the first connector 40 being adapted to engage with the second connector 60, such as by being inserted within the second connector 60.

Figure 15A:
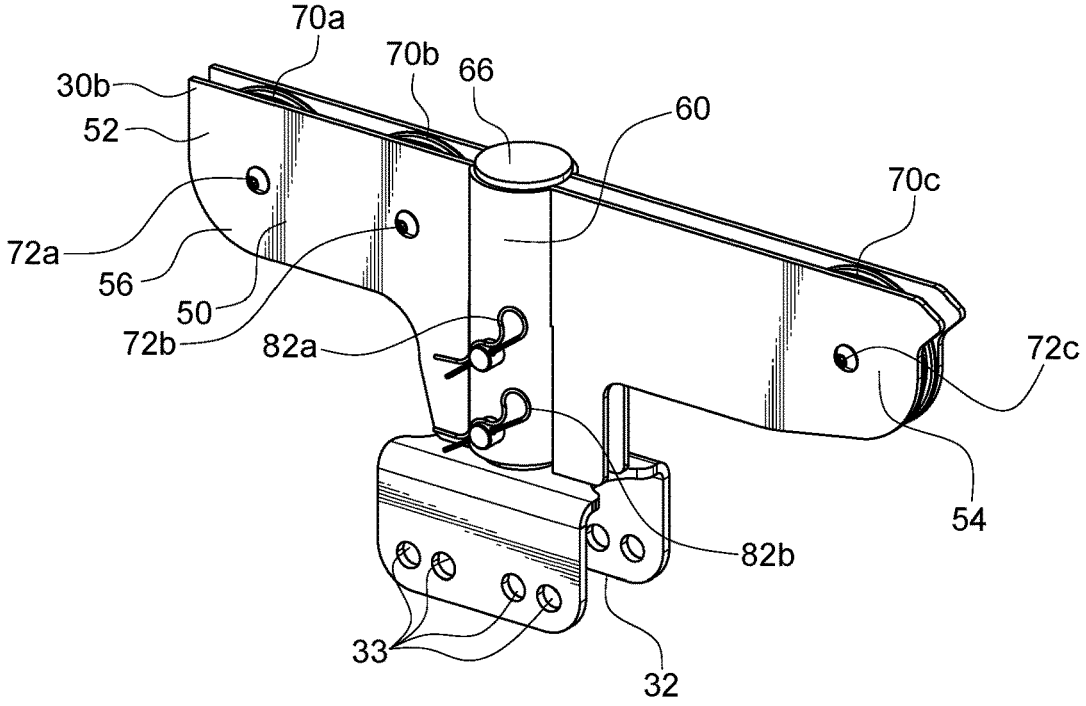
FIG. 15A is a perspective view of a second exemplary embodiment of a pulley unit in a first position in accordance with an example embodiment.
Figure 15B:
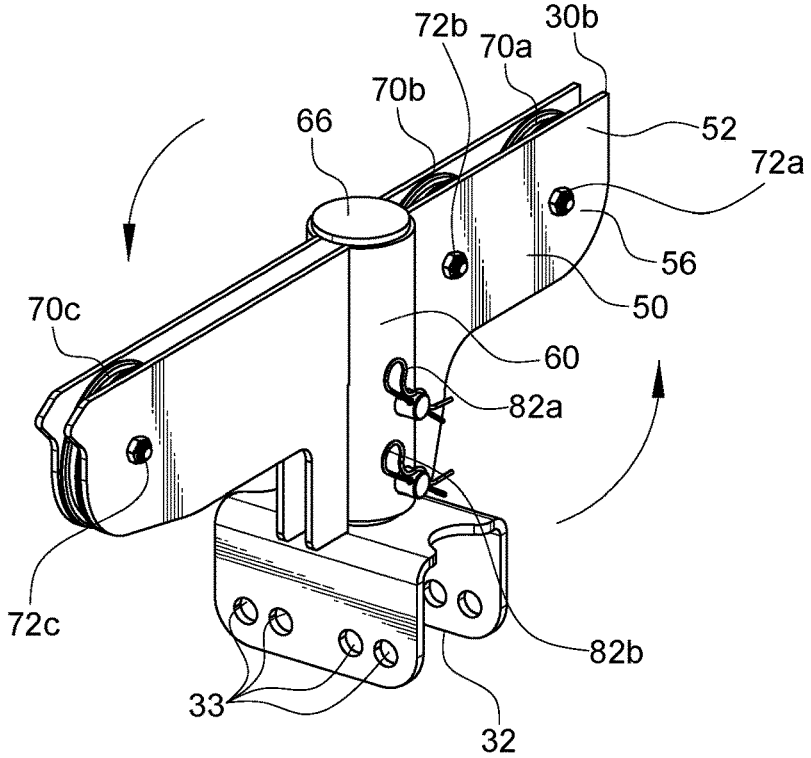
FIG. 15B is a perspective view of a second exemplary embodiment of a pulley unit in a second position in accordance with an example embodiment.

With reference to FIGS. 15A and 15B, it can be seen that the second exemplary embodiment of the pulley unit 30*b* includes a pair of wings 52, 54 which extend outwardly in opposite directions from the central second connector 60. In the embodiment shown in FIGS. 15A and 15B, it can be seen that only three pulleys 70*a*, 70*b*, 70*c* are utilized, with the first and second pulleys 70*a*, 70*b* being rotatably connected within the slot 58 of the first wing 54 and the third pulley 70*c* being rotatably connected within the slot 58 of the second wing 54.

Figure 16A:
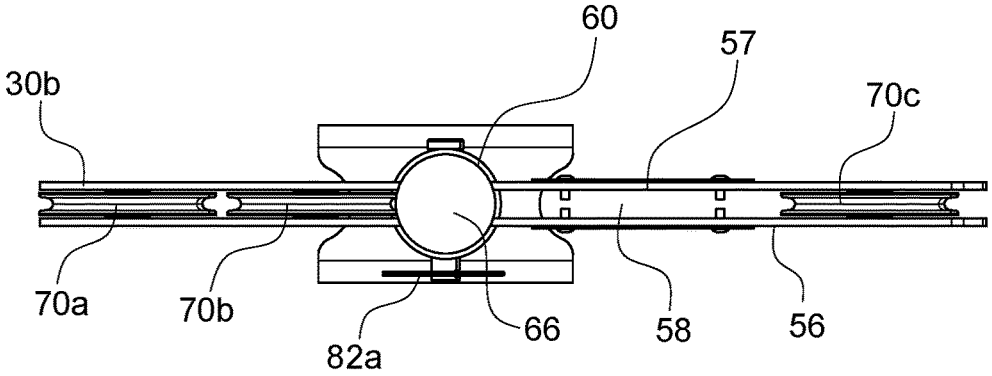
FIG. 16A is a top view of a second exemplary embodiment of a pulley unit in a first position in accordance with an example embodiment.
Figure 16B:
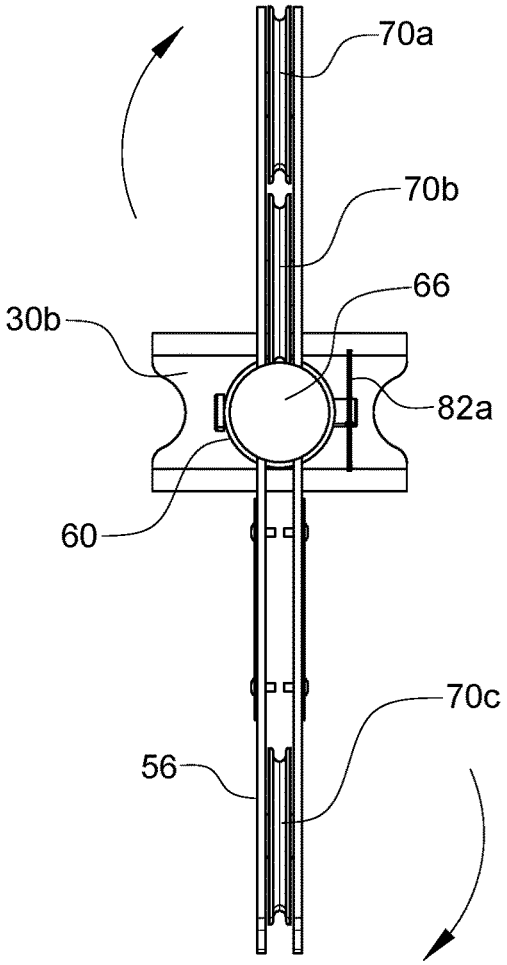
FIG. 16B is a top view of a second exemplary embodiment of a pulley unit in a second position in accordance with an example embodiment.

As best shown in FIGS. 16A and 16B, the primary difference between the second exemplary embodiment of the pulley unit 30*b* and the first exemplary embodiment of the pulley unit 30*b* is the shape of the respective connectors 40, 60. In the second exemplary embodiment of the pulley unit 30*b*, each of the first and second connectors 40, 60 are comprised of a round cross-section which allows the frame 50 to be rotated with respect to the bracket 31 without the frame 50 being fully removed from the bracket 31. While concentric openings 41, 61 still extend through the respective first and second connectors 40, 60, a cap 66 is positioned at the top of the opening 61 of the second connector 60. The cap 66 is illustrated as comprised a round shape and may be fixedly or removably connected to the second connector 60.

Figure 17A:
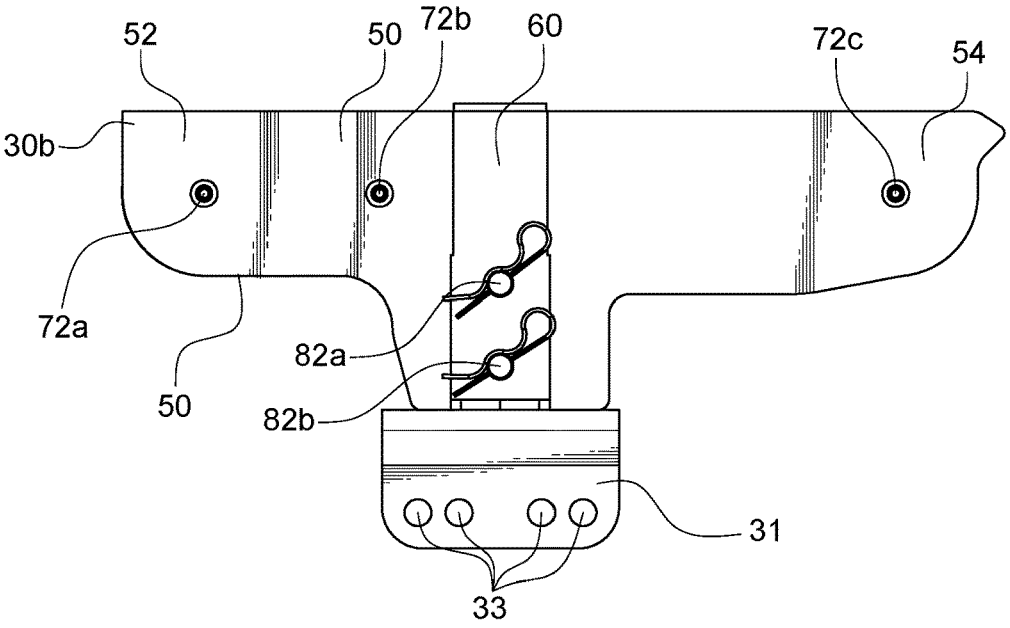
FIG. 17A is a front view of a second exemplary embodiment of a pulley unit in a first position in accordance with an example embodiment.
Figure 17B:
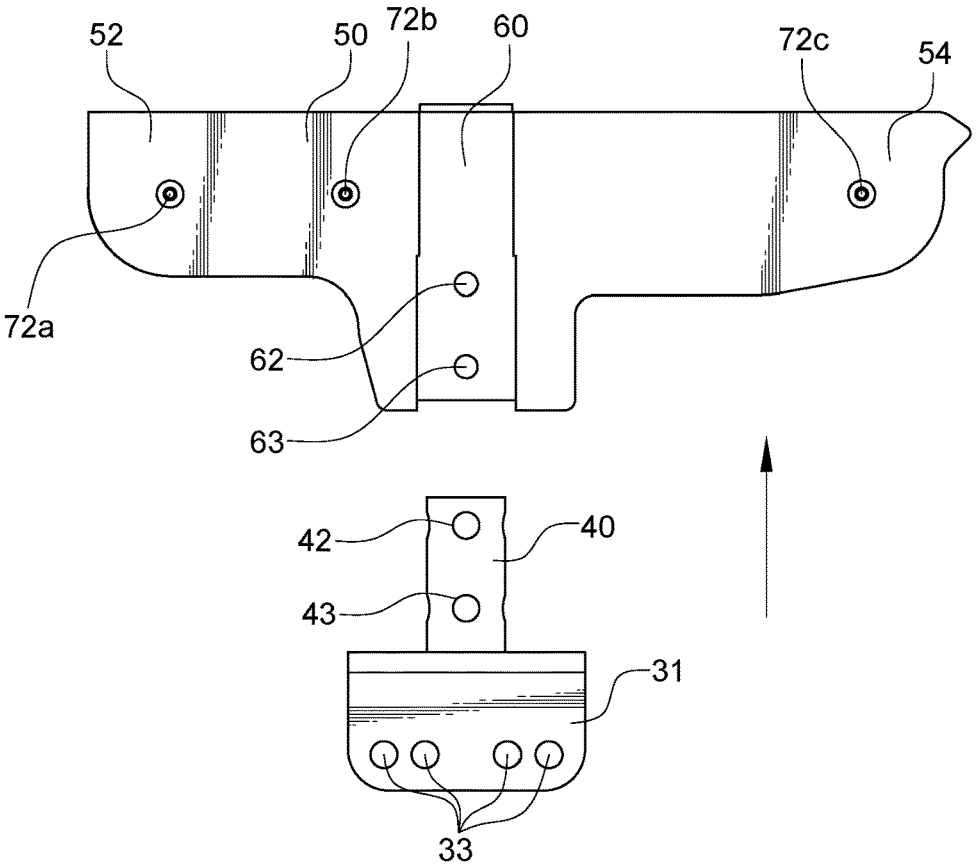
FIG. 17B is a front view of a frame lifted up with respect to a bracket of a second exemplary embodiment of a pulley unit in accordance with an example embodiment.
Figure 18:
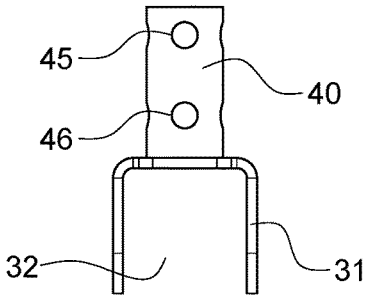
FIG. 18 is a side view of a bracket of a second exemplary embodiment of a pulley unit in accordance with an example embodiment.

As best shown in FIGS. 17B and 18, it can also be seen that the apertures 42, 43, 45, 46 of the first connector 40 of the second embodiment of the pulley unit 30*b* are aligned vertically, rather than diagonally. Such a configuration may be utilized where it is not intended that a cable 90 will be routed through the center openings 41, 61 of the connectors 40, 60, particularly in embodiments in which a cap 66 is utilized. It should be appreciated, however, that the second embodiment of the pulley unit 30*b* may include diagonally-oriented or horizontally-oriented apertures 42, 43, 45, 46 in some embodiments.

Continuing to reference FIGS. 17B and 18, it can be seen that sets of apertures 42, 43, 45, 46 may be utilized such that each of the apertures 42, 43, 45, 46 extends fully through the first connector 40. Such an embodiment allows for the pins 80*a*, 80*b* to extend fully through the first connector 40 such as shown in FIG. 16A. In such an embodiment, a first set of concentric upper apertures 42 and a first set of concentric lower apertures 43 are positioned on opposing sides of the first connector 40. Similarly, a second set of concentric upper apertures 45 and a second set of concentric lower apertures 46 are positioned on opposing sides of the first connector 40, ninety degrees offset from the first sets of apertures 42, 43.

Figure 17C:
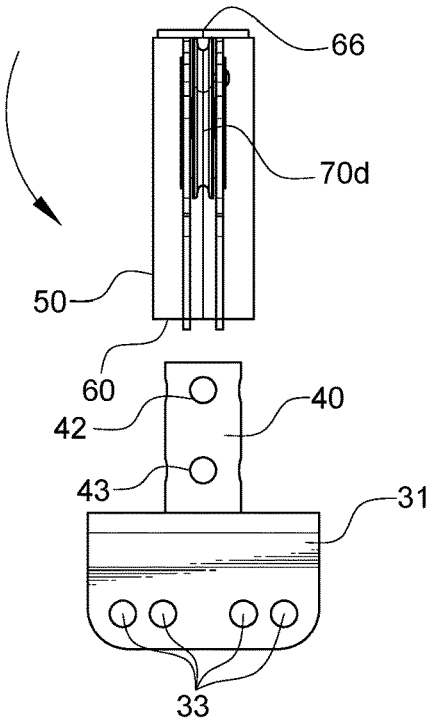
FIG. 17C is a front view of a frame lifted up and rotated with respect to a bracket of a second exemplary embodiment of a pulley unit in accordance with an example embodiment.
Figure 17D:
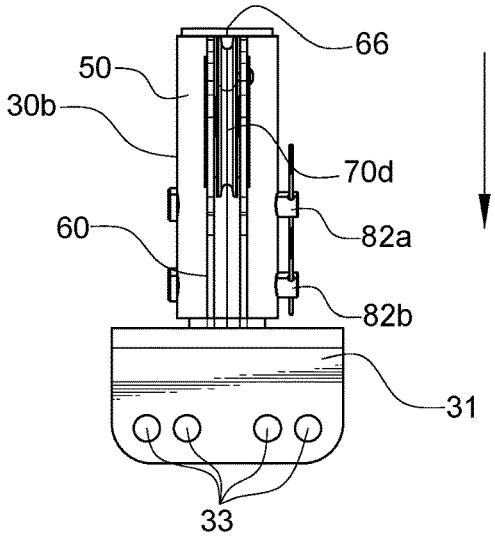
FIG. 17D is a front view of a second exemplary embodiment of a pulley unit in a second position in accordance with an example embodiment.

As best shown in FIGS. 17A and 17D, it can be seen that each of the pins 80*a*, 80*b* includes a locking member 82*a*, 82*b* which prevents each of the pins 80*a*, 80*b* from slipping out of the bracket 31 and frame 50 prematurely, such as due to motion during performance of exercises. In the exemplary embodiment shown in FIGS. 17A and 17D, it can be seen that a first locking member 82*a* may be removably inserted through the first pin 80*a* and a second locking member 82*b* may be removably inserted through the second pin 80*b*.

FIGS. 17A-17D illustrate an exemplary method of adjusting the pulley unit 30*b* between the first and second positions. While FIGS. 17B and 17C illustrate the frame 50 being removed entirely from the bracket 31, it should be appreciated that the round shape of the connectors 40, 60 makes it possible to rotate the frame 50 with respect to the bracket 31 without removing the frame 50 (e.g., by lifting it upwardly).

FIG. 17A illustrates the pulley unit 30*b* in the first position in which the frame 50 is parallel with the bracket 31. The pins 80*a*, 80*b* are extended through the first upper and lower apertures 42, 43 of the first connector 40 and the upper and lower apertures 62, 63 of the second connector 60.

As shown in FIG. 17A, in the first position, the first pin 80*a* may extend through both a first set of upper apertures 42 of the first connector 40 and a set of upper apertures 62 of the second connector 60, and a second pin 80*b* may extend through both a first set of lower apertures 43 of the first connector 40 and a set of lower apertures 63 of the second connector 60. The pins 80*a*, 80*b*, in such an embodiment, may be vertically-oriented such as shown in the figures.

As shown in FIG. 17B, the pins 80*a*, 80*b* may be removed such that the frame 50 may be lifted off of the bracket 31. However, in embodiments which includes round first and second connectors 40, 60 such as shown in FIGS. 17A-17D, the frame 50 need not necessarily be lifted off of the bracket 31. In such embodiments, the pins 80*a*, 80*b* need only be removed so that the frame 50 may be rotated about the bracket 31.

As shown in FIG. 17C, the frame 50 may be rotated into the second position which is perpendicular to the bracket 31. Generally, the frame 50 will be rotated until the second upper and lower apertures 45, 46 of the first connector 40 are aligned and concentric with the upper and lower apertures 62, 63 of the second connector 60. As previously mentioned, while FIG. 17C illustrates that the frame 50 has been lifted upwardly off of the bracket 31, it may be possible to rotate the frame 50 without lifting upwardly off of the bracket 31 in embodiments in which the first and second connectors 40, 60 are round.

In either case, once the second upper and lower apertures 45, 46 of the first connector 40 are aligned and concentric with the upper and lower apertures 62, 63 of the second connector 60, the pins 80*a*, 80*b* may be reinserted. More specifically, the first pin 80*a* may be inserted through the second upper aperture 45 of the first connector 40 and the upper aperture 62 of the second connector 60, and the second pin 80*b* may be inserted through the second lower aperture 46 of the first connector 40 and the lower aperture 63 of the second connector 60. Such a configuration in which the pulley unit 30*b* is in the second position is shown in FIG. 17D. The same steps may be repeated in order to adjust the pulley unit 30*b* back into the first position as-needed.

iii. Third Exemplary Embodiment

FIGS. 19A-22 illustrate a third exemplary embodiment of a pulley unit 30*c*. As with the previously-discussed embodiments, the pulley unit 30*c* comprises a bracket 31 which is adapted to be connected to an exercise rack 20 and a frame 50 which is adjustably and removably connected to the bracket 31. The frame 50 may be rotated between a first position in which the frame 50 is parallel with the bracket 31, and a second position in which the frame 50 is perpendicular with the bracket 31.

Figure 19A:
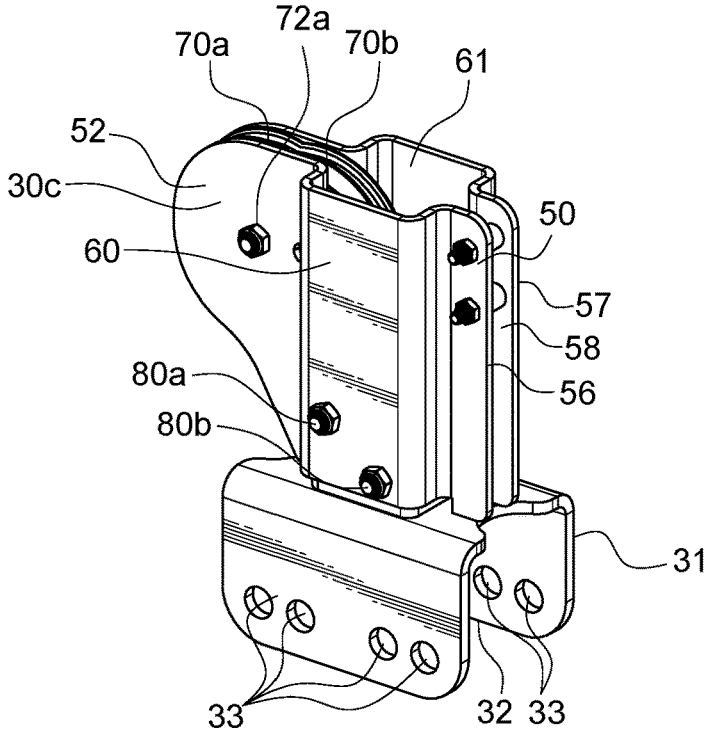
FIG. 19A is a perspective view of a third exemplary embodiment of a pulley unit in a first position in accordance with an example embodiment.
Figure 19B:
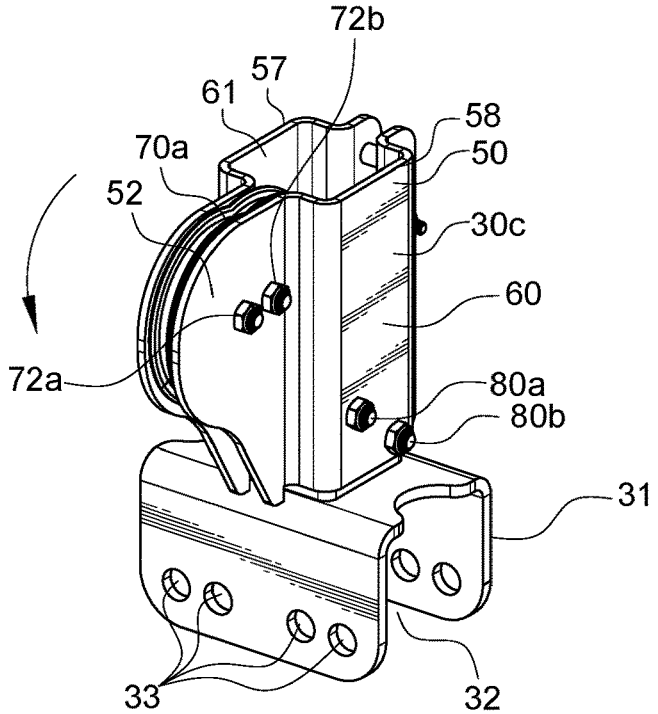
FIG. 19B is a perspective view of a third exemplary embodiment of a pulley unit in a second position in accordance with an example embodiment.

As best shown in FIGS. 19A and 19B, the frame 50 of the third exemplary embodiment of the pulley unit 30*c* will generally comprise only a first wing 52, with the second wing 54 being omitted. The first wing 52 of the frame 50 of the third exemplary embodiment of the pulley unit 30*c* may include a rounded edge which matches the curvature of the pulley 70*a*. However, other shapes may be utilized. The first wing 52 extends outwardly from the second connector 60 of the frame 50.

Continuing to reference FIGS. 19A and 19B, it can be seen that one or more pulleys 70*a*, 70*b* may be rotatably connected to the frame 50 of the third exemplary embodiment of the pulley unit 30*c*. In the embodiment shown in the figures, a pair of pulleys 70*a*, 70*b* which slightly overlap are shown. Various other configurations may be utilized for the pulleys 70*a*, 70*b* in different embodiments.

Figure 20A:
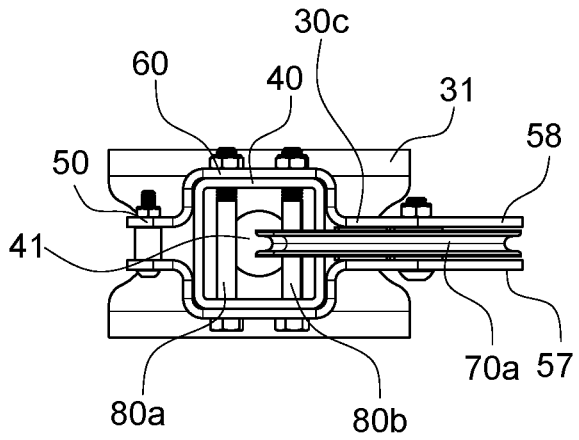
FIG. 20A is a top view of a third exemplary embodiment of a pulley unit in a first position in accordance with an example embodiment.
Figure 20B:
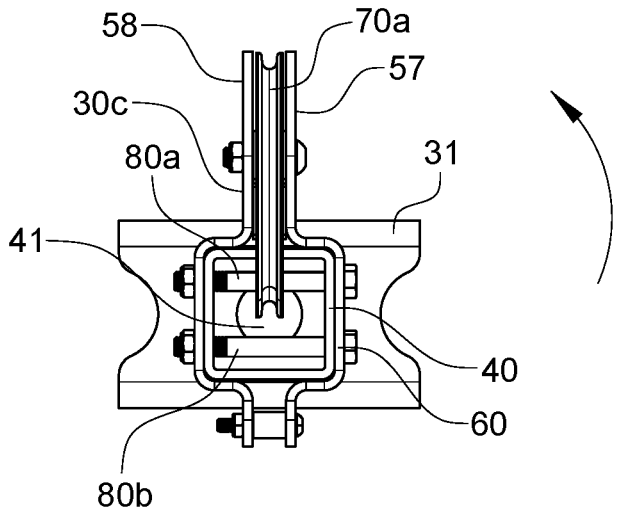
FIG. 20B is a top view of a third exemplary embodiment of a pulley unit in a second position in accordance with an example embodiment.

As best shown in FIGS. 20A and 20B, the first and second connectors 40, 60 of the third exemplary embodiment of the pulley unit 30*c* may each comprise a square-shaped cross-section. The first connector 40 may include two sets of upper and lower apertures 42, 43, 45, 46 which are positioned on different, adjacent sides of the first connector 40. In the embodiment shown in FIGS. 19A-20B and 22, it can be seen that the upper and lower apertures 42, 43, 45, 46 are diagonally-oriented. However, other orientations (e.g., vertical and horizontal) may be utilized in different embodiments.

With reference to FIGS. 20A and 20B, it can be seen that the first connector 40 may be inserted within the second connector 60 to connect the frame 50 to the bracket 31. Pins 80*a*, 80*b* may be selectively inserted within the apertures 42, 43, 45, 46 so as to lock the frame 50 between its two positions. The first and second connectors 40, 60 include concentric openings 41, 61 through which a cable 90 may be routed as-needed when in both the first and second positions.

FIGS. 19A and 20A illustrate the third exemplary embodiment of the pulley unit 30*c* in the first position. FIGS. 19B and 20B illustrate the third exemplary embodiment of the pulley unit 30*c* in the second position, with the second position being ninety degrees offset with respect to the first position. FIGS. 21A-21D illustrate an exemplary method of adjusting the pulley unit 30*c* between the two positions.

Figure 21A:
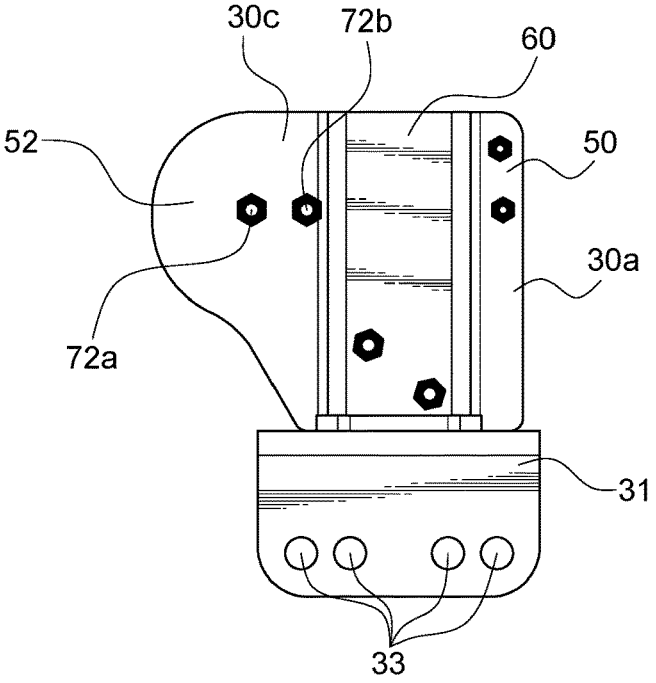
FIG. 21A is a front view of a third exemplary embodiment of a pulley unit in a first position in accordance with an example embodiment.

As shown in FIG. 21A, in the first position, the first pin 80*a* may extend through both a first set of upper apertures 42 of the first connector 40 and a set of upper apertures 62 of the second connector 60, and a second pin 80*b* may extend through both a first set of lower apertures 43 of the first connector 40 and a set of lower apertures 63 of the second connector 60. The pins 80*a*, 80*b* may be distally-spaced away from each other such that a cable 90 may extend in the space between the pins 80*a*, 80*b*.

Figure 21B:
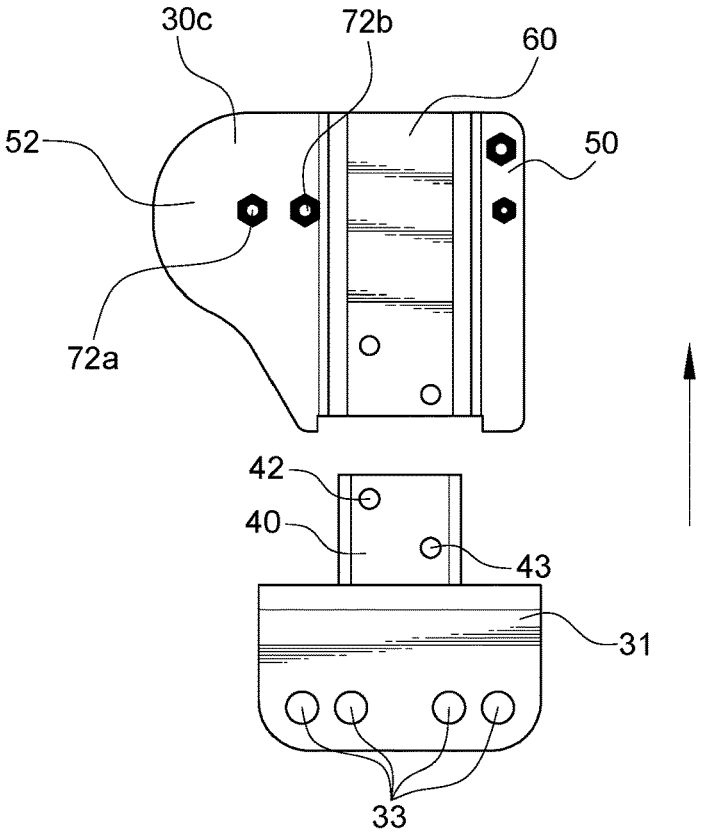
FIG. 21B is a front view of a frame lifted up with respect to a bracket of a third exemplary embodiment of a pulley unit in accordance with an example embodiment.

To adjust the pulley unit 30*c* into the second position, the frame 50 is first removed from the bracket 31. As shown in FIG. 21B, the pins 80*a*, 80*b* are first removed such that the frame 50 may be lifted up and away from the bracket 31. The second connector 60 thus slides upwardly off of the first connector 40 such that the frame 50 is fully disconnected from the bracket 31.

Figure 21C:
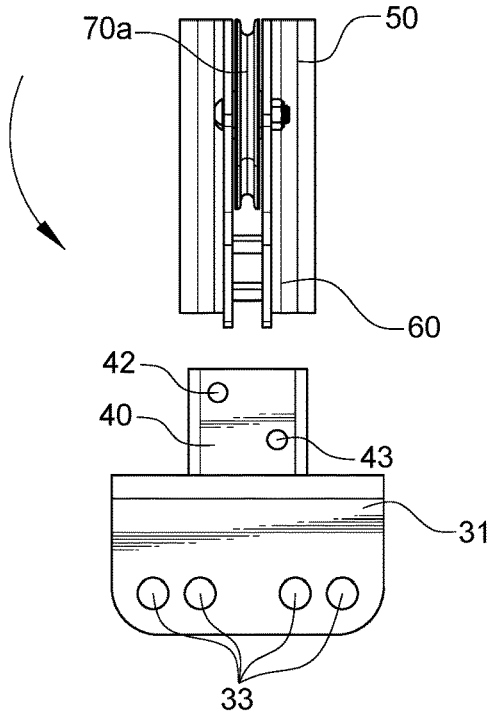
FIG. 21C is a front view of a frame lifted up and rotated with respect to a bracket of a third exemplary embodiment of a pulley unit in accordance with an example embodiment.

As shown in FIG. 21C, the frame 50 may then be rotated with respect to the bracket 31 into the second position, which is at a right angle with respect to the first position. In the second position, the frame 50 is at a right angle with respect to the bracket 31 such as shown in FIG. 20B. In the embodiment shown in FIGS. 19A-22 in which the first and second connectors 40, 60 are both square-shaped, the frame 50 will need to be fully removed from the bracket 31 prior to being rotated. However, in certain embodiments in which the first and second connectors 40, 60 are round such as with the fourth exemplary embodiment discussed below, the frame 50 may be rotated while still connected to the bracket 31.

Figure 21D:
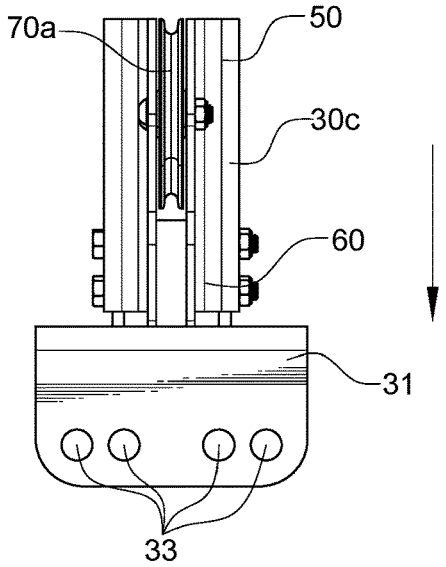
FIG. 21D is a front view of a third exemplary embodiment of a pulley unit in a second position in accordance with an example embodiment.
Figure 22:
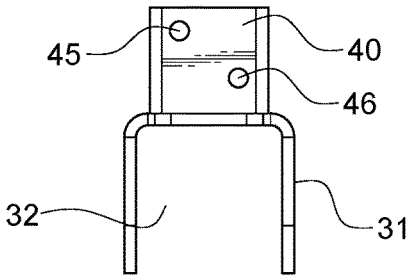
FIG. 22 is a side view of a bracket of a third exemplary embodiment of a pulley unit in accordance with an example embodiment.

As shown in FIG. 21D, the frame 50 may be lowered back onto the bracket 31 after the frame 50 has been rotated into the second position. The first connector 40 of the bracket 31 is inserted within the opening 61 of the second connector 60 until the second upper and lower apertures 45, 46 of the first connector 40 are aligned with the upper and lower apertures 62, 63 of the second connector 60. When the respective apertures 45, 46, 62, 63 are so aligned, the pins 80*a*, 80*b* may be reinserted so as to lock the pulley unit 30*c* into the second position such as shown in FIG. 21D. The same steps may be repeated in order to adjust the pulley unit 30*c* back into the first position as-needed.

As shown in FIG. 20B, in the second position, the first pin 80*a* may extend through both a second set of upper apertures 45 of the first connector 40 and a set of upper apertures 62 of the second connector 60, and a second pin 80*b* may extend through both a second set of lower apertures 46 of the first connector 40 and a set of lower apertures 63 of the second connector 60. The pins 80*a*, 80*b* may be distally-spaced away from each other such that a cable 90 may extend in the space between the pins 80*a*, 80*b*.

iv. Fourth Exemplary Embodiment

FIGS. 23A-26 illustrate a fourth exemplary embodiment of a pulley unit 30*d*. The fourth exemplary embodiment of the pulley unit 30*d* is similar to the third exemplary embodiment of the pulley unit 30*c*, with some notable variations. Generally, the fourth exemplary embodiment of the pulley unit 30*d* comprises a bracket 31 adapted to be connected to an exercise rack 20 and a frame 50 which is rotatably connected to the bracket 31. The bracket 31 includes a first connector 40 and the frame 50 includes a second connector 60, with the first connector 40 being adapted to engage with the second connector 60, such as by being inserted within the second connector 60.

Figure 23A:
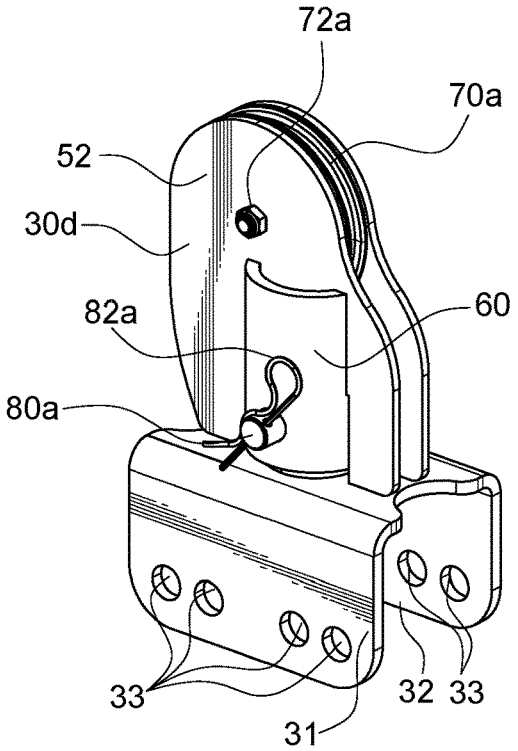
FIG. 23A is a perspective view of a fourth exemplary embodiment of a pulley unit in a first position in accordance with an example embodiment.
Figure 23B:
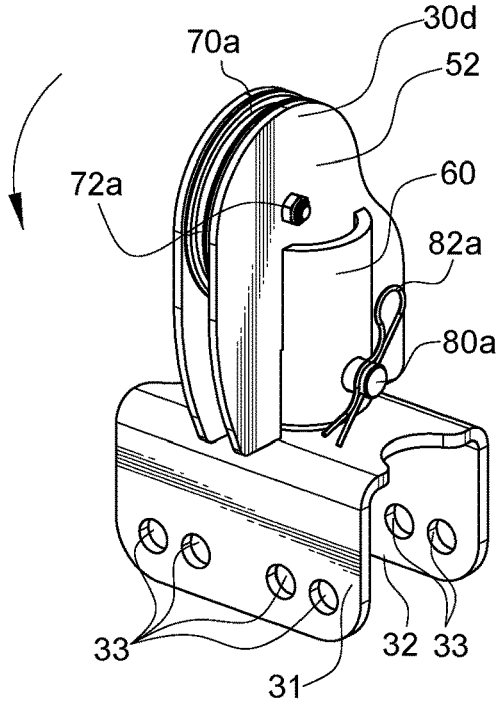
FIG. 23B is a perspective view of a fourth exemplary embodiment of a pulley unit in a second position in accordance with an example embodiment.

As best shown in FIGS. 23A and 23B, it can be seen that the fourth exemplary embodiment of the pulley unit 30*d* includes a frame 50 having a single wing 52 which extends upwardly, rather than outwardly to the side, from the second connector 60. Such a configuration may be particularly useful for routing a cable 90 horizontally, rather than vertically. A single pulley 70*a* is shown rotatably connected to the frame 50, with the shape of the first wing 52 matching the outer curvature of the pulley 70*a*. However, other configurations may be utilized in different embodiments.

Figure 24A:
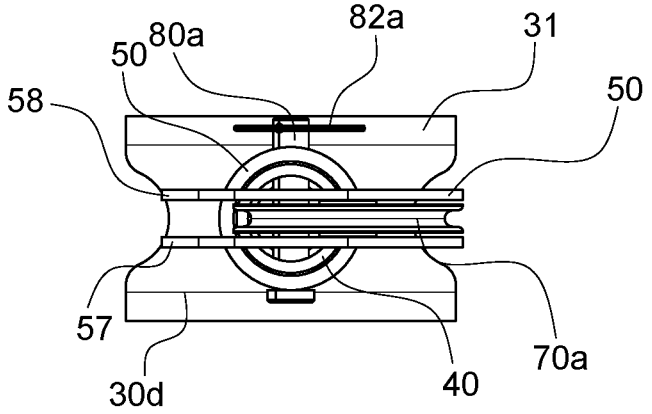
FIG. 24A is a top view of a fourth exemplary embodiment of a pulley unit in a first position in accordance with an example embodiment.
Figure 24B:
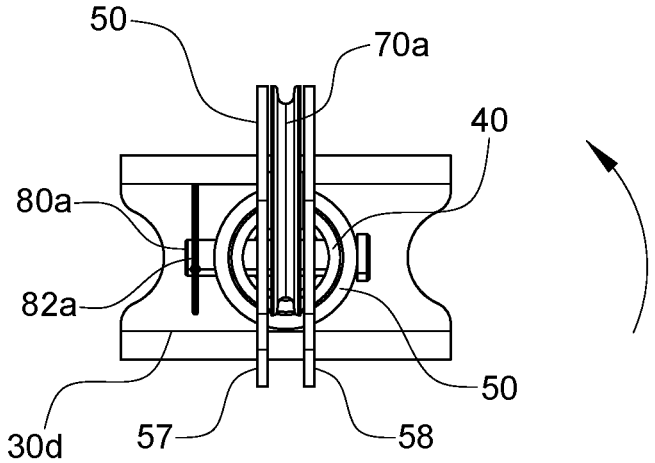
FIG. 24B is a top view of a fourth exemplary embodiment of a pulley unit in a second position in accordance with an example embodiment.

As best shown in FIGS. 24A and 24B, the shape of the respective connectors 40, 60 in the fourth exemplary embodiment of the pulley unit 30*d* are round, rather than square. In the fourth exemplary embodiment of the pulley unit 30*d*, each of the first and second connectors 40, 60 are comprised of a round cross-section which allows the frame 50 to be rotated with respect to the bracket 31 without the frame 50 being fully removed from the bracket 31. Concentric openings 41, 61 extend through the respective first and second connectors 40, 60 such that a cable 90 may be routed through the first and second connectors 40, 60 as-needed.

With reference to FIGS. 23A-24B and 26, it can be seen that the fourth exemplary embodiment of the pulley unit 30*d* uses only a single aperture 42, 45 on each side of its first connector 40, and a single aperture 62 on the second connector 60. It can be seen that sets of apertures 42, 45 may be utilized such that each of the apertures 42, 45 extends fully through the first connector 40. Such an embodiments allows for a pin 80*a* to extend fully through the first connector 40 such as shown in FIG. 24A. In such an embodiment, a first set of concentric upper apertures 42 is positioned on opposing sides of the first connector 40. Similarly, a second set of concentric apertures 45 and a second set of concentric apertures 46 are positioned on opposing sides of the first connector 40, ninety degrees offset from the first set of apertures 42.

As best shown in FIGS. 23A and 23B, it can be seen that the pin 80*a* includes a locking member 82*a* which prevents the pin 80*a* from slipping out of the bracket 31 and frame 50 prematurely, such as due to motion during performance of exercises. In the exemplary embodiment shown in FIGS. 23A and 23B, it can be seen that a first locking member 82*a* may be removably inserted through the first pin 80*a*.

Figure 25A:
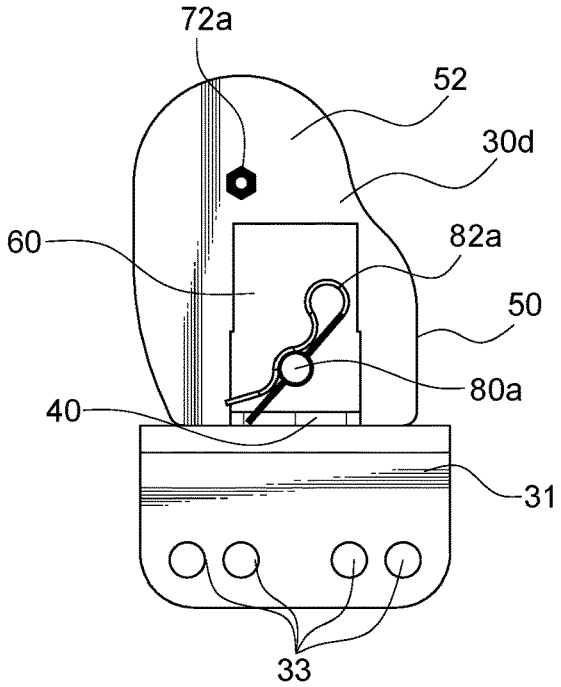
FIG. 25A is a front view of a fourth exemplary embodiment of a pulley unit in a first position in accordance with an example embodiment.
Figure 25B:
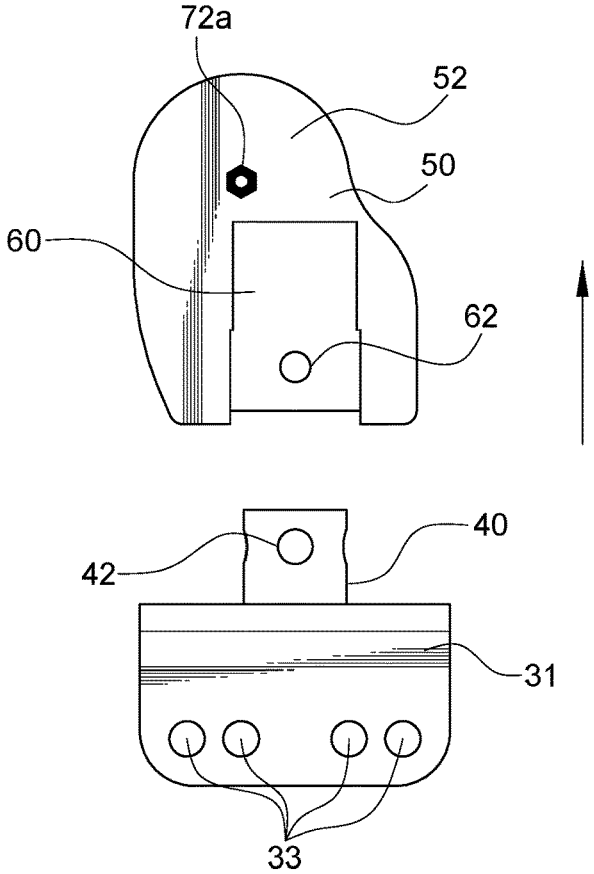
FIG. 25B is a front view of a frame lifted up with respect to a bracket of a fourth exemplary embodiment of a pulley unit in accordance with an example embodiment.
Figure 25C:
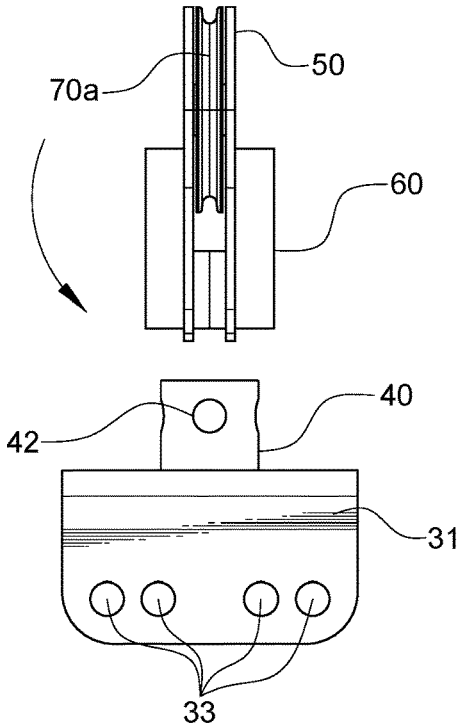
FIG. 25C is a front view of a frame lifted up and rotated with respect to a bracket of a fourth exemplary embodiment of a pulley unit in accordance with an example embodiment.

FIGS. 25A-25D illustrate an exemplary method of adjusting the fourth exemplary embodiment of the pulley unit 30*d* between the first and second positions. While FIGS. 25B and 25C illustrate the frame 50 being removed entirely from the bracket 31, it should be appreciated that the round shape of the connectors 40, 60 makes it possible to rotate the frame 50 with respect to the bracket 31 without removing the frame 50 (e.g., by lifting it upwardly).

FIG. 25A illustrates the pulley unit 30*d* in the first position in which the frame 50 is parallel with the bracket 31. A pin 80*a* extends through the first aperture 42 of the first connector 40 and the first aperture 62 of the second connector 60. The frame 50 is in the first position with respect to the bracket 31, with the frame 50 being parallel with respect to the bracket 31. As shown in FIG. 25A, in the first position, the first pin 80*a* may extend through both a set of apertures 42 of the first connector 40 and a set of apertures 62 of the second connector 60.

As shown in FIG. 25B, the pin 80*a* may be removed such that the frame 50 may be lifted off of the bracket 31. However, in embodiments which includes round first and second connectors 40, 60 such as shown in FIGS. 25A-25D, the frame 50 need not necessarily be lifted off of the bracket 31. In such embodiments, the pin 80*a* need only be removed so that the frame 50 may be rotated about the bracket 31.

As shown in FIG. 25C, the frame 50 may be rotated into the second position which is perpendicular to the bracket 31. Generally, the frame 50 will be rotated until the second aperture 45 of the first connector 40 is aligned and concentric with the aperture 62 of the second connector 60. As previously mentioned, while FIG. 25C illustrates that the frame 50 has been lifted upwardly off of the bracket 31, it may be possible to rotate the frame 50 without lifting upwardly off of the bracket 31 in embodiments in which the first and second connectors 40, 60 are round.

Figure 25D:
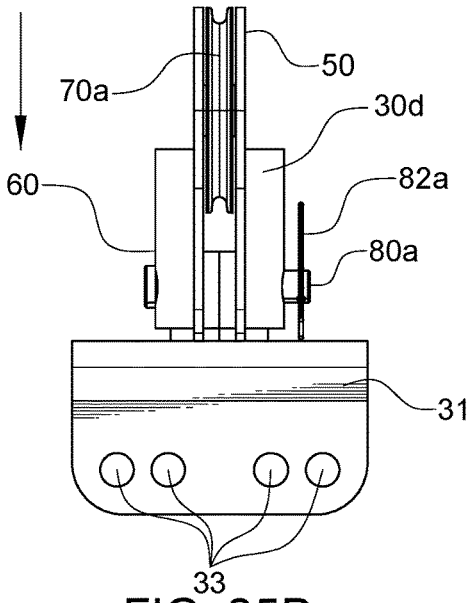
FIG. 25D is a front view of a fourth exemplary embodiment of a pulley unit in a second position in accordance with an example embodiment.
Figure 26:
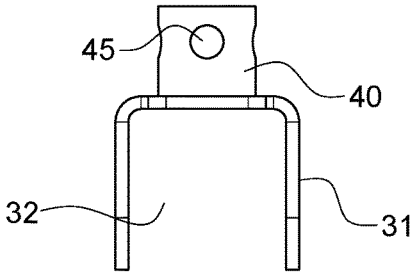
FIG. 26 is a side view of a bracket of a fourth exemplary embodiment of a pulley unit in accordance with an example embodiment.

In either case, once the second aperture 45 of the first connector 40 is aligned and concentric with the aperture 62 of the second connector 60, the pin 80*a* may be reinserted. More specifically, the pin 80*a* may be inserted through the second aperture 45 of the first connector 40 and the aperture 62 of the second connector 60. Such a configuration in which the pulley unit 30*d* is in the second position is shown in FIG. 25D. The same steps may be repeated in order to adjust the pulley unit 30*d* back into the first position as-needed.

E. Operation of Preferred Embodiment.

In use, one or more pulley units 30*a*, 30*b*, 30*c*, 30*d* may be attached to various structures of an exercise rack 20 in various positions and orientations so as to perform a wide range of different exercises. The pulley units 30*a*, 30*b*, 30*c*, 30*d* may be adjusted between at least two positions as-needed to allow for variations in exercise moves. One or more cables 90 may be routed through one or more pulley units 30*a*, 30*b*, 30*c*, 30*d*, with the one or more cables 90 being connected to various types of weights 100 or the like to provide resistance for an exerciser 12 when pulling on the one or more cables 90 in various directions.

Generally, each pulley unit 30*a*, 30*b*, 30*c*, 30*d* may be attached to an exercise rack 20 through use of a bracket 31. The bracket 31 generally includes a channel 32 into which various structures of the exercise rack 20 may be inserted and one or more apertures 33 through which a fastener may be inserted to removably attach the bracket 31 to the exercise rack 20. In other words, the bracket 31 may be positioned over a portion of the exercise rack 20. The bracket 31 may be attached to a wide range of positions on an exercise rack 20, including but not limited to the support members 21*a*, 21*b*, 21*c*, 21*d*, 21*e*, 21*f*, upper arm members 22*a*, 22*b*, 22*c*, 22*d*, 22*e*, 22*f*, and/or lower arm members 23*a*, 23*b*, 23*c*, 23*d*, 23*e*.

The bracket 31 may be attached at various orientations to the exercise rack 20. For example, the bracket 31 may be attached to the top, bottom, or sides of any of the support members 21*a*, 21*b*, 21*c*, 21*d*, 21*e*, 21*f*, upper arm members 22*a*, 22*b*, 22*c*, 22*d*, 22*e*, 22*f*, and/or lower arm members 23*a*, 23*b*, 23*c*, 23*d*, 23*e* of an exercise rack 20 to allow for different types of exercises to be performed. Each pulley unit 30*a*, 30*b*, 30*c*, 30*d* may be easily repositioned or reoriented by simple removing the fasteners and repositioning the bracket 31 prior to reinserting the fasteners. In some embodiments, fasteners may be omitted. By way of example, magnets or straps could be utilized to secure the bracket 31 to the exercise rack 20.

Each pulley unit 30*a*, 30*b*, 30*c*, 30*d* may be oriented in one of at least two positions either prior to, or after, being attached to the exercise rack 20. In a first exemplary position, the frame 50 and bracket 31 of each pulley unit 30*a*, 30*b*, 30*c*, 30*d* are parallel. In a second exemplary position, the frame 50 is rotated ninety degrees with respect to the bracket 31 such that the frame 50 and bracket 31 are perpendicular. Thus, the first position is at a right angle with respect to the second position. The adjustment of the orientation of the pulley unit 30*a*, 30*b*, 30*c*, 30*d* may be useful for accommodating a wide range of exercise moves by altering the routing of a cable 90.

To adjust the pulley units 30*a*, 30*b*, 30*c*, 30*d* between their at least two positions, the one or more pins 80*a*, 80*b* are first removed from the first and second connectors 40, 60. The frame 50 may then be lifted upwardly and removed from the bracket 31, then rotated into the desired position before being lowered back onto the bracket 31. However, in some embodiments, the frame 50 need not be lifted up off of the bracket 31, but instead may be rotated while the respective connectors 40, 60 are still engaged. In either case, the one or more pins 80*a*, 80*b* are inserted through the connectors 40, 60 when the frame 50 has been rotated into its desired position.

In the first position such as shown throughout the figures, the one or more first apertures 42, 43 of the first connector 40 are aligned and concentric with the one or more apertures 62, 63 of the second connector 60. In the second position such as shown throughout the figures, the one or more second apertures 45, 46 of the first connector 40 are aligned and concentric with the one or more apertures 62, 63 of the second connector 60.

In such a manner, the position of the frame 50 may be adjusted without removing the bracket 31 from the exercise rack 20. Such a feature eases the adjustment of the pulley units 30*a*, 30*b*, 30*c*, 30*d* by omitting the requirement that an exerciser 12 remove the bracket 31 each time a pulley unit 30*a*, 30*b*, 30*c*, 30*d* is to be adjusted between positions. This can save valuable time when performing an exercise routine using the exercise rack 20, as the exerciser 12 need only adjust the frame 50 without a need to remove and adjust the bracket 31.

The pulley units 30*a*, 30*b*, 30*c*, 30*d* may be utilized in combination with other exercise attachments to perform a wide variety of exercises. Generally, a cable 90 is routed through the pulley unit(s) 30*a*, 30*b*, 30*c*, 30*d* and connected to a weight 100. The cable 90 will generally include a first end 91 to be grasped by an exerciser 12, and a second end 92 to be secured to the weight 100, which will impart resistance force against pulling of the cable 90 by the exerciser 12. By positioning the pulley units 30*a*, 30*b*, 30*c*, 30*d* at various locations of the exercise rack 20, and adjusting the orientations of the pulley units 30*a*, 30*b*, 30*c*, 30*d*, the cable 90 may be routed in various directions as-needed to accommodate different exercises or different positioning of the weight 100.

The first end 91 of the cable 90 may include a handle 93 to be grasped by an exerciser 12. Additionally, various positions along the length of the cable 90 may include a stopper 95 which prevents the cable 90 from being drawn into a pulley unit 30*a*, 30*b*, 30*c*, 30*d*. The stopper 95 may comprise a member which is wider than the pulley unit 30*a*, 30*b*, 30*c*, 30*d*, such as a spherical member as shown in the figures. However, various other shapes may be utilized for the stopper 95.

As shown throughout the figures, a foot rest 29 may be attached to various positions on the exercise rack 20, such as at or near a lower end of any of the support members 21*a*, 21*b*, 21*c*, 21*d*, 21*e*, 21*f*, or to any of the lower arm members 23*a*, 23*b*, 23*c*, 23*d*, 23*e*. The foot rest 29 may be positioned adjacent to and outside of a pulley unit 30*a*, 30*b*, 30*c*, 30*d*. The foot rest 29 may include an opening or slot through which the cable 90 may be routed. In some embodiments, the foot rest 29 may function to stop retraction of the cable 90 past a certain point, either with use of a stopper 95 or by the handle 93.

Various types of weights 100 may be utilized with the systems and methods shown and described herein. In some embodiments, the one or more weights 100 may be secured to a weight rod 103 on top of a weight support 102, such as a flat plate member or bracket. The weight support 102 may be rested upon the ground surface, upon a floor support 26, or on a weight bracket 105 as shown in the various figures.

In other embodiments, a weightlifting unit 110 may be utilized, with an upper bracket 111 attached to a first portion of the exercise rack 20, a lower bracket 112 attached to a second portion of the exercise rack 20, and one or more guides 115*a*, 115*b* connected between the upper and lower brackets 111, 112 along which the weight 100 may slide up or down.

In some embodiments, a cable end connector 120 may be utilized to which the second end 92 of the cable 90 may be connected. The cable end connector 120 may comprise a bracket 121 adapted to be removably connected to various portions of the exercise rack 20, such as by a fastener, and a connector 122 to which the second end 92 of the cable 90 may be secured.

The versatility of the systems and methods shown and described herein allow for a wide range of exercises to be performed. By attaching pulley units 30*a*, 30*b*, 30*c*, 30*d* to various locations on the exercise rack 20, the cable 90 may be routed along various paths to optimize different exercise moves to be performed by the exerciser 12. Additionally, the pulley units 30*a*, 30*b*, 30*c*, 30*d* may be adjusted between various positions (i.e., orientations) to provide even more versatility with respect to routing of the cable 90. By adjusting the routing of the cable 90, exercises may be performed in which the exerciser 12 is seated or standing at various positions with respect to the exercise rack 20.

FIGS. 1A-10G illustrate various configurations of exercise racks 20 for use in performing a wide range of exemplary exercises. It should be appreciated that the exemplary embodiments shown in the figures are not meant to be exhaustive or limiting in scope, but are merely non-limiting exemplary embodiments for illustrative purposes.

Figure 1B:
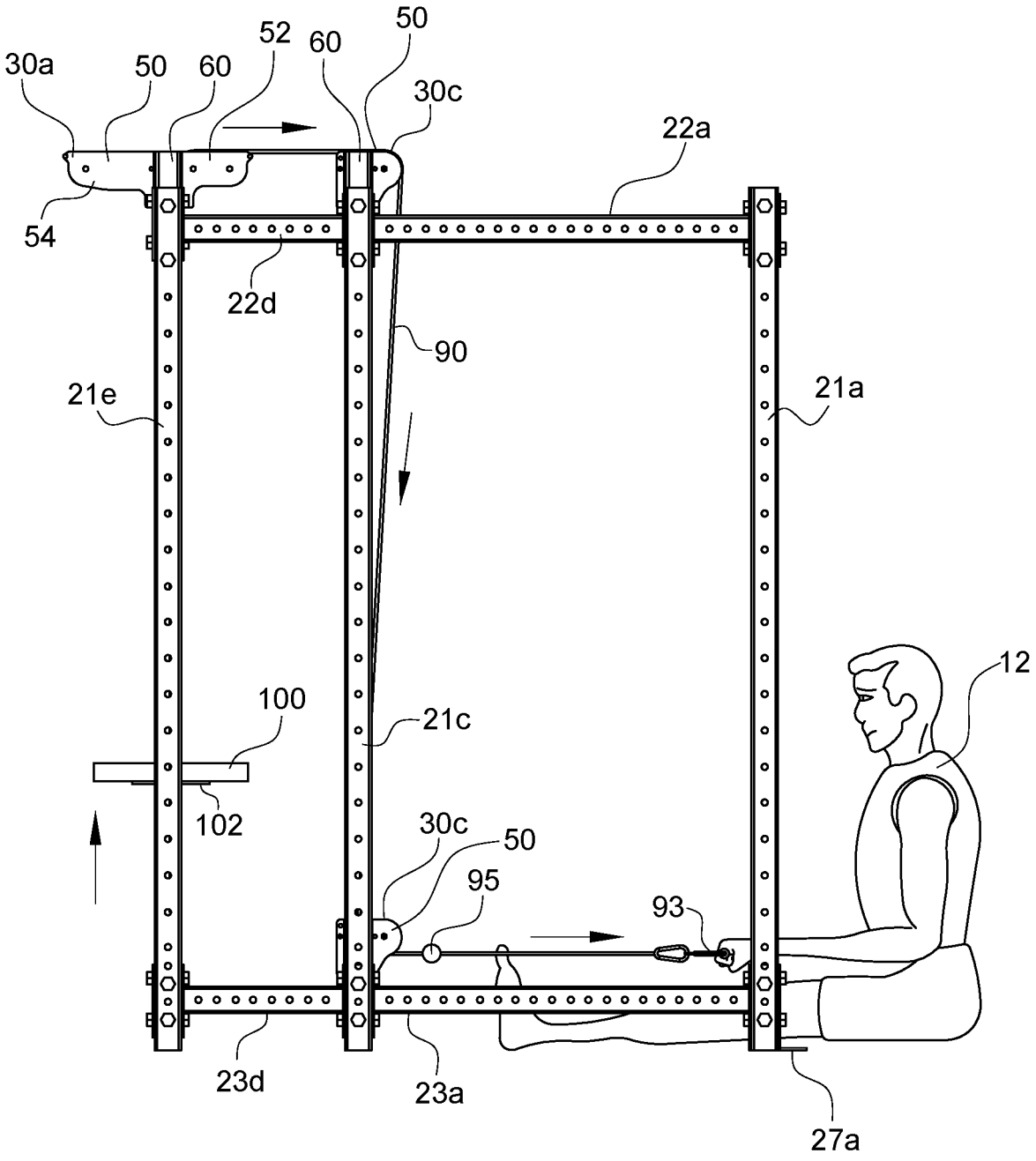
FIG. 1B is a side view of an exercise rack pulley system in use in accordance with an example embodiment.

FIGS. 1A and 1B illustrate an exercise rack 20 which is configured for performing an exercise in which an exerciser 12 may pull on a weight-restricted cable 90 while seated, kneeling, or standing on the ground surface. As shown in FIG. 1A, pulley units 30*a*, 30*c* are shown being connected to upper and lower arm members 22*c*, 22*f*, 23*c*. More specifically, it can be seen that a first pulley unit 30*c* is attached to the third lower arm member 23*c*, a second pulley unit 30*c* is attached to the third upper arm member 22*c*, and a third pulley unit 30*a* is attached to the sixth upper arm member 22*f*.

Continuing to reference FIGS. 1A and 1B, it can be seen that a cable 90 is routed underneath the pulley 70*a* of the first pulley unit 30*c* and up through the concentric openings 41, 61 of the first and second connectors 40, 60 of the first pulley unit 30*c*. The cable 90 then extends vertically to pass over the pulley 70*a* of the second pulley unit 30*c* before extending horizontally over the first and second pulleys 70*a*, 70*b* of the third pulley unit 30*a*. The cable 90 is then routed downwardly through the concentric openings 41, 61 of the first and second connectors 40, 60 of the third pulley unit 30*a* and through a slotted opening 25*b* of the sixth upper arm member 22*f* to be secured to a weight rod 103 supporting a weight 100. As shown in FIG. 1B, an exerciser 12 may grasp the handle 93 of the cable 90 while seated on the ground surface (or in other positions such as kneeling or standing) and pull outwardly to lift the weight 100 to perform an exercise.

Figure 2B:
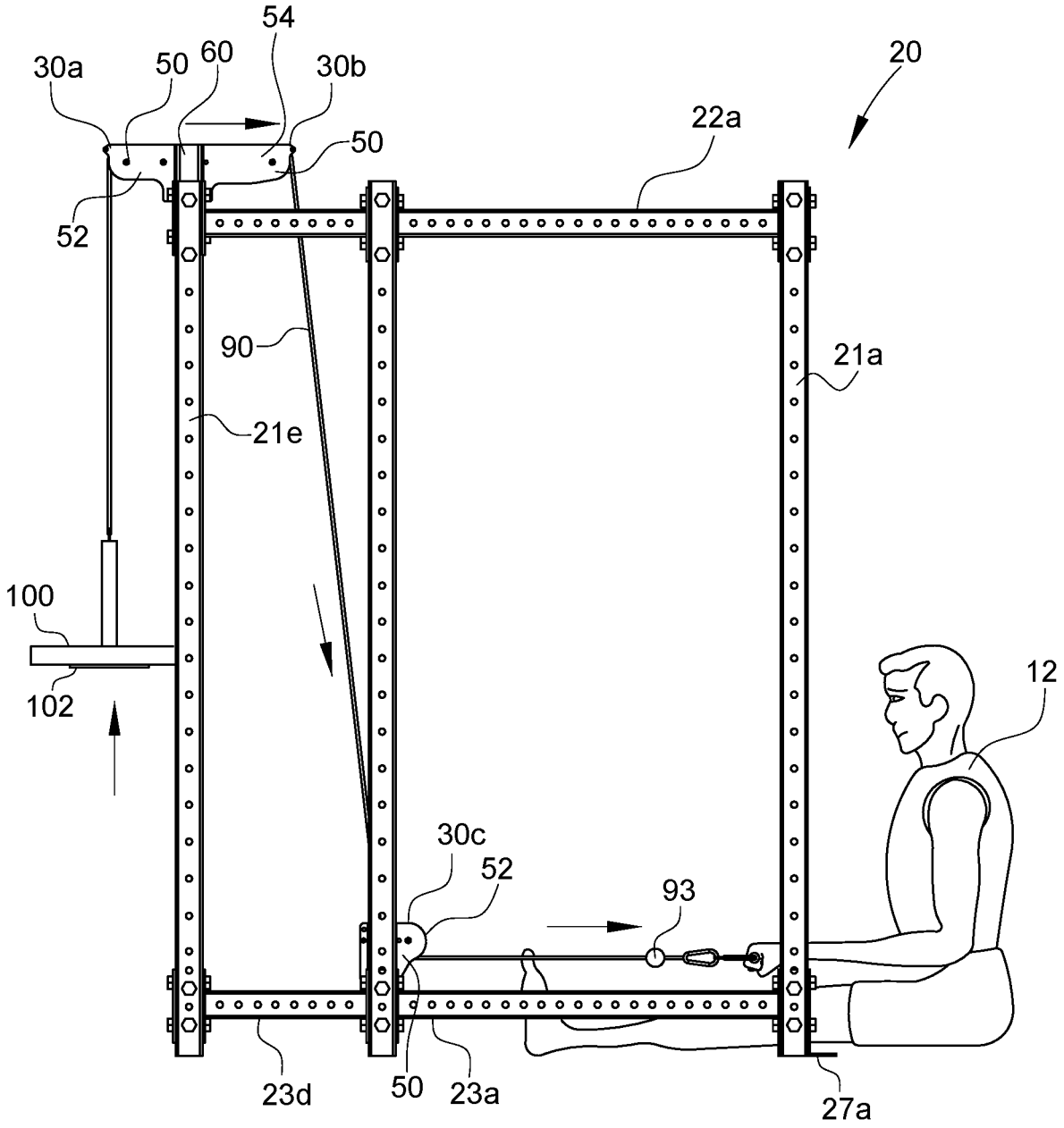
FIG. 2B is a side view of an exercise rack pulley system in use in accordance with an example embodiment.

FIGS. 2A and 2B illustrate an exercise rack 20 which has omitted the third upper arm member 22*c* and which utilizes only two pulley units 30*a*, 30*c*. An exerciser 12 may be seated on the ground surface to perform an exercise such as shown in FIG. 2B. As shown in FIG. 2A, a first pulley unit 30*c* is attached to the third lower arm member 23*c* and a second pulley unit 30*a* is attached to the sixth upper arm member 22*f*.

Continuing to reference FIGS. 2A and 2B, it can be seen that a cable 90 is routed underneath the pulley 70*a* of the first pulley unit 30*c* and up through the concentric openings 41, 61 of the first and second connectors 40, 60 of the first pulley unit 30*c*. The cable 90 then extends diagonally upward prior to extending over all of the pulleys 70*a*, 70*b*, 70*c*, 70*d* of the second pulley unit 30*a*, prior to extending downwardly to be connected to a weight rod 103 supporting a weight 100. As shown in FIG. 2B, an exerciser 12 may grasp the handle 93 of the cable 90 while seated on the ground surface (or in other positions such as kneeling or standing) within the outer frame of the exercise rack 20 and pull outwardly to lift the weight 100 to perform an exercise.

Figure 3B:
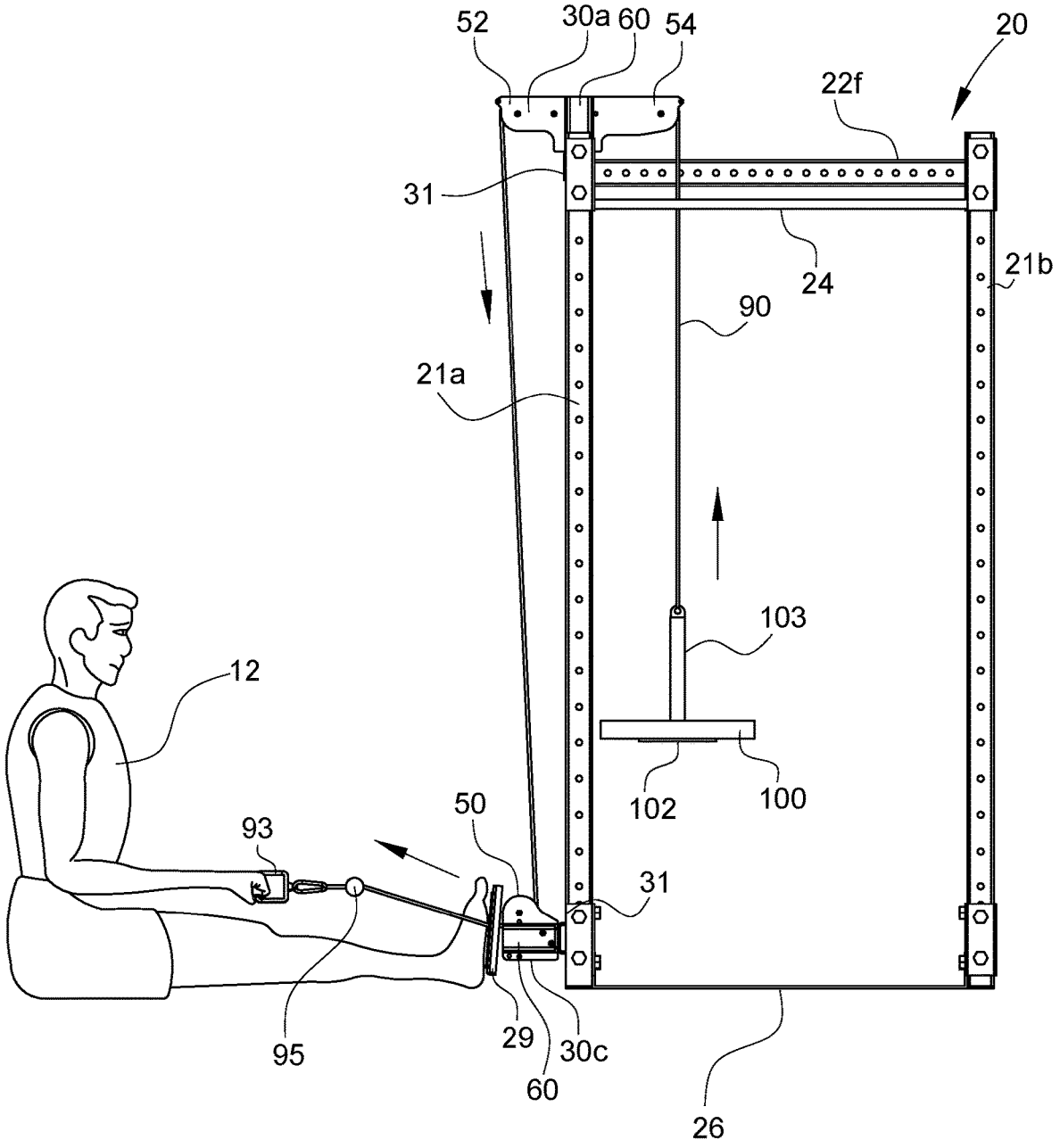
FIG. 3B is a side view of an exercise rack pulley system in use in accordance with an example embodiment.

FIGS. 3A and 3B illustrate an exercise rack 20 configured for an exerciser 12 to perform weightlifting exercises while seated outside the perimeter of the frame of the exercise rack 20. As shown in FIG. 3A, a first pulley unit 30*c* is attached to the first lower arm member 23*a* and a second pulley unit 30*a* is attached to the first upper arm member 22*a*. A foot rest 29 is attached around the first pulley unit 30*c*.

With reference to FIGS. 3A and 3B, it can be seen that a cable 90 is routed through a footrest and underneath a pulley 70*a* of the first pulley unit 30*c* prior to extending vertically upwardly. The cable 90 then extends over the pulleys 70*a*, 70*b*, 70*c*, 70*d* of the second pulley unit 30*a* and then downwardly to be connected to a weight rod 103 supporting a weight 100. As shown in FIG. 3B, an exerciser 12 may grasp the handle 93 of the cable 90 while seated on the ground surface outside of the frame of the exercise rack 20 with his feet on the foot rest 29 and pull outwardly to lift the weight 100 to perform an exercise.

Figure 4B:
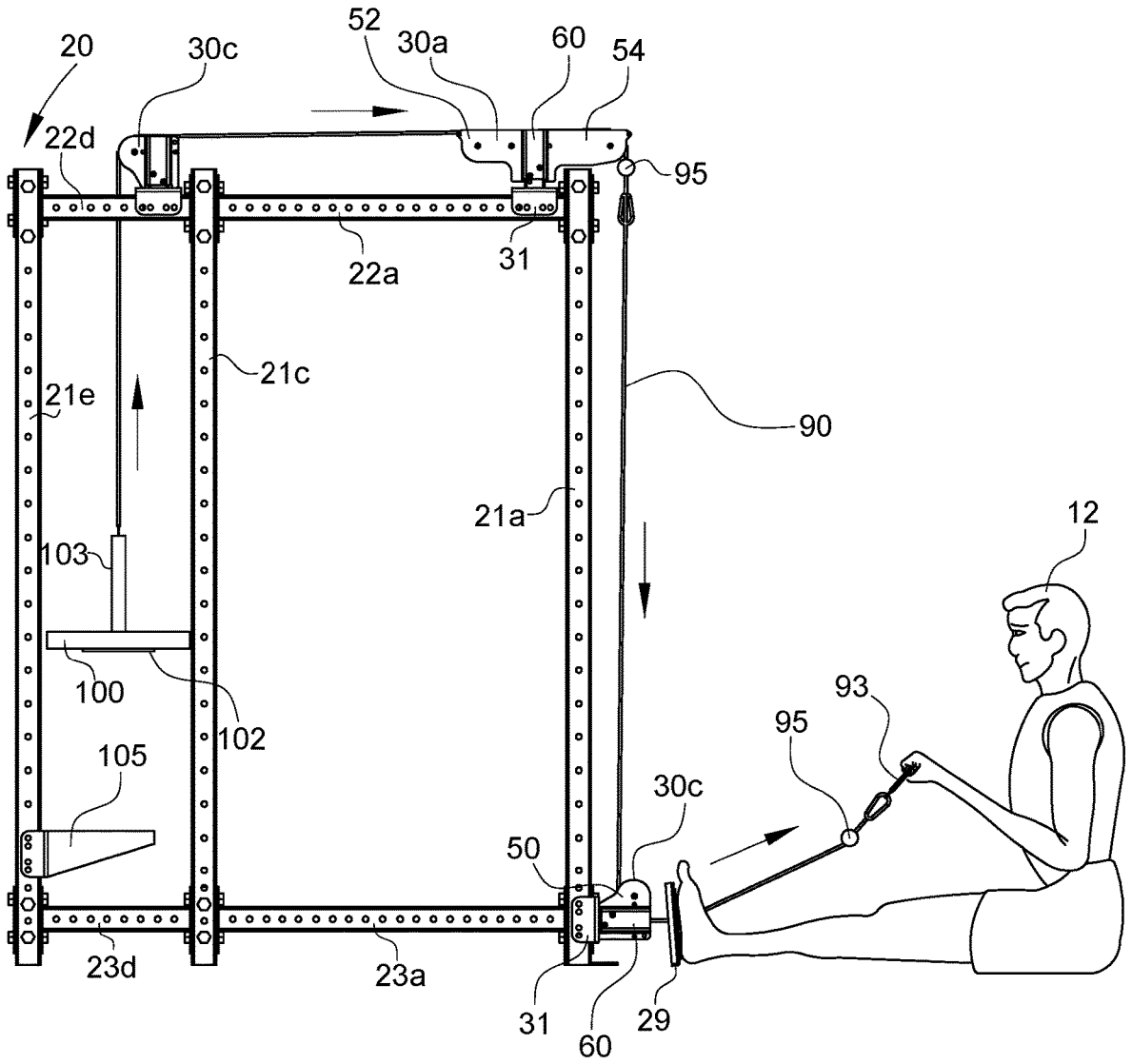
FIG. 4B is a side view of an exercise rack pulley system in use in accordance with an example embodiment.

FIGS. 4A and 4B illustrate an exercise rack 20 configured for an exerciser 12 to perform weightlifting exercises while seated adjacent to the first support member 21*a*. As shown in FIG. 4A, a first pulley unit 30*c* is attached to the first support member 21*a*, a second pulley unit 30*a* is attached to the first upper arm member 22*a* adjacent to the first support member 21*a*, and a third pulley unit 30*c* is attached to the fourth upper arm member 22*d* adjacent to the third support member 21*c*. A foot rest 29 is attached around the first pulley unit 30*c*. A weight bracket 105 is attached to the fifth support member 21*e* to support one or more weights 100.

Continuing to reference FIGS. 4A and 4B, it can be seen that a cable 90 extends through the foot rest 29 and underneath the pulley 70*a* of the first pulley unit 30*c*. The cable 90 then extends horizontally across the pulleys 70*a*, 70*b*, 70*c*, 70*d* of the second pulley unit 30*a* and across to pass over the pulley 70*a* of the third pulley unit 30*c*. The cable 90 then extends downwardly to be connected to a weight rod 103 supporting a weight 100, with the weight 100 resting upon a weight bracket 105. As shown in FIG. 4B, an exerciser 12 may grasp the handle 93 of the cable 90 while seated on the ground surface outside of the frame of the exercise rack 20 with his feet on the foot rest 29 and pull outwardly to lift the weight 100 to perform an exercise.

Figure 5A:
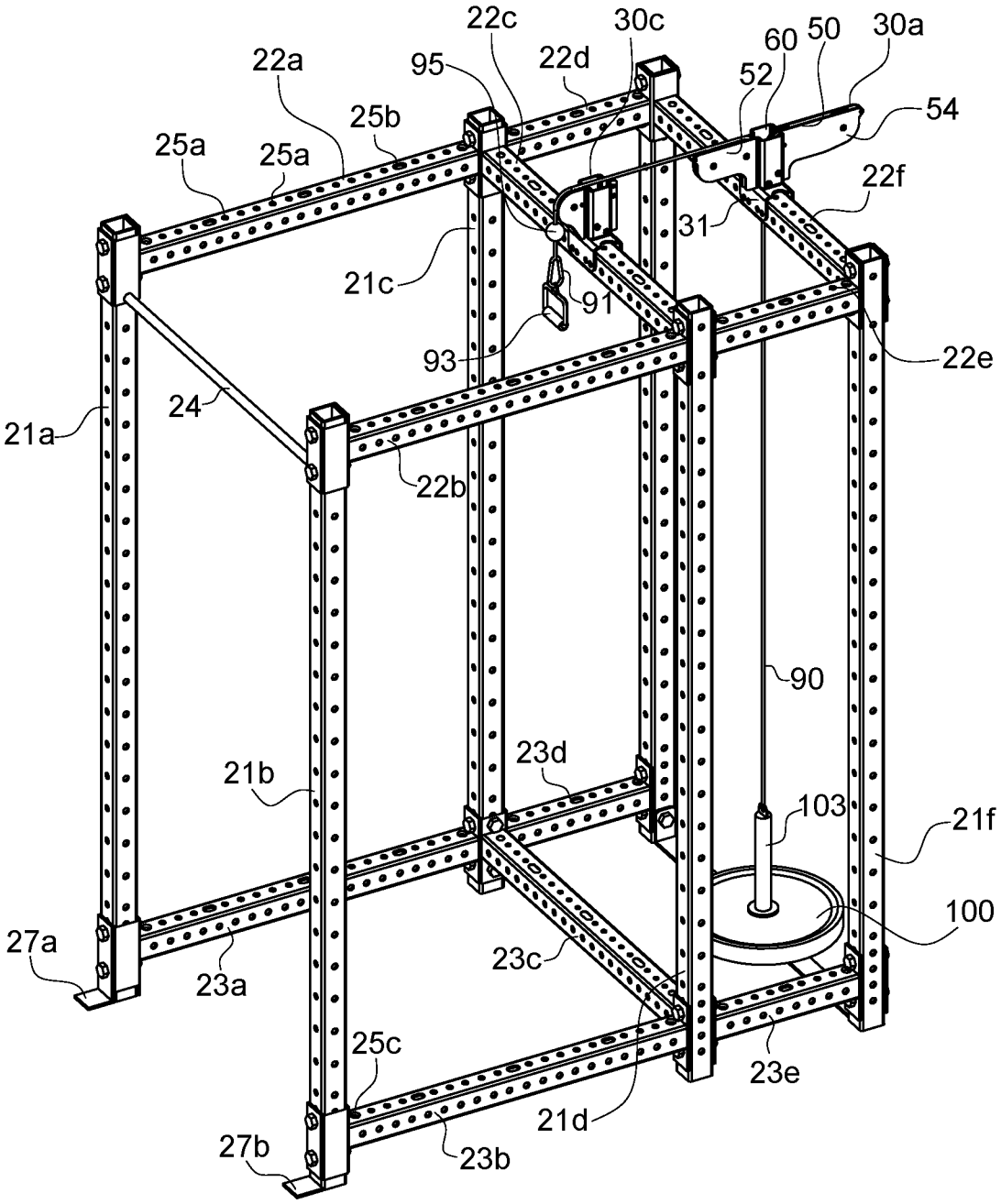
FIG. 5A is a perspective view of an exercise rack pulley system in accordance with an example embodiment.
Figure 5B:
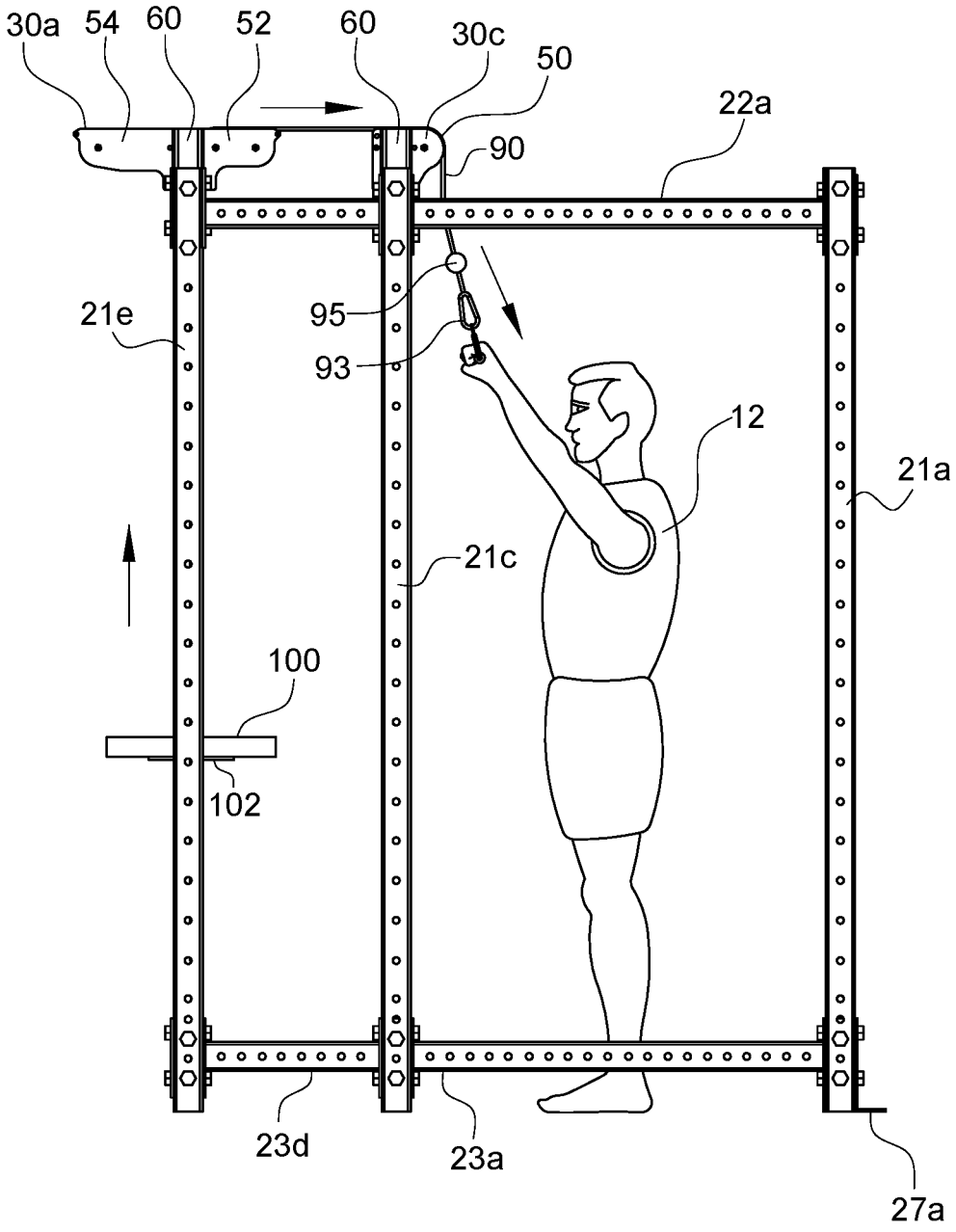
FIG. 5B is a side view of an exercise rack pulley system in use in accordance with an example embodiment.

FIGS. 5A and 5B illustrate an exercise rack 20 configured for an exerciser 12 to perform weightlifting exercises while standing within the frame of the exercise rack 20. As shown in FIG. 5A, a first pulley unit 30*a* is attached to the sixth upper arm member 22*f* and a second pulley unit 30*c* is attached to the third upper arm member 22*c*.

Continuing to reference FIGS. 5A and 5B, it can be seen that a cable 90 is first routed over the pulley 70*a* of the first pulley unit 30*c*, with the handle 93 dangling at an elevated position. The cable 90 is routed horizontally to pass over a pair of pulleys 70*a*, 70*b* of the second pulley unit 30*a* prior to extending downwardly through the concentric openings 41, 61 of the first and second connectors 40, 60 of the second pulley unit 30*a*, as well as a slotted opening 25*b* of the sixth upper arm member 22*f* to be connected to a weight rod 103 supporting a weight 100. As shown in FIG. 5B, an exerciser 12 may grasp the handle 93 of the cable 90 while standing within the exercise rack 20 and pull downwardly to lift the weight 100 to perform an exercise.

Figure 6A:
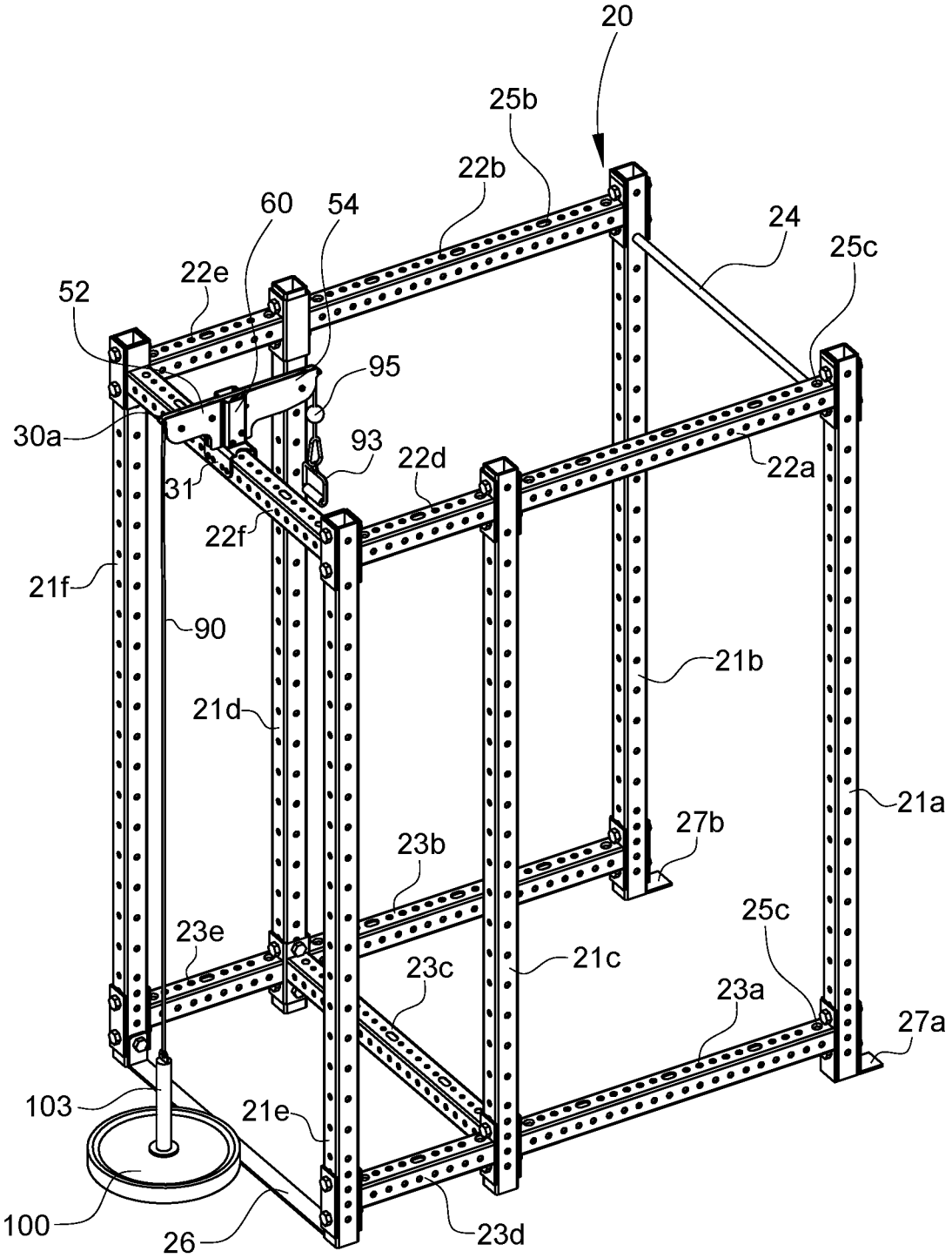
FIG. 6A is a perspective view of an exercise rack pulley system in accordance with an example embodiment.
Figure 6B:
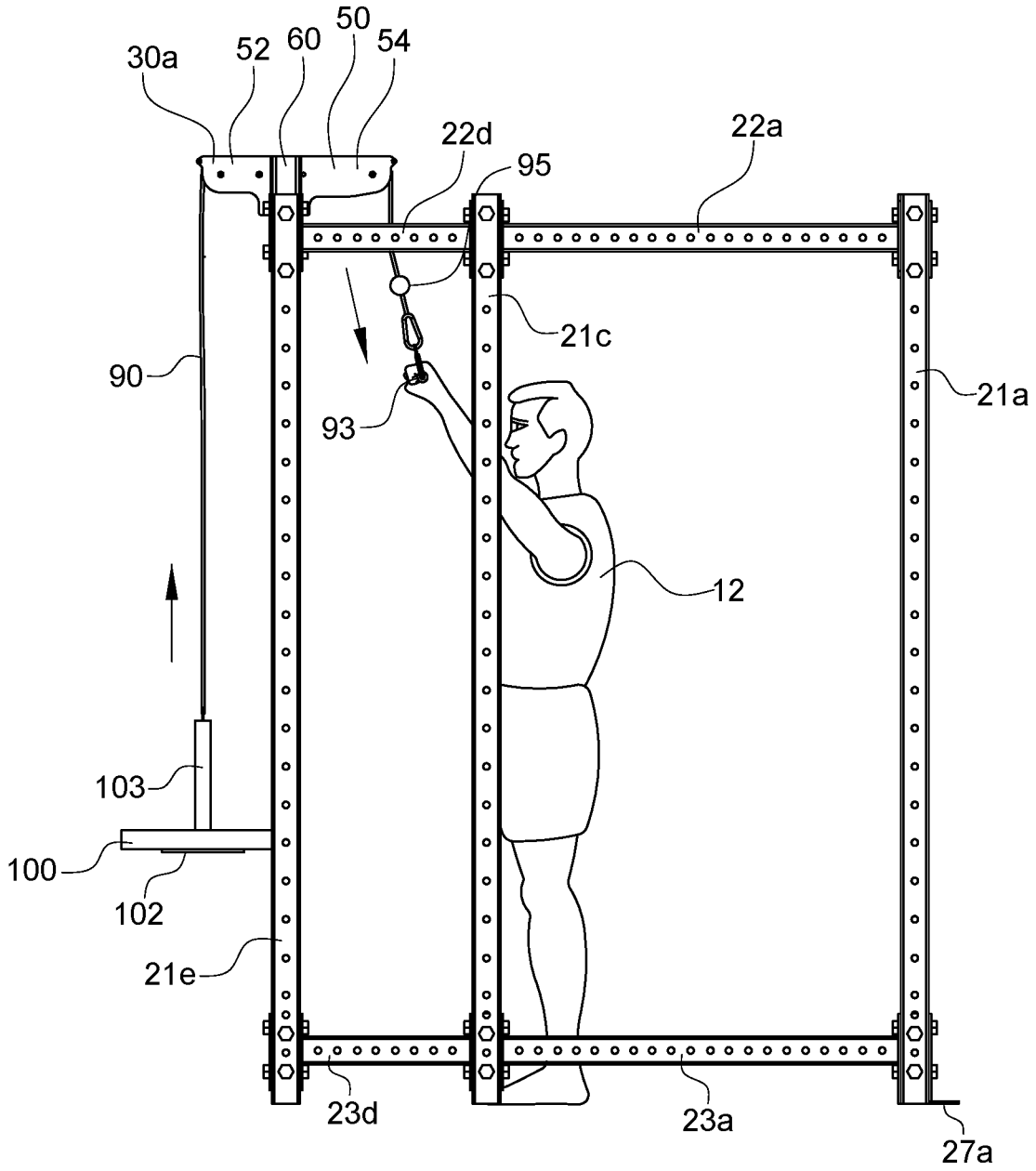
FIG. 6B is a side view of an exercise rack pulley system in use in accordance with an example embodiment.

FIGS. 6A and 6B illustrate an exercise rack 20 configured for an exerciser 12 to perform weightlifting exercises while standing within the frame of the exercise rack 20. As shown in FIG. 6A, a single pulley unit 30*a* is attached to the sixth upper arm member 22*f*. A cable 90 is routed over the pulleys 70*a*, 70*b*, 70*c*, 70*d* of the pulley unit 30*a* and connected to a weight rod 103 supporting a weight 100 which is positioned to rest upon the ground surface adjacent to the floor support 26, with the handle dangling 93 at an elevated position. As shown in FIG. 6B, an exerciser 12 may grasp the handle 93 of the cable 90 while standing within the exercise rack 20 and pull downwardly to lift the weight 100 to perform an exercise.

Figure 7A:
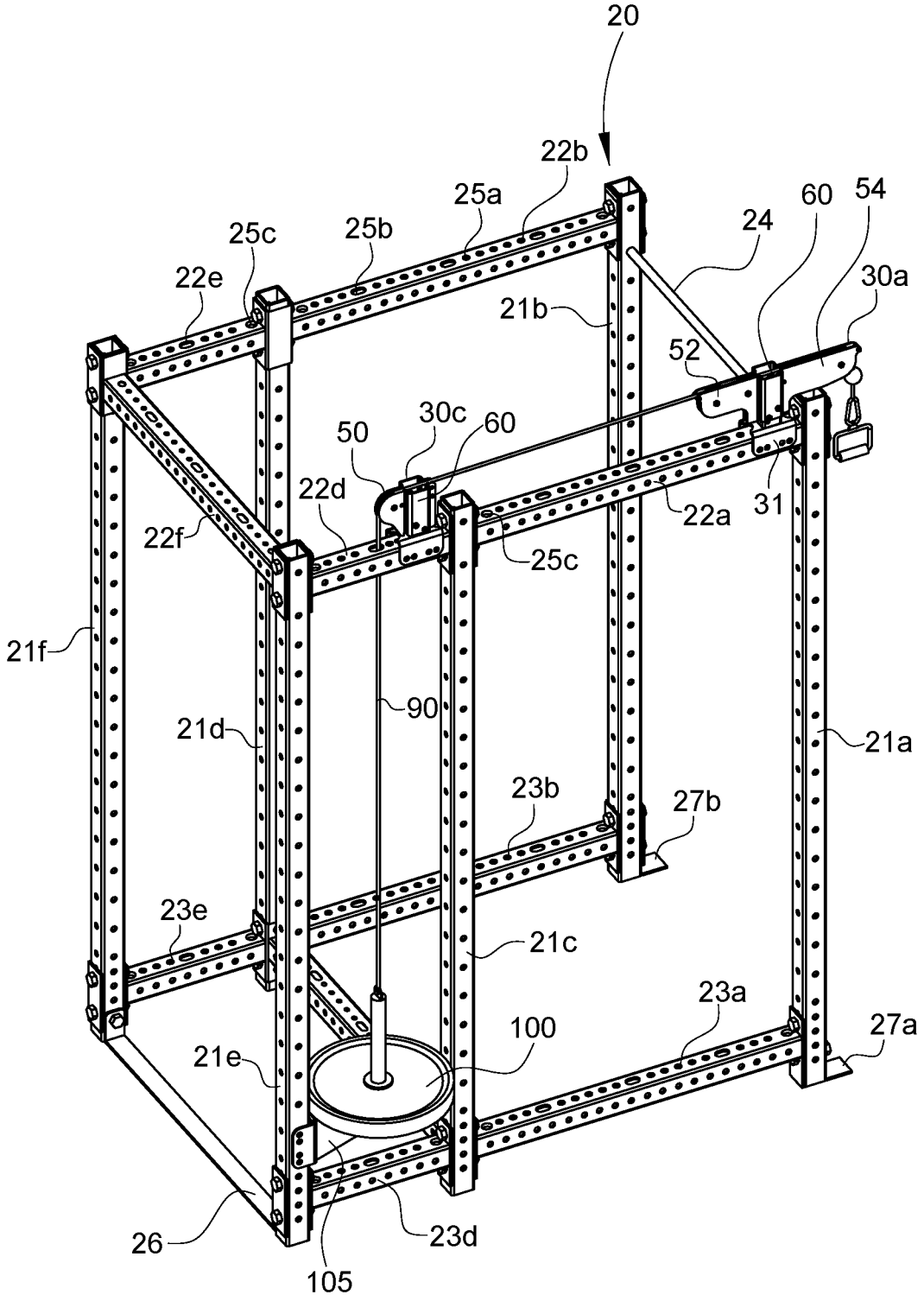
FIG. 7A is a perspective view of an exercise rack pulley system in accordance with an example embodiment.
Figure 7B:
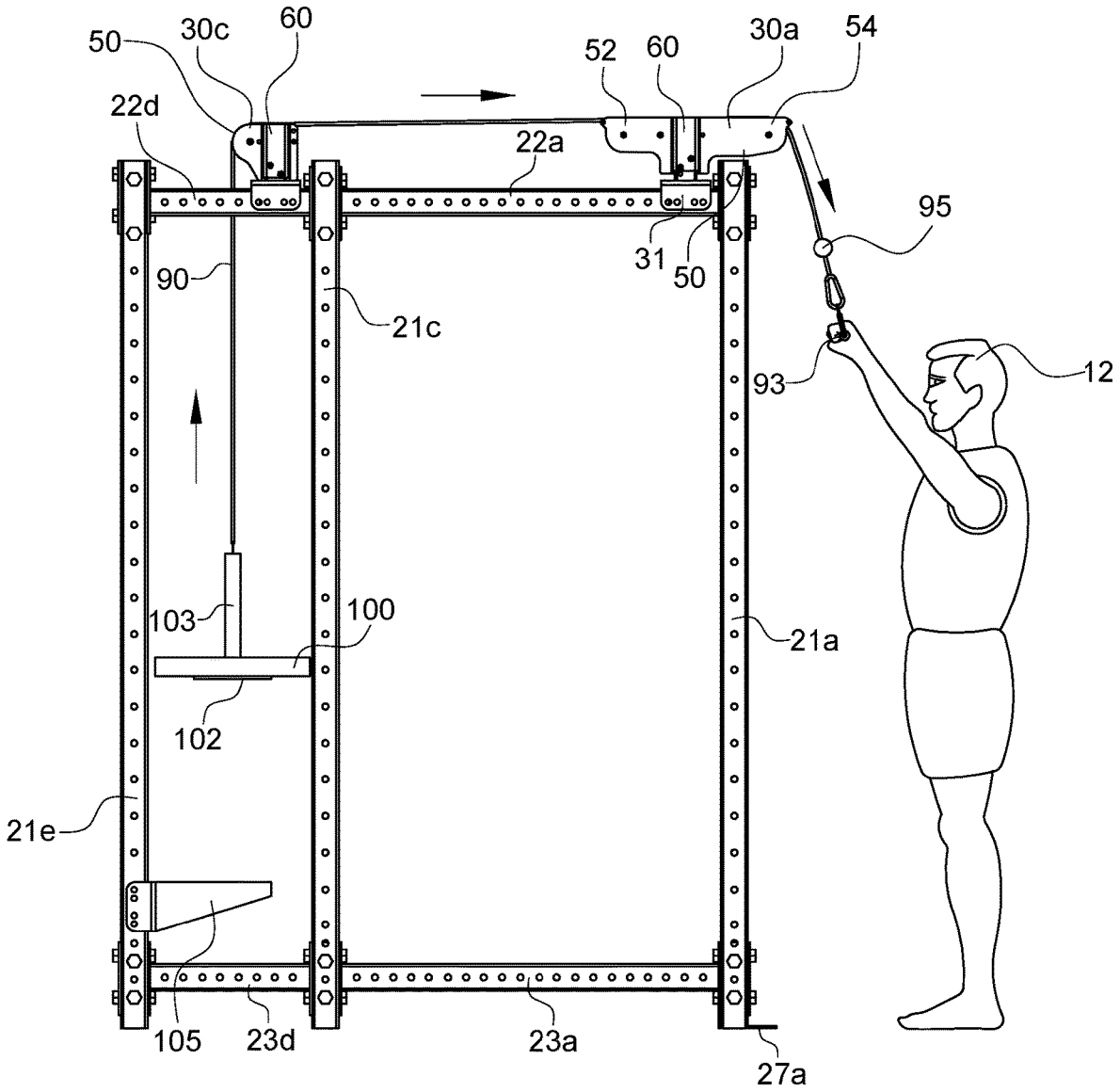
FIG. 7B is a side view of an exercise rack pulley system in use in accordance with an example embodiment.

FIGS. 7A and 7B illustrate an exercise rack 20 configured for an exerciser 12 to perform weightlifting exercises while standing outside the exercise rack 20, adjacent to the first support member 21*a*. As shown in FIG. 7A, a first pulley unit 30*a* is attached to the first upper arm member 22*a* and a second pulley unit 30*c* is attached to the fourth upper arm member 22*d*. A weight bracket 105 is attached to the fifth support member 21*e*, with a weight 100 resting on the weight bracket 105.

Continuing to reference FIGS. 7A and 7B, it can be seen that a cable 90 is routed over and across the pulleys 70*a*, 70*b*, 70*c*, 70*d* of the first pulley unit 30*a*, with the handle 93 dangling at an elevated position. The cable 90 extends horizontally over the pulley 70*a* of the second pulley unit 30*c* prior to extending downwardly to connect to a weight rod 103 supporting a weight 100 which is positioned on the weight bracket 105. As shown in FIG. 7B, an exerciser 12 may grasp the handle 93 of the cable 90 while standing outside of the frame of the exercise rack 20 adjacent to the first support member 21*a* and pull downwardly to lift the weight 100 to perform an exercise.

Figure 8A:
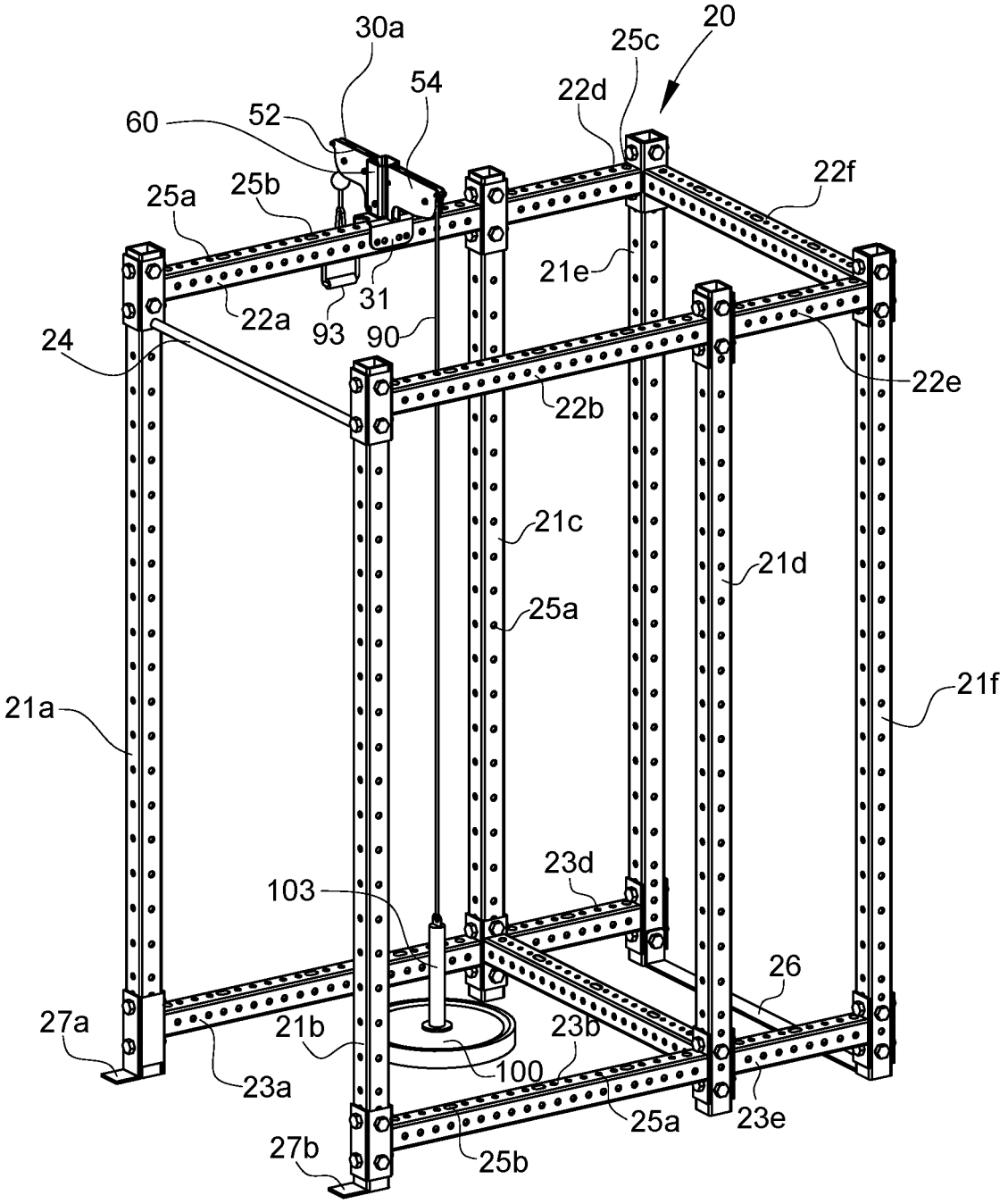
FIG. 8A is a perspective view of an exercise rack pulley system in accordance with an example embodiment.
Figure 8B:
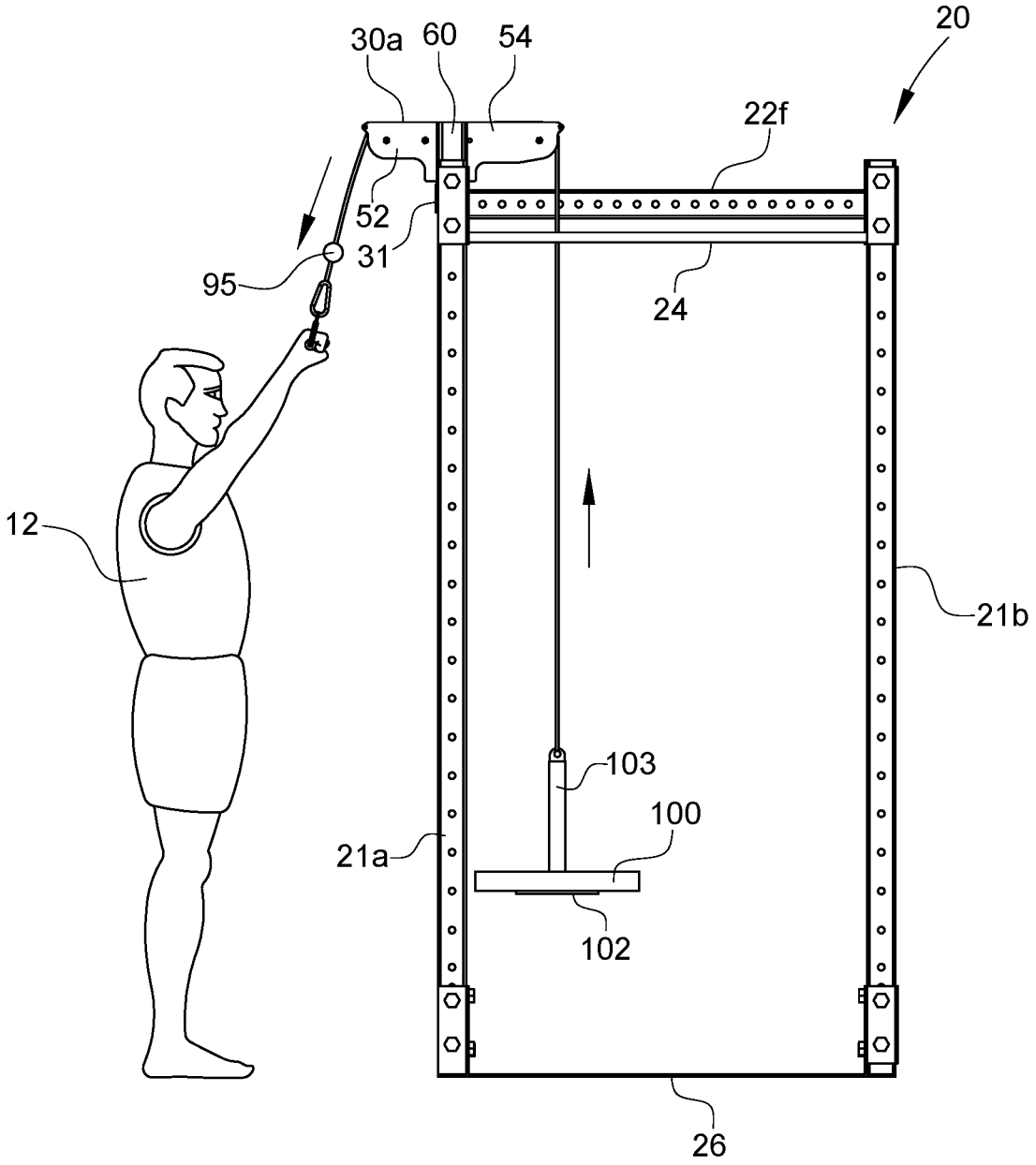
FIG. 8B is a side view of an exercise rack pulley system in use in accordance with an example embodiment.

FIGS. 8A and 8B illustrate an exercise rack 20 configured for an exerciser 12 to perform weightlifting exercises while standing outside of the frame of the exercise rack 20. As shown in FIG. 8A, a single pulley unit 30*a* is attached to the first upper arm member 22*a* adjacent to the third support member 21*c*. The pulley unit 30*a* is positioned perpendicular to the first upper arm member 22*a*.

Continuing to reference FIGS. 8A and 8B, it can be seen that a cable 90 is routed over and across the pulleys 70*a*, 70*b*, 70*c*, 70*d* of the pulley unit 30*a*, with the handle 93 dangling at an elevated position. The cable 90 then extends downwardly to be connected to a weight rod 103 supporting a weight 100 which is positioned on a ground surface within the frame of the exercise rack 20. As shown in FIG. 8B, an exerciser 12 may grasp the handle 93 of the cable 90 while standing outside the exercise rack 20 and pull downwardly to lift the weight 100 to perform an exercise.

Figure 9:
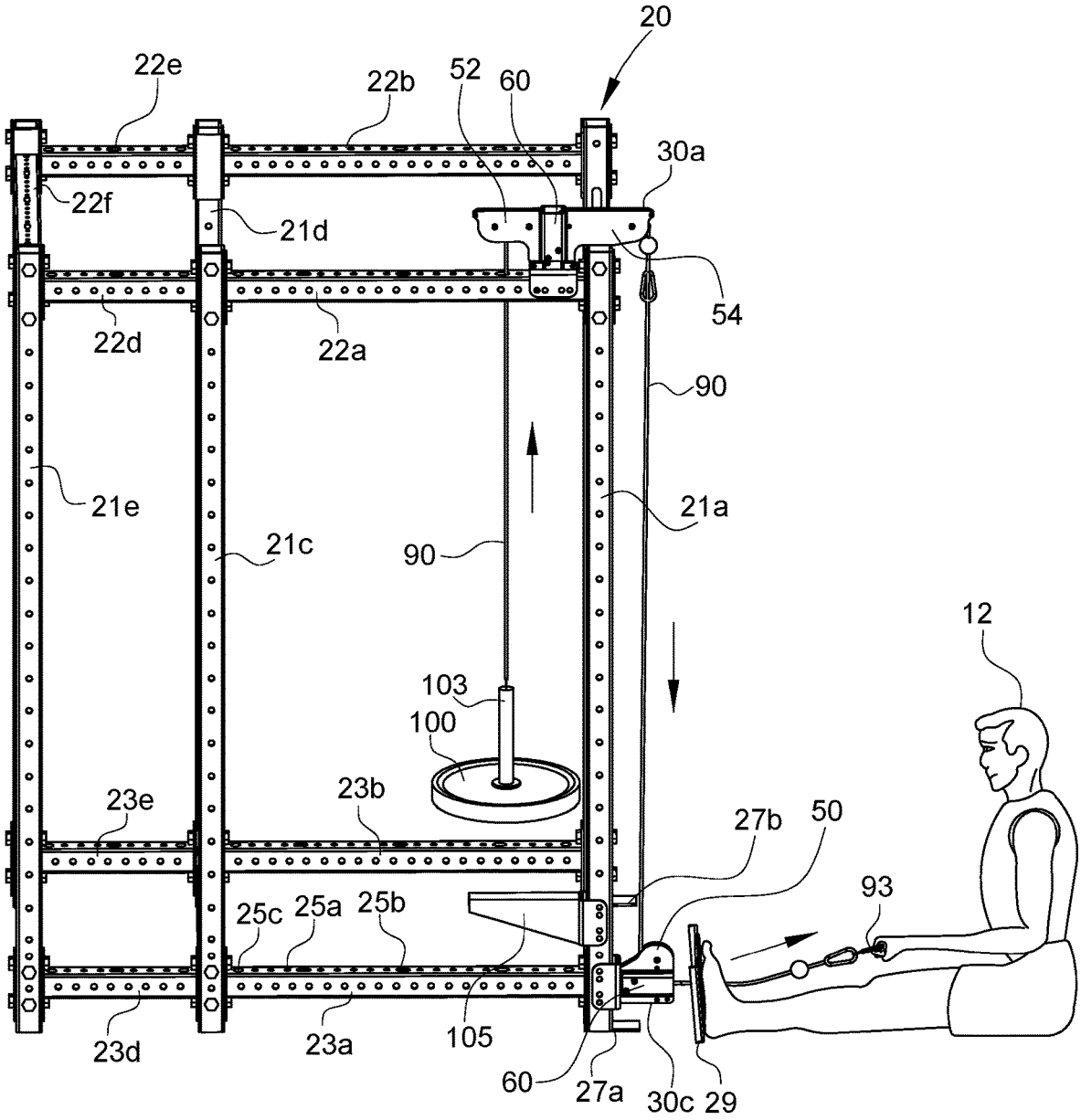
FIG. 9 is a side perspective view of an exercise rack pulley system in use in accordance with an example embodiment.

FIG. 9 illustrates an exercise rack 20 configured for an exerciser 12 to perform weightlifting exercises while seated outside of the frame of the exercise rack 20. As shown in FIG. 9, a first pulley unit 30*c* is attached to the outside of the first support member 21*a*. A second pulley unit 30*a* is attached to the first upper arm member 22*a* in a position which is parallel to the first upper arm member 22*a*. A weight bracket 105 is attached to the first support member 21*a* and a foot rest 29 is attached around the first pulley unit 30*c*.

Continuing to reference FIG. 9, it can be seen that a cable 90 is routed through the foot rest 29 and underneath the pulley 70*a* of the first pulley unit 30*c* prior to extending vertically upward. The cable 90 then extends horizontally over and across three of the pulleys 70*b*, 70*c*, 70*d* of the second pulley unit 30*a* prior to extending downwardly between the first and second pulleys 70*a*, 70*b* of the second pulley unit 30*a*. The cable 90 then extends downwardly through a slotted opening 25*b* of the first upper arm member 22*a* to be connected to a weight rod 103 supporting a weight 100 which may be positioned on the weight bracket 105. An exerciser 12 is shown seated on the ground surface outside of the exercise rack 20, with his feet on the foot rest 29 while he pulls outwardly to lift the weight 100 to perform an exercise.

Figure 10A:
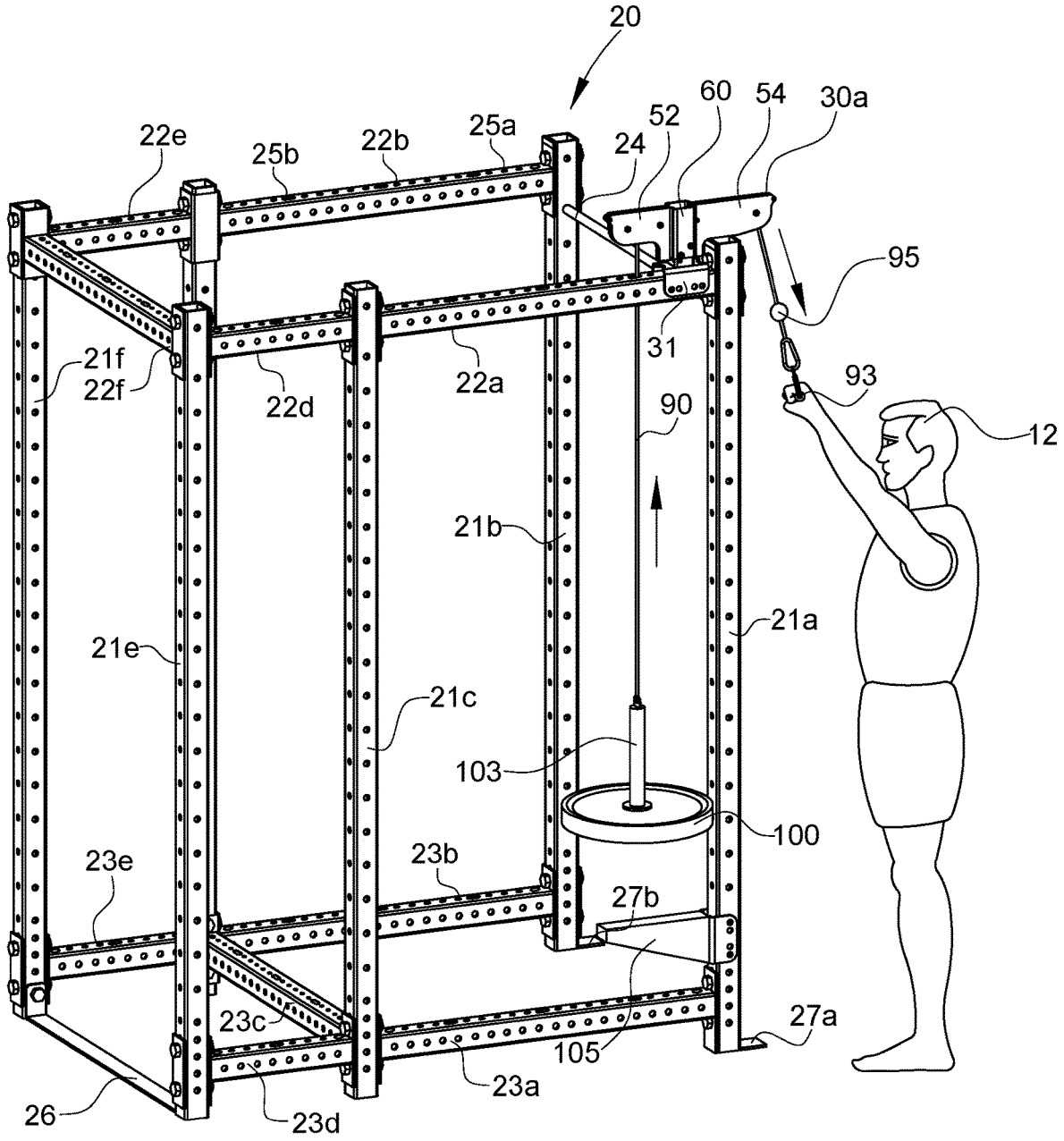
FIG. 10A is a side perspective view of an exercise rack pulley system in use in accordance with an example embodiment.
Figure 10B:
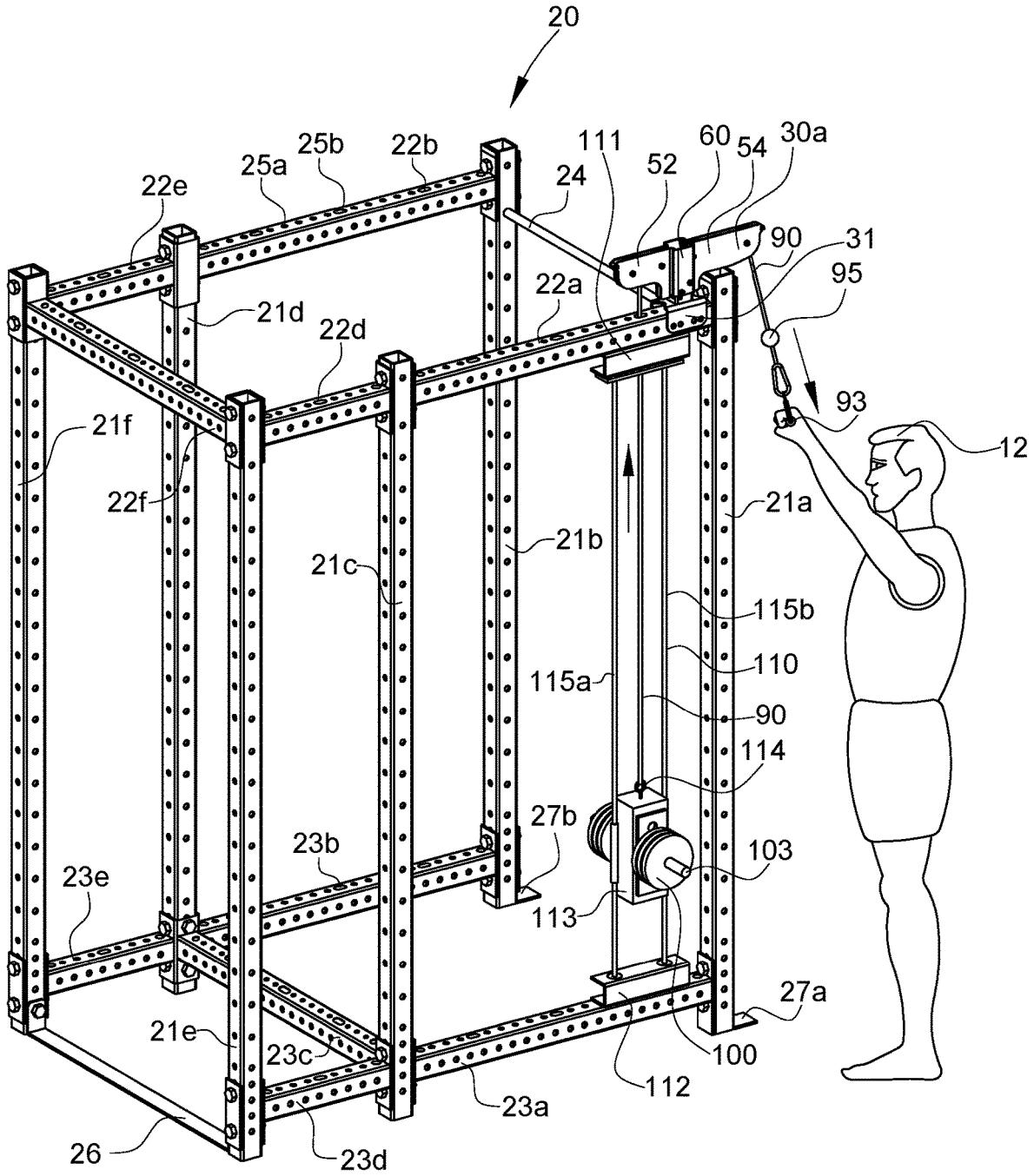
FIG. 10B is a side perspective view of an exercise rack pulley system in use in accordance with an example embodiment.
Figure 10C:
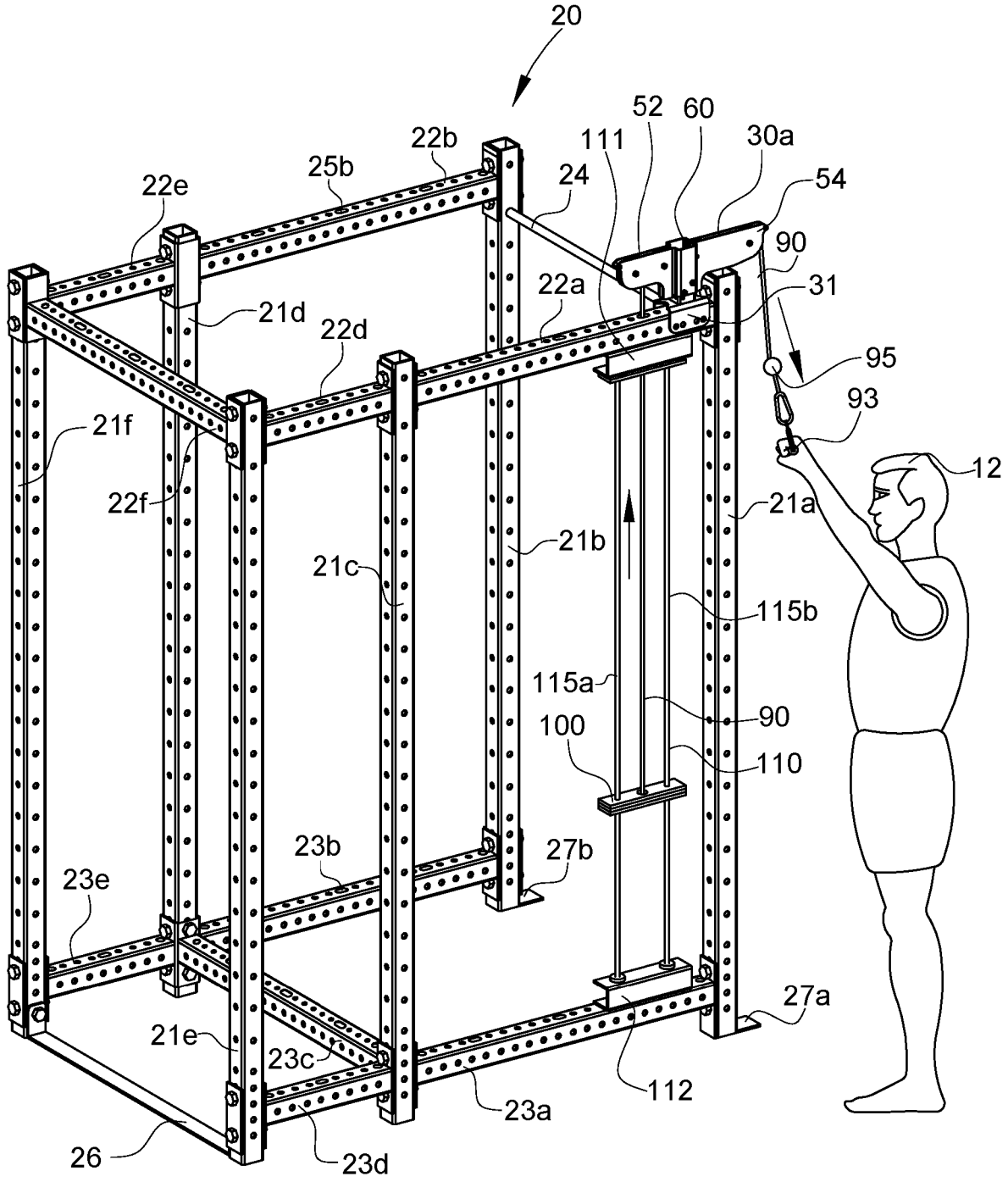
FIG. 10C is a side perspective view of an exercise rack pulley system in use in accordance with an example embodiment.

FIG. 10A illustrates an exercise rack 20 configured for an exerciser 12 to perform weightlifting exercises while standing outside of the frame of the exercise rack 20. As shown in FIG. 10A, a single pulley unit 30*a* is attached to the first upper arm member 22*a* adjacent to the first support member 21*a*. A weight bracket 105 is attached to the first support member 21*a*. A cable 90 extends over and across three of the pulleys 70*b*, 70*c*, 70*d* of the pulley unit 30*a*, with the handle 93 dangling at an elevated position. The cable 90 then extends downwardly between the first two pulleys 70*a*, 70*b* and through a slotted opening 25*b* of the first upper arm member 22*a* to connect to a weight rod 103 supporting a weight 100 which may be positioned on the weight bracket 105. An exerciser 12 is shown standing outside of the exercise rack 20 and pulling downwardly to lift the weight 100 and perform an exercise.

FIG. 10B illustrates an exercise rack 20 which utilizes a weightlifting unit 110 (e.g., a weight stack) that is connected between the first upper arm member 22*a* and the first lower arm member 23*a*. The weightlifting unit 110 comprises an upper bracket 111 which is attached to the first upper arm member 22*a* and a lower bracket 112 which is attached to the first lower arm member 23*a*. A pair of guides 115*a*, 115*b*, comprised of a first guide 115*a* and a second guide 115*b*, is connected between the upper and lower brackets 111, 112 in parallel. Each of the guides 115*a*, 115*b* may comprise elongated members such as rods or the like. A weight mount 113 is connected between the guides 115*a*, 115*b* such that the weight mount 113 may traverse upwardly and downwardly along the guides 115*a*, 115*b*. A weight rod 103 extends horizontally through the weight mount 113, with weights 100 positioned on the weight rod 103. A connector 114 comprised of a loop or bracket is connected to an upper end of the weight mount 113 to receive the cable 90.

Continuing to reference FIG. 10B, it can be seen that a pulley unit 30*a* is attached to the first upper arm member 22*a* adjacent to the first support member 21*a*, above the weightlifting unit 110. A cable 90 is routed over and across three of the pulleys 70*b*, 70*c*, 70*d* of the pulley unit 30*a* and downwardly between the first two pulleys 70*a*, 70*b* to extend through a slotted opening 25*b* of the first upper arm member 22*a*. The cable 90 then extends through the upper bracket 111 of the weightlifting unit 110 to extend downwardly between the guides 115*a*, 115*b* and connect to the connector 114 of the weight mount 113. An exerciser 12 may stand outside of the exercise rack 20 and pull downwardly on the handle 93 of the cable 90 to lift the weight mount 113 (and attached weights 100) and perform an exercise. FIG. 10C illustrates a similar configuration as FIG. 10B, except that the weightlifting unit 110 includes an integrated weight 100 which is positioned to run along the pair of guides 115*a*, 115*b*.

FIGS. 10D-10G illustrate an exercise configuration which utilizes a cable end connector 120 to which a second end 92 of the cable 90 may be anchored to perform a wide range of exercises. As shown in FIGS. 10D-10G, the cable end connector 120 may be attached to the fourth support member 21*d*. A pair of pulley units 30*a*, 30*c* may be attached to the second upper arm member 22*b*, and an additional pulley unit 30*c* may be attached to the second support member 21*b*.

Figure 10D:
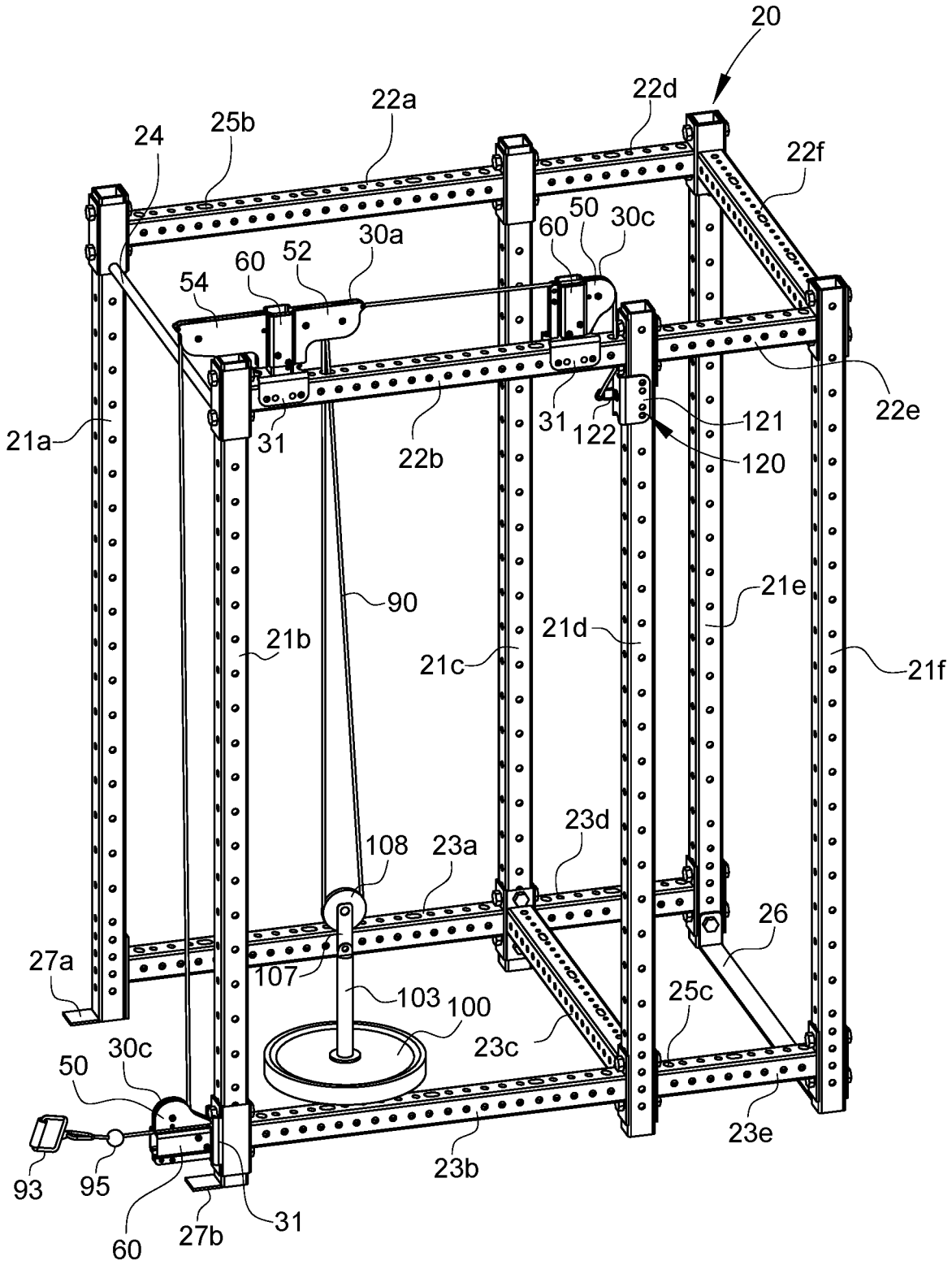
FIG. 10D is a perspective view of an exercise rack pulley system in accordance with an example embodiment.
Figure 10E:
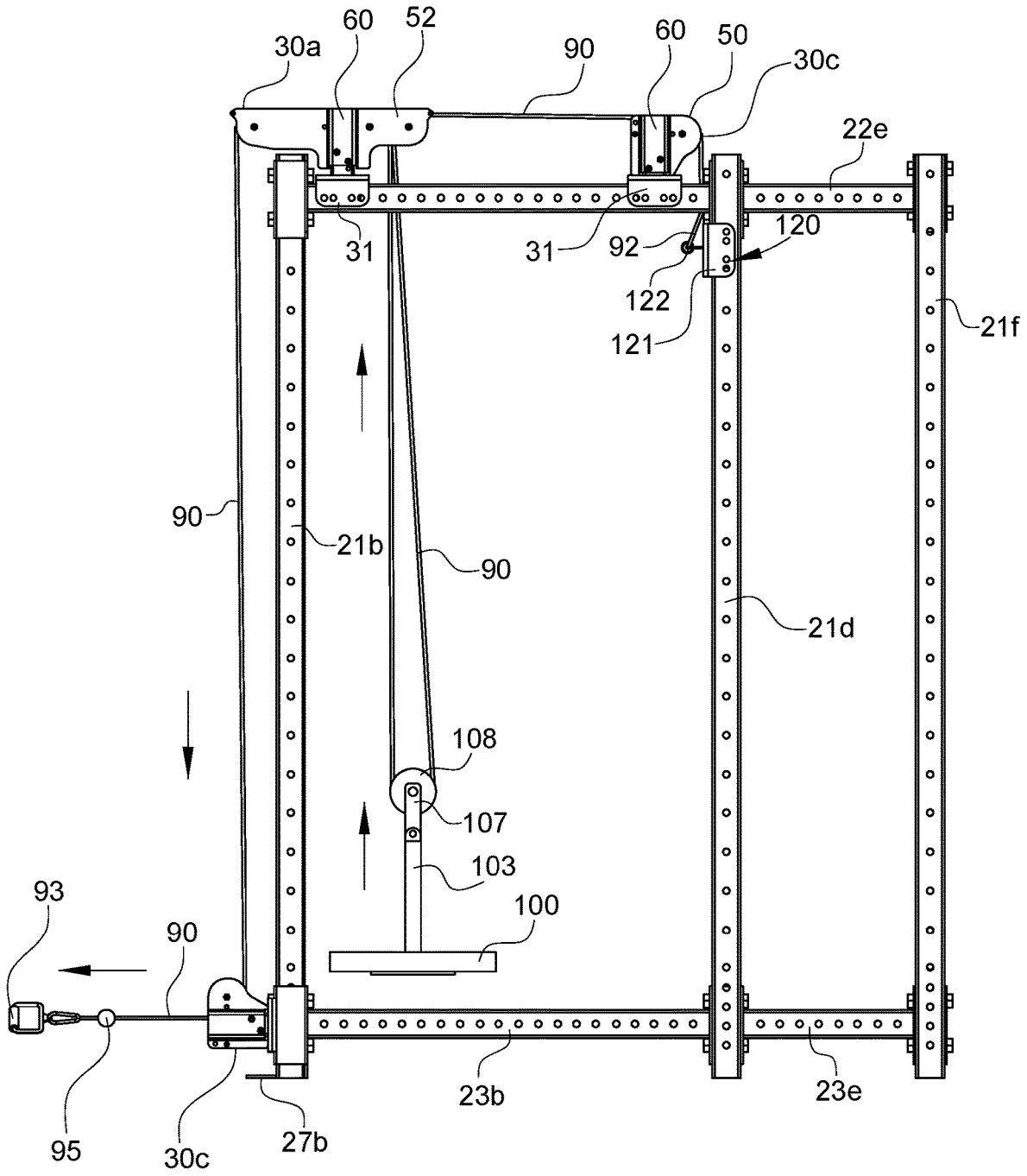
FIG. 10E is a side view of an exercise rack pulley system in accordance with an example embodiment.

Continuing to reference FIGS. 10D-10G, a cable 90 may be routed through the pulley units 30*a*, 30*c* and connected at its second end 92 to the cable end connector 120. FIGS. 10D and 10E illustrate a first embodiment in which a weight 100 is secured to a weight rod 103, with the weight rod 103 on which the weight(s) 100 are positioned including a weight pulley bracket 107 and a weight pulley 108. The weight pulley bracket 107 may be attached to the weight rod 103, and the weight pulley 108 may be rotatably connected to the weight pulley bracket 107.

Figure 10F:
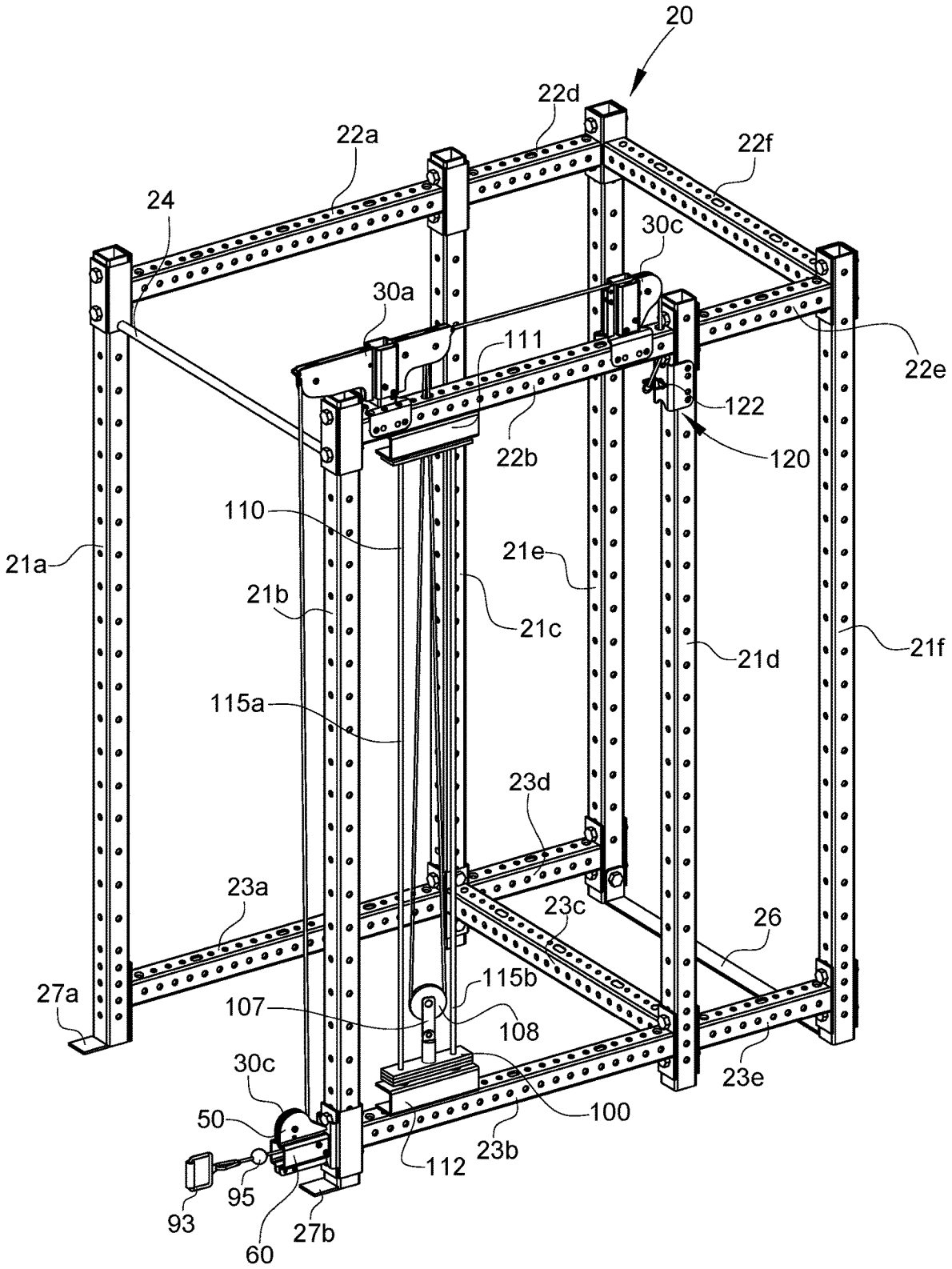
FIG. 10F is a perspective view of an exercise rack pulley system in accordance with an example embodiment.
Figure 10G:
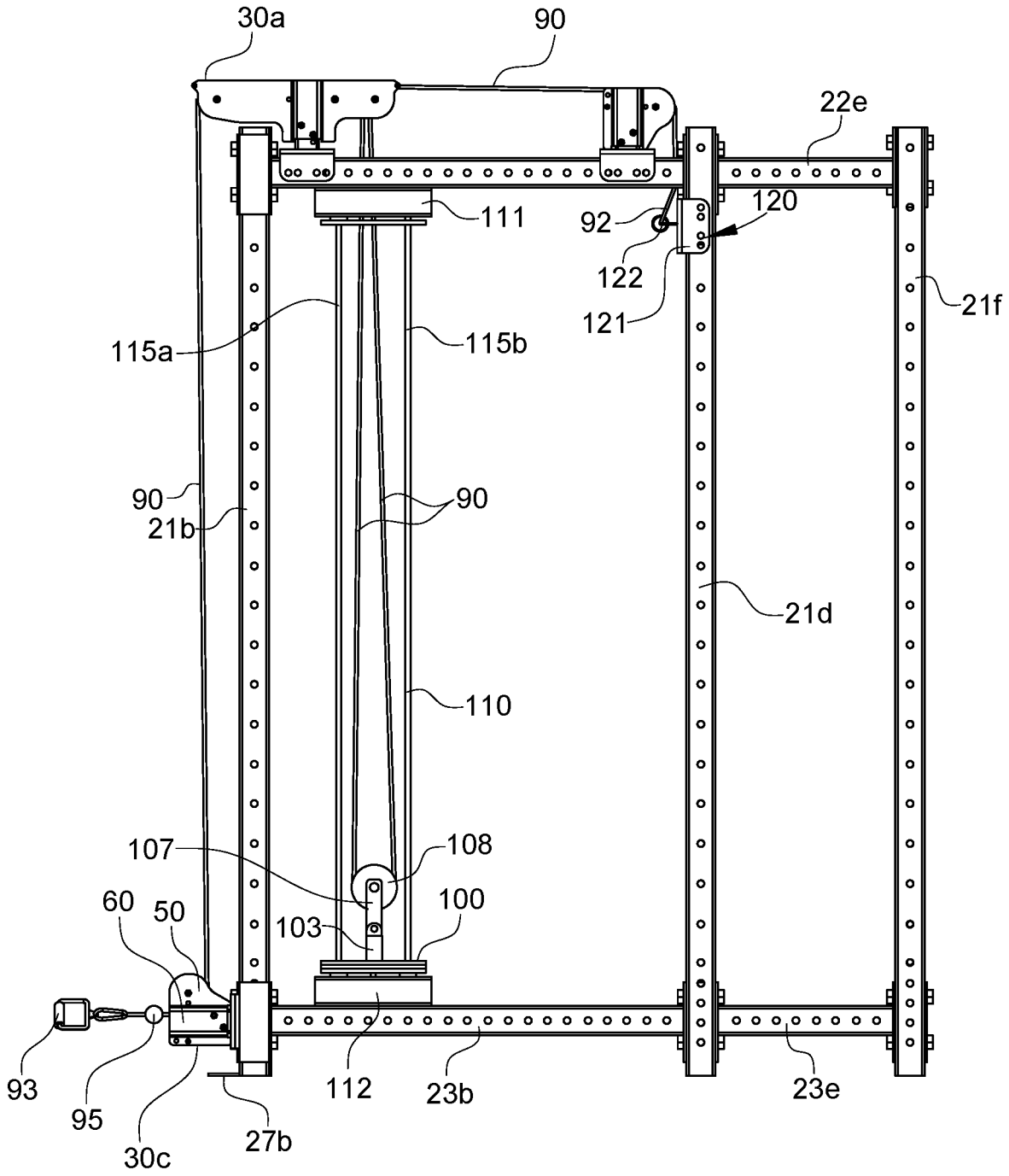
FIG. 10G is a perspective view of an exercise rack pulley system in accordance with an example embodiment.

FIGS. 10F and 10G illustrate a second embodiment in which a weightlifting unit 110 (e.g., weight stack) is utilized in place of the weight 100 and weight rod 103. As shown, upper and lower brackets 111, 112 of the weightlifting unit 110 are secured to the respective second upper and lower arm members 22*b*, 23*b*, with guides 115*a*, 115*b* extending between the upper and lower brackets 111, 112. A stack of weights 100 is slidably positioned between the guides 115*a*, 115*b*, with a weight pulley bracket 107 and weight pulley 108 extending upwardly from the stack of weights 100.

In both embodiments shown in FIGS. 10D-10G, it can be seen that the cable 90 is first routed through and underneath a pulley 70*a* of a first pulley unit 30*c* which is attached to the second support member 21*b*, then routed over three pulleys 70*a*, 70*b*, 70*c* of a second pulley unit 30*a* which is attached to the second upper arm member 22*b*, then routed downwardly between the third and fourth pulleys 70*c*, 70*d* of the second pulley unit 30*a* to wind around the weight pulley 108. The cable 90 is then routed back upwardly between the third and fourth pulleys 70*c*, 70*d* of the second pulley unit 30*a* and over the fourth pulley 70*d*, before being routed through and over the pulley 70*a* of a third pulley unit 30*c* which is attached to the second upper arm member 22*b* and downwardly to terminate at its connection to the cable end connector 120. An exerciser 12 may grasp the first end 91 of the cable 90 (e.g., by a handle 93) and pull outwardly to lift the weight 100 and perform various exercises.

Unless otherwise defined, all technical and scientific terms used herein have the same meaning as commonly understood by one of ordinary skill in the art to which this invention belongs. Although methods and materials similar to or equivalent to those described herein can be used in the practice or testing of the various embodiments of the present disclosure, suitable methods and materials are described above. All patent applications, patents, and printed publications cited herein are incorporated herein by reference in their entireties, except for any definitions, subject matter disclaimers or disavowals, and except to the extent that the incorporated material is inconsistent with the express disclosure herein, in which case the language in this disclosure controls. The various embodiments of the present disclosure may be embodied in other specific forms without departing from the spirit or essential attributes thereof, and it is therefore desired that the various embodiments in the present disclosure be considered in all respects as illustrative and not restrictive. Any headings utilized within the description are for convenience only and have no legal or limiting effect.

What is claimed is:

1. An exercise rack pulley system, comprising:

a bracket adapted to be removably connected to a horizontal member of an exercise rack, wherein the bracket includes a first connector;

a frame, wherein the frame includes a second connector;

wherein the second connector of the frame is removably connected to the first connector of the bracket in one of at least two different orientations comprising a first position and a second position, wherein the second position is rotatably offset by 90 degrees from the first position;

a first pulley rotatably connected to the frame; and a pin that removably connects the first connector of the bracket to the second connector of the frame in either of the first position or the second position, wherein the pin extends through an aperture of the first connector of the bracket and through an aperture of the second connector of the frame that is aligned with the aperture of the first connector of the bracket.

2. The exercise rack pulley system of claim 1, wherein the first connector and the second connector each comprise a round cross-section.

3. The exercise rack pulley system of claim 1, wherein the first connector and the second connector each comprise a square cross-section.

4. The exercise rack pulley system of claim 1, wherein the pin includes a handle.

5. The exercise rack pulley system of claim 1, wherein the pin is comprised of a threaded fastener.

6. The exercise rack pulley system of claim 1, wherein the pin is adapted to lock the frame in the first position or the second position.

7. The exercise rack pulley system of claim 1, wherein the first connector is comprised of a male connector, wherein the second connector is comprised of a female receiver, and wherein the first connector is adapted to be inserted into the second connector.

8. The exercise rack pulley system of claim 1, wherein the first connector is connected to the bracket, and wherein the second connector is connected to the frame.

9. The exercise rack pulley system of claim 1, wherein the first connector extends upwardly from an upper end of the bracket.

10. The exercise rack pulley system of claim 1, wherein the bracket is comprised of a U-shaped member including a channel adapted to receive the horizontal member of the exercise rack.

11. The exercise rack pulley system of claim 1, wherein the frame includes a first wing and a second wing, wherein the first pulley is rotatably connected to the first wing, and further comprising a second pulley rotatably connected to the second wing.

12. The exercise rack pulley system of claim 1, wherein the frame is comprised of a first member and a second member, wherein the first member and the second member are spaced-apart so as to define a slot, and wherein the first pulley is rotatably connected within the slot.

13. A method of adjusting the exercise rack pulley system of claim 1, comprising the steps of:

removing the pin from the first connector and the second connector;

rotating the frame with respect to the bracket; and inserting the pin through the first connector and the second connector.

14. The method of claim 13, further comprising the steps of:

lifting the frame upwardly and away from the bracket; and lowering the frame downwardly onto the bracket.

15. The exercise rack pulley system of claim 1, wherein the second connector of the frame is removably connected to the first connector of the bracket in one of at least four different orientations, comprising the first position, the second position, a third position, and a fourth position.

16. An exercise rack pulley system, comprising:

an exercise rack including a plurality of support members and a plurality of arms, wherein each of the plurality of support members are vertically-oriented, and wherein each of the plurality of arms are horizontally-oriented;

a bracket removably connected to one of the plurality of arms of the exercise rack, wherein the bracket includes a first connector;

a frame, wherein the frame includes a second connector;;

a first pulley rotatably connected to the frame;

wherein the second connector of the frame is removably connected to the first connector of the bracket in one of at least two different orientations comprising a first position and a second position, wherein the second position is rotatably offset by 90 degrees from the first position;

a pin that removably connects the first connector of the bracket to the second connector of the frame in either of the first position or the second position, wherein the pin extends through an aperture of the first connector of the bracket and through an aperture of the second connector of the frame that is aligned with the aperture of the first connector of the bracket;

a weight; and a cable connected to the weight, wherein the cable extends over the first pulley, and wherein the cable includes a handle.

17. The exercise rack pulley system of claim 16, wherein the bracket is comprised of a U-shaped member including a channel adapted to receive the one of the plurality of arms of the exercise rack.

18. The exercise rack pulley system of claim 16, wherein the second connector of the frame is removably connected to the first connector of the bracket in one of at least four different orientations, comprising the first position, the second position, a third position, and a fourth position.

19. An exercise rack pulley system, comprising:

a bracket adapted to be removably connected to a horizontal member of an exercise rack, wherein the bracket includes a first connector;

a frame, wherein the frame includes a second connector;

wherein the second connector of the frame is removably connected to the first connector of the bracket in one of at least two different orientations comprising a first position and a second position, wherein the second position is rotatably offset by 90 degrees from the first position;

a first pulley rotatably connected to the frame;

a pin that removably connects the first connector of the bracket to the second connector of the frame in either of the first position or the second position, wherein the pin extends through an aperture of the first connector of the bracket and through an aperture of the second connector of the frame that is aligned with the aperture of the first connector of the bracket;

wherein the first connector is comprised of a male connector, wherein the second connector is comprised of a female receiver, and wherein the first connector is adapted to be inserted into the second connector;

wherein the first connector extends upwardly from an upper end of the bracket; and wherein the bracket is comprised of a U-shaped member including a channel adapted to receive the horizontal member of the exercise rack.

20. The exercise rack pulley system of claim 19, wherein the second connector of the frame is removably connected to the first connector of the bracket in one of at least four different orientations, comprising the first position, the second position, a third position, and a fourth position.

* * * * *